US006537715B2

(12) United States Patent
Mizoo et al.

(10) Patent No.: US 6,537,715 B2
(45) Date of Patent: Mar. 25, 2003

(54) TONER, IMAGE-FORMING METHOD AND PROCESS CARTRIDGE

(75) Inventors: Yuichi Mizoo, Ibaraki (JP); Takeshi Naka, Shizuoka (JP); Masami Azuma, Ibaraki (JP); Takashige Kasuya, Shizuoka (JP); Tadashi Dojo, Shizuoka (JP); Tsuneo Nakanishi, Chiba (JP); Nene Shibayama, Shizuoka (JP); Katsuhisa Yamazaki, Shizuoka (JP); Yusuke Hasegawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/912,915

(22) Filed: Jul. 26, 2001

(65) Prior Publication Data

US 2002/0072006 A1 Jun. 13, 2002

(30) Foreign Application Priority Data

Jul. 28, 2000 (JP) ..... 2000-228075
Apr. 6, 2001 (JP) ..... 2001-108468

(51) Int. Cl.[7] ..... G03G 9/00

(52) U.S. Cl. ..... 430/108.22; 430/108.5; 430/110.3; 430/110.4; 430/137.2

(58) Field of Search ..... 430/108.22, 108.5, 430/110.3, 110.4, 137.2

(56) References Cited

U.S. PATENT DOCUMENTS

| | | | | |
|---|---|---|---|---|
| 2,297,691 | A | 10/1942 | Carlson | 95/5 |
| 4,356,245 | A | 10/1982 | Hosono et al. | 430/122 |
| 4,844,349 | A | 7/1989 | Kanda et al. | 241/19 |
| 4,851,865 | A | 7/1989 | Ehara et al. | 346/160.1 |
| 4,883,735 | A | 11/1989 | Watanabe et al. | 430/109 |
| 5,096,798 | A | 3/1992 | Kanbe et al. | 430/120 |
| 5,240,803 | A | 8/1993 | Ota | 430/106 |
| 5,721,433 | A | 2/1998 | Kosaka | 250/573 |
| 5,800,959 | A | 9/1998 | Ikami | 430/126 |

FOREIGN PATENT DOCUMENTS

| | | |
|---|---|---|
| JP | 42-23910 | 11/1942 |
| JP | 43-24748 | 10/1943 |
| JP | 54-42141 | 4/1979 |
| JP | 55-18656 | 2/1980 |
| JP | 63-101858 | 5/1988 |
| JP | 63-184762 | 7/1988 |
| JP | 2-87157 | 3/1990 |
| JP | 3-84558 | 4/1991 |
| JP | 3-161761 | 7/1991 |
| JP | 3-229268 | 10/1991 |
| JP | 4-1766 | 1/1992 |
| JP | 4-102862 | 4/1992 |
| JP | 8-136439 | 5/1996 |
| JP | 9-26672 | 1/1997 |
| JP | 2000-56518 | 2/2000 |

*Primary Examiner*—Mark A. Chapman
(74) *Attorney, Agent, or Firm*—Fitzpatrick, Cella, Harper & Scinto

(57) ABSTRACT

A toner has toner particles containing at least a binder resin, a colorant and a sulfur-containing compound selected from the group consisting of a sulfur-containing polymer and a sulfur-containing copolymer. The toner has a weight-average particle diameter of from 5 $\mu$m to 12 $\mu$m, and the toner has, in its particles of 3 $\mu$m or larger in diameter, at least 90% by number of particles with a circularity of 0.900 or higher, and has a specific relationship between the cut rate Z and the toner weight-average particle diameter X and a specific relationship between the number-based cumulative value Y of particles with a circularity of 0.950 or higher and the toner weight-average particle diameter X. Also disclosed are an image-forming method and a process cartridge which make use of the toner.

36 Claims, 16 Drawing Sheets

TONER, IMAGE-FORMING METHOD AND PROCESS CARTRIDGE

BACKGROUND OF THE INVENTION

1. Field of the Invention

This invention relates to a toner used in image-forming processes such as electrophotography, electrostatic recording, electrostatic printing and toner jet recording, and also relates to an image-forming method and a process cartridge which make use of the toner.

2. Related Background Art

A number of methods as disclosed in U.S. Pat. No. 2,297,691, Japanese Patent Publication No. 42-23910 and No. 43-24748 are known as methods for electrophotography. In general, recorded images are obtained by forming an electrostatic latent image on a photosensitive member by various means utilizing a photoconductive material, subsequently developing the latent image by the use of a toner to form a toner image, and transferring the toner image to a transfer medium such as paper as occasion calls, followed by fixing by the action of heat, pressure, heat-and-pressure, or solvent vapor.

In recent years, as copying machines and printers have been made to have multiple function, to record images in a higher image quality and to have a higher process speed, toners have also become required to have much severer performances. Accordingly, toners are made smaller in particle diameter and are required to have particle size distribution which is sharp enough to contain no coarse particles and less ultrafine powder.

Making toners have a smaller particle diameter can improve the resolution and sharpness of images, but brings about various problems.

For one thing, making a toner have a small particle diameter results in a large specific surface area of the toner and hence a broad distribution of its charge quantity, to tend to cause fog on non-image areas when the toner participates in development. Also, the chargeability of toners more tends to be affected by environment. In order to make this fog less occur, it is also attempted to make toners have a sharp particle size distribution. This, however, may be the cause of a cost increase due to, e.g., a low yield in the production of toners.

Moreover, where toners are made to have a small particle diameter, the dispersibility of other internal additives in binder resin tends to more affect the performances of toners.

To cope with such problems, it is common to add charge control agents to toners in order to impart the desired triboelectric charges to the toners.

Nowadays, charge control agents known in the present technical field include, metal complexes of monoazo dyes, metal complexes of hydroxycarboxylic acids, dicarboxylic acids or aromatic diols and resins containing acid components, which are known as negative triboelectric charge control agents. As positive triboelectric charge control agents, Nigrosine dyes, azine dyes, triphenylmethane dyes, quaternary ammonium salts and polymers having a quaternary ammonium salt in the side chain are known in the art. Most of these charge control agents, however, are color agents and are often not usable in color toners.

In addition, some charge control agents have disadvantages that it is difficult to balance image density and fog, it is difficult to attain sufficient image density in a high-humidity environment, they have a poor dispersibility in resins, and they may adversely affect storage stability, fixing performance and anti-offset properties.

In recent years, from the viewpoint of triboelectric charge control and safety, studies are being made on charge control resins. Japanese Patent Application Laid-Open No. 63-184762 discloses a method in which a polymer of a styrene monomer with 2-acrylamido-2-methylsulfonic acid is used. Japanese Patent Application Laid-Open No. 3-161761 discloses a method in which the polymer of a styrene monomer with 2-acrylamido-2-methylsulfonic acid is used as a charge control agent with respect to a polyester resin. Japanese Patent Application Laid-Open No. 2000-56518 discloses a toner which contains as a charge control agent a sulfonic-acid-group-containing acryl- or methacrylamide copolymer having a specific glass transition temperature. These methods can provide a superior triboelectric chargeability, but can not be said to be satisfactory in respect of any environmental variation, lapse of time and condition of use which are to be dealt with adequately as the toners are made to have a smaller particle diameter, in particular, on making image quality higher, and also in respect of an improvement in transfer efficiency taking account of environmental problems as stated later.

In the above photographic process, transfer residual toner is present on the photosensitive member after the toner image has been transferred from the surface of the photosensitive member to the transfer medium. In order to perform continuous copying quickly, this residual toner on the photosensitive member must be removed by cleaning. The residual toner thus removed and collected is further put into a container or collection box provided inside the main body, and thereafter discarded or recycled through a circulation step.

To grapple with environmental problems, a construction designed to provide a recycle system inside the main body is required as a waste-tonerless system. However, in order to make copying machines and printers have multiple function, record images in a higher image quality and have a higher process speed, a fairly large recycle system is required in the main body, resulting in large copying machines and printers in themselves. This is not feasible for making machines small-size from the viewpoint of space saving. The same applies also in a system in which the waste toner is held in a container or collection box provided inside the main body and a system in which the photosensitive member and the part where the waste toner is collected are set in one unit.

To deal with these adequately, it is necessary to improve the transfer efficiency required when the toner image is transferred from the surface of the photosensitive member to the transfer medium.

Japanese Patent Application Laid-Open No. 9-26672 discloses a method in which in a toner produced by pulverization a transfer efficiency improver having an average particle diameter of 0.1 to 3 $\mu$m and a hydrophobic fine silica powder having a BET specific surface area of 50 to 300 $m^2/g$ are incorporated so that the toner can have a low volume resistance and the transfer efficiency improver can form a thin-film layer on the photosensitive member so as to improve the transfer efficiency. However, since the toner produced by pulverization has particle size distribution, it is difficult to afford a uniform effect on all particles. Accordingly, it is necessary to make further improvement.

As a means for improving the transfer efficiency, Japanese Patent Application Laid-Open No. 3-84558, No. 3-229268, No. 4-1766 and No. 4-102862 disclose toners produced by processes such as spray granulation, solution dissolution, and polymerization so that toner particles can have a shape close to spheres. Production of such toners, however, not only requires large-scale equipment, but also tends to cause a problem concerned with cleaning just because of the toner particles made close to true spheres.

As common processes for producing toners, a binder resin for making toner fix to transfer mediums, a colorant of various types for giving color to toner and a charge control agent for imparting electric charges to toner particles are used as materials. In addition to such materials, in one-component development as disclosed in Japanese Patent Application Laid-Open No. 54-42141 and No. 55-18656, a magnetic material of various types for imparting transport performance to the toner itself is added. If necessary, other additives such as a release agent and a fluidity-providing agent are further added, and these are dry-process mixed. Thereafter, the mixture obtained is melt-kneaded by means of a general-purpose kneading machine such as a roll mill or an extruder, followed by cooling to solidify, and then the kneaded product is crushed. The crushed product obtained is pulverized by means of a grinding machine of various types such as a jet-stream grinding machine and a mechanical-impact grinding machine. Then the pulverized product obtained is introduced into an air classifier of various types to carry out classification to obtain toner particles put to have particle diameters necessary as toners, optionally followed by further external addition of a fluidizer or a lubricant and dry-process blending to obtain toners. Also, in the case of two-component developers, the above toners are used after they are blended with various carriers.

In order to obtain fine toner particles as stated above, a conventional process shown in FIG. 10 as a flow chart is commonly employed.

The crushed product for toner is continuously or successively fed into a first classification means. Classified coarse powder composed chiefly of a group of coarse particles larger than a prescribed particle size is pulverized by means of a pulverization means, and thereafter circulated to the first classification means again.

Other finely pulverized product for toner which is composed chiefly of particles within the prescribed particle size and particles smaller than the prescribed particle size is sent to a second classification means, and is classified into median powder composed chiefly of a group of particles having the prescribed particle size and fine powder composed chiefly of a group of particles smaller than the prescribed particle size. However, where toners are made to have smaller particle diameter, electrostatic agglomeration between particles may greatly occur. The toner particles which are originally to be sent to the second classification means are circulated to the first classification again to tend to produce excessively pulverized fine powder and ultrafine powder.

Various types of grinding machines are used as pulverization means. To pulverize the crushed product composed chiefly of binder resin, a jet-stream grinding machine, in particular, a collision air grinding machine making use of jet streams as shown in FIG. 13 is used.

In the collision air grinding machine making use of high-pressure gas such as jet streams, a powder material is transported by jet streams and jetted from an outlet of an accelerating tube to cause the powder material to collide against the colliding surface of a collision member provided facing the open end of the outlet of the accelerating tube, and the powder material is pulverized by the aid of impact force of the collision.

In the collision air grinding machine shown in FIG. 13, a collision member 164 is provided facing an outlet 163 of an accelerating tube 162 to which a high-pressure gas feed nozzle 161 is connected. By the aid of high-pressure gas fed to the accelerating tube 162, the powder material is sucked into the accelerating tube 162 from a powder material feed opening 165 made to communicate with the accelerating tube 162 at its halfway point. The powder material is jetted together with the high-pressure gas, caused to collide against a colliding surface 166 of the collision member 164, and pulverized by the aid of the impact force of the collision. The pulverized product is discharged out of a pulverization chamber 168 through a pulverized product discharge opening 167.

However, since the above collision air grinding machine is so constructed that the powder material is jetted together with the high-pressure gas, caused to collide against the colliding surface of the collision member, and pulverized by the aid of impact force of the collision, the toner particles thus obtained by pulverization may be amorphous and have a squared shape.

Japanese Patent Application Laid-Open No. 2-87157 discloses a method in which toner particles produced by pulverization are subjected to mechanical impact (hybridizer) to modify the shape and surface properties of the particles so as to improve transfer efficiency. This method, however, requires to further provide a post-treatment step for the pulverization, and hence it can not be said to be a preferable method in view of the productivity of toners and also because the toner particle surfaces become close to an unevenness-free state to necessitate an improvement with respect to development.

With regard to the classification means, various types of gas current classifiers and methods are proposed. Among them, a classifier making use of a rotating blade and a classifier having no movable part are available. Of these, the classifier having no movable part includes a stationary wall centrifugal classifier and an inertial classifier. Such a classifier that utilizes an inertia force is disclosed in Japanese Patent Publication No. 54-24745 and No. 55-6433 and Japanese Patent Application Laid-Open No. 63-101858.

In these gas current classifiers, as shown in FIG. 8, a powder material is jetted into a classification zone of a classifying chamber together with gas currents at a high speed from a feed nozzle having an opening at the classification zone. In the classifying chamber, a centrifugal force of curved gas currents flowing along a Coanda block 145 separates the powder material into coarse powder, median powder and fine powder, and edges 146 and 147, having slender tips, classify it into the coarse powder, the median powder and the fine powder.

In such a conventional classifier 57, a finely pulverized material is introduced from a material feed nozzle. Powder particles flowing inside pyramidal tubes 148 and 149 have a tendency of flowing with a screwing force acting straight in parallel to the tube walls. In the material feed nozzle, however, the powder material separates roughly into an upper stream and a lower stream when introduced from the upper part. Light fine powder tends to be contained in the upper stream in a large quantity, and heavy coarse powder in the lower stream in a large quantity, where the corresponding particles flow independently. Hence, depending on the portion from which the powder material is introduced into the classifier, the respective flows may draw different loci or the coarse powder disturbs the locus of the fine powder, bringing about a limitation to the improvement in classification precision and also tending to lower the precision when a powder material containing coarse particles of 20 μm or larger diameter in a large quantity is classified.

In general, toners are required to have many and different properties. To attain such required properties depends on base materials to be used of course, and also on production methods in many cases. In the classification step for toners, classified particles are required to have a sharp particle size distribution. It is also sought to produce good-quality toners at a low cost, in a good efficiency and stably.

In addition, in order to improve image quality in copying machines and printers, toners are made smaller in particle diameter and are required to have particle size distribution which is sharp enough to contain no coarse particles and less ultrafine powder. In general, as substance becomes finer, interparticle force acts more greatly. The same applies to resins and toners, and particles become more greatly agglomerative to one another as they become finer in size.

Especially when it is attempted to obtain a toner having a weight-average particle diameter of 10 μm or smaller and a sharp particle size distribution, any conventional apparatus and methods cause a lowering of classification yield. Also when it is attempted to obtain a toner having a weight-average particle diameter of 8 μm or smaller and a sharp particle size distribution, any conventional apparatus and methods especially not only cause a lowering of classification yield, but also tend to result in inclusion of ultrafine powder in a large quantity.

Moreover, in the toners made to have smaller particle diameter, what is relatively important is the compatibility of individual materials contained in toners, so that a severer restriction than ever is imposed in respect of developing performance, too.

Namely, inclusive of the productivity of the toner itself, it is long-awaited to provide a toner having a high developing performance, which has been improved in transfer efficiency for the purpose of lessening the transfer residual toner on the photosensitive member, which is left as waste toner.

SUMMARY OF THE INVENTION

An object of the present invention is to provide a toner having a transfer efficiency high enough to leave less waste toner.

Another object of the present invention is to provide a toner which can maintain good developing performance even with its particle diameter made smaller.

Still another object of the present invention is to provide a toner which is not affected by any environment of image reproduction, and can maintain a good developing performance even in a high-temperature high-humidity environment and in a normal-temperature low-humidity environment.

A further object of the present invention is to provide a toner which can be produced in a high productivity with ease by pulverization.

A still further object of the present invention is to provide an image-forming method which make use of the above toner.

A still further object of the present invention is to provide a process cartridge which has the above toner.

To achieve the above objects, the present invention provides a toner comprising toner particles containing at least (i) a binder resin, (ii) a colorant and (iii) a sulfur-containing compound selected from the group consisting of a sulfur-containing polymer and a sulfur-containing copolymer, wherein;

the toner has a weight-average particle diameter of from 5 μm to 12 μm; and the toner has, in its particles of 3 μm or larger in diameter, at least 90% by number of particles with a circularity a of 0.900 or higher as determined from the following expression (1):

$$\text{Circularity } a = L_0/L \quad (1)$$

where $L_0$ represents the circumferential length of a circle having the same projected area as a particle image, and L represents the circumferential length of the particle image;

and in which;

a) the relationship between cut rate Z and toner weight-average particle diameter X satisfies the following expression (2):

$$\text{Cut rate } Z \leqq 5.3 \times X \quad (2)$$

provided that the cut rate Z is represented by the following expression (3):

$$Z = (1 - B/A) \times 100 \quad (3)$$

where A is the particle concentration of the whole measured particles as measured with a flow-type particle image analyzer FPIA-1000, manufactured by Toa Iyou Denshi K.K., and B is the particle concentration of measured particles of 3 μm or larger in circle-corresponding diameter; and in the particles of 3 μm or larger in diameter of the toner and in the number-based circularity distribution of the circularity a, the relationship between the number-based cumulative value Y of particles with a circularity a of 0.950 or higher and the toner weight-average particle diameter X satisfies the following expression (4):

$$\text{Number-based cumulative value } Y \text{ of particles with a circularity } a \text{ of 0.950 or higher} \geqq \exp 5.51 \times X^{-0.645} \quad (4)$$

provided that the toner weight-average particle diameter X is from 5.0 μm to 12.0 μm; or b) the relationship between the cut rate Z and the toner weight-average particle diameter X satisfies the following expression (5):

$$\text{Cut rate } Z > 5.3 \times X \quad (5);$$

and in the particles of 3 μm or larger in diameter of the toner and in the number-based circularity distribution of the circularity a, the relationship between the number-based cumulative value Y of particles with a circularity a of 0.950 or higher and the toner weight-average particle diameter X satisfies the following expression (6):

$$\text{Number-based cumulative value } Y \text{ of particles with a circularity } a \text{ of 0.950 or higher} \geqq \exp 5.37 \times X^{-0.545} \quad (6)$$

provided that the toner weight-average particle diameter X is from 5.0 μm to 12.0 μm.

The present invention also provides an image-forming method comprising the steps of:

forming an electrostatic latent image on an electrostatic-image-bearing member;

developing the electrostatic latent image with a toner held in a developing means, to form a toner image;

transferring the toner image thus formed, to a transfer medium via, or not via, an intermediate transfer member;

fixing the toner image held on the transfer medium, to the transfer medium by heat-and-pressure fixing means; wherein;

the toner comprises toner particles containing at least (i) a binder resin, (ii) a colorant and (iii) a sulfur-containing compound selected from the group consisting of a sulfur-containing polymer and a sulfur-containing copolymer, wherein;

the toner has a weight-average particle diameter of from 5 $\mu$m to 12 $\mu$m; and the toner has, in its particles of 3 $\mu$m or larger in diameter, at least 90% by number of particles with a circularity a of 0.900 or higher as determined from the following expression (1):

$$\text{Circularity } a = L_0/L \quad (1)$$

where $L_0$ represents the circumferential length of a circle having the same projected area as a particle image, and L represents the circumferential length of the particle image;

and in which;

a) the relationship between cut rate Z and toner weight-average particle diameter X satisfies the following expression (2):

$$\text{Cut rate } Z \leqq 5.3 \times X \quad (2)$$

provided that the cut rate Z is represented by the following expression (3):

$$Z = (1 - B/A) \times 100 \quad (3)$$

where A is the particle concentration of the whole measured particles as measured with a flow-type particle image analyzer FPIA-1000, manufactured by Toa Iyou Denshi K.K., and B is the particle concentration of measured particles of 3 $\mu$m or larger in circle-corresponding diameter; and in the particles of 3 $\mu$m or larger in diameter of the toner and in the number-based circularity distribution of the circularity a, the relationship between the number-based cumulative value Y of particles with a circularity a of 0.950 or higher and the toner weight-average particle diameter X satisfies the following expression (4):

$$\text{Number-based cumulative value } Y \text{ of particles with a circularity } a \text{ of 0.950 or higher} \geqq \exp 5.51 \times X^{-0.645} \quad (4)$$

provided that the toner weight-average particle diameter X is from 5.0 $\mu$m to 12.0 $\mu$m; or b) the relationship between the cut rate Z and the toner weight-average particle diameter X satisfies the following expression (5):

$$\text{Cut rate } Z > 5.3 \times X \quad (5);$$

and in the particles of 3 $\mu$m or larger in diameter of the toner and in the number-based circularity distribution of the circularity a, the relationship between the number-based cumulative value Y of particles with a circularity a of 0.950 or higher and the toner weight-average particle diameter X satisfies the following expression (6):

$$\text{Number-based cumulative value } Y \text{ of particles with a circularity } a \text{ of 0.950 or higher} \geqq \exp 5.37 \times X^{-0.545} \quad (6)$$

provided that the toner weight-average particle diameter X is from 5.0 $\mu$m to 12.0 $\mu$m.

The present invention still also provides a process cartridge comprising an electrostatic-image-bearing member and a developing means for developing with a toner an electrostatic latent image formed on the electrostatic-image-bearing member;

the electrostatic-image-bearing member and the developing means being supported in one unit to constitute the process cartridge, and the process cartridge being detachably mountable to the main body of an image-forming apparatus; wherein;

the toner comprises toner particles containing at least (i) a binder resin, (ii) a colorant and (iii) a sulfur-containing compound selected from the group consisting of a sulfur-containing polymer and a sulfur-containing copolymer, wherein;

the toner has a weight-average particle diameter of from 5 $\mu$m to 12 $\mu$m; and the toner has, in its particles of 3 $\mu$m or larger in diameter, at least 90% by number of particles with a circularity a of 0.900 or higher as determined from the following expression (1):

$$\text{Circularity } a = L_0/L \quad (1)$$

where $L_0$ represents the circumferential length of a circle having the same projected area as a particle image, and L represents the circumferential length of the particle image;

and in which;

a) the relationship between cut rate Z and toner weight-average particle diameter X satisfies the following expression (2):

$$\text{Cut rate } Z \leqq 5.3 \times X \quad (2)$$

provided that the cut rate Z is represented by the following expression (3):

$$Z = (1 - B/A) \times 100 \quad (3)$$

where A is the particle concentration of the whole measured particles as measured with a flow-type particle image analyzer FPIA-1000, manufactured by Toa Iyou Denshi K.K., and B is the particle concentration of measured particles of 3 $\mu$m or larger in circle-corresponding diameter; and in the particles of 3 $\mu$m or larger in diameter of the toner and in the number-based circularity distribution of the circularity a, the relationship between the number-based cumulative value Y of particles with a circularity a of 0.950 or higher and the toner weight-average particle diameter X satisfies the following expression (4):

$$\text{Number-based cumulative value } Y \text{ of particles with a circularity } a \text{ of 0.950 or higher} \geqq \exp 5.51 \times X^{-0.645} \quad (4)$$

provided that the toner weight-average particle diameter X is from 5.0 $\mu$m to 12.0 $\mu$m; or b) the relationship between the cut rate Z and the toner weight-average particle diameter X satisfies the following expression (5):

Cut rate $Z>5.3\times X$ (5);

and in the particles of 3 μm or larger in diameter of the toner and in the number-based circularity distribution of the circularity a, the relationship between the number-based cumulative value Y of particles with a circularity a of 0.950 or higher and the toner weight-average particle diameter X satisfies the following expression (6):

Number-based cumulative value $Y$ of particles with a circularity $a$ of 0.950 or higher $\geqq \exp 5.37\times X^{-0.545}$ (6)

provided that the toner weight-average particle diameter X is from 5.0 μm to 12.0 μm.

DESCRIPTION OF THE PREFERRED EMBODIMENTS

Figure 1:
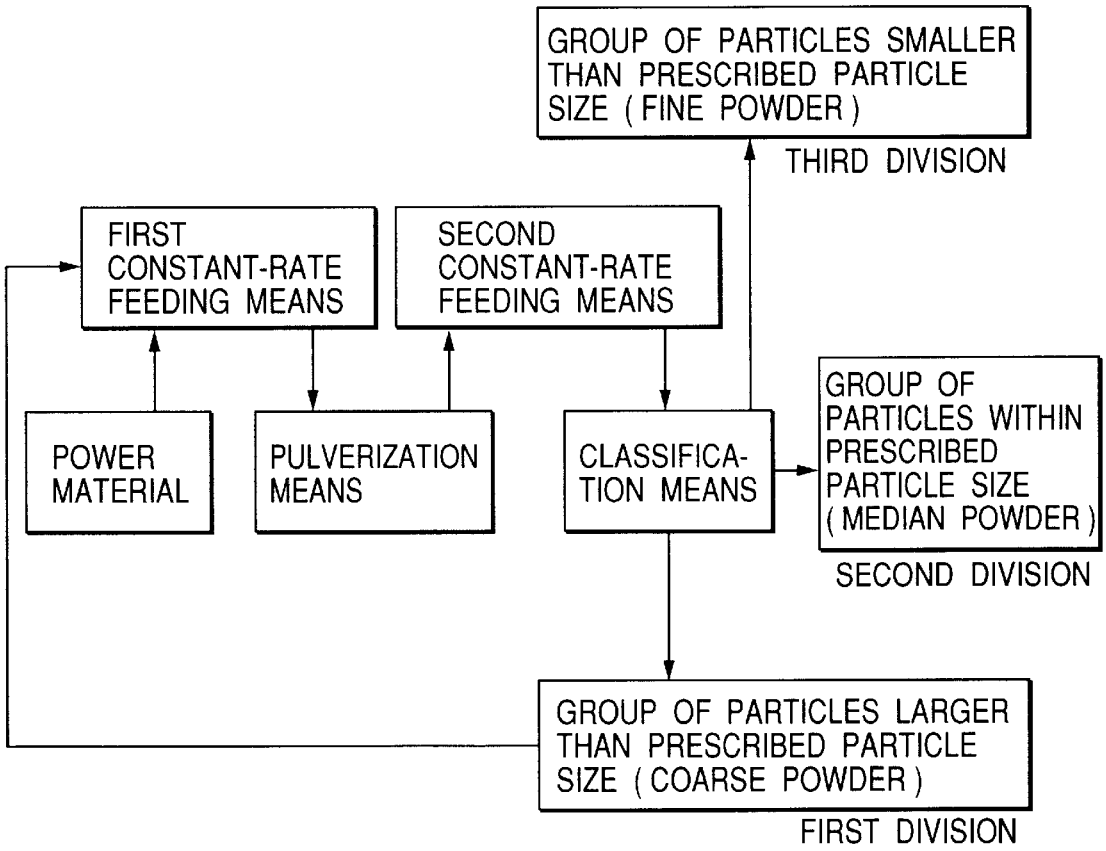
FIG. 1 is a flow chart for describing a preferred process for producing the toner of the present invention.

The present inventors have carried on studies with regard to the particle diameter and shape of toners and toner particles produced by pulverization, and have discovered that the circularity in particles of 3 μm or larger in diameter correlates closely with the transfer performance and developing performance (image quality) and fixing performance.

Moreover, in order to attain the same effect in a toner having particles with different particle diameters, the circularity in particles of 3 μm or larger in diameter must be controlled on the basis of weight-average particle diameter of the toner and content of fine powder of 3 μm or smaller in diameter.

When the circularity in particles of 3 μm or larger in diameter is prescribed on the basis of weight-average particle diameter of the toner and content of fine powder of 3 μm or smaller in diameter, a toner having superior transfer performance and developing performance (image quality) and fixing performance can be obtained.

In addition, when a specific pulverization and classification system is used, the toner of the present invention can be produced by a simple method which has not been available in conventional methods.

Now, a pulverization and classification system which enables optimum production of the toner of the present invention is a system in which toner particles are formed from a median powder obtained by;

melt-kneading a mixture containing at least a binder resin, a colorant and a sulfur-containing compound, cooling the kneaded product obtained, and thereafter crushing the cooled product by a crushing means;

introducing the crushed product obtained as a powder material, into a first constant-rate feeder;

introducing the powder material in a stated quantity into a mechanical grinding machine from the first constant-rate feeder via a powder material inlet of the mechanical grinding machine; the mechanical grinding machine having at least a rotor comprising a rotator attached to the center rotating shaft and a stator which is provided around the rotor, keeping a certain space between it and the rotor surface, and being so constructed that a circular space formed by keeping the space stands airtight;

rotating the rotor of the mechanical grinding machine at a high speed to finely pulverize the powder material to form a finely pulverized product having a weight-average particle diameter of from 5 to 12 μm and containing 70% by number or less of particles of 4.0 μm or smaller in particle diameter and 25% by volume or less of particles of 10.1 μm or larger in particle diameter;

discharging the finely pulverized product from a powder material discharge opening of the mechanical grinding machine and introducing the finely pulverized product into a second constant-rate feeder;

introducing the finely pulverized product in a stated quantity into a multi-division gas current classifier which classifies the powder material by utilizing the crossed gas streams and Coanda effect;

classifying the finely pulverized powder in the multi-division gas current classifier into at least fine powder, median powder and coarse powder to obtain the median powder; and mixing the classified coarse powder with the powder material and introducing them into the mechanical grinding machine to carry out pulverization and classification to obtain the median powder. The system will be detailed later.

Making toner particles have a small particle diameter results in a large specific surface area of the toner particles. This makes the toner greatly agglomerative and adherent. Hence, when the toner image is transferred from the surface of the photosensitive member to the transfer medium via, or not via, an intermediate transfer member, the force of adherence may strongly act between the photosensitive member and the toner to lower its transfer efficiency. This tendency is remarkable especially in the case of toner particles produced by conventional methods of pulverization, which are amorphous and have a squared shape.

Even in the case of toners having small particle diameter, making them have an adherence equal to or smaller than that of toners having ordinary particle diameter leads to an improvement in transfer efficiency.

Making toner particles spherical makes small the contact area between the toner particles and the photosensitive member and makes it possible to improve the transfer efficiency. However, it is very difficult to produce truly spherical toner particles in the case of pulverization toners. Accordingly, a method is contemplated in which the corners of toner particles obtained by pulverization are round off to smoothen their surfaces so as to make them closely spherical. This enables improvement in the transfer efficiency of toner, but there are various problems inherent in the pulverization, and it has been necessary to make further studies.

In the case when the toners made to have small particle diameter are used, a good dot reproducibility can be achieved, but fog and spots around line images tend to occur. This is considered to be caused by inclusion of fine powder and ultrafine powder in a large quantity because fine toner particles are produced from coarse particles obtained by crushing. Toner particles having different particle diameters have different charging characteristics and also have different adherence. Hence, making a toner have small particle diameter makes the toner have a broad charge quantity distribution. Moreover, this tendency is more remarkable when the charge control agent, added for the purpose of imparting charges to the toner, is non-uniformly dispersed.

The toner particles formed by pulverization may also repeatedly be classified to obtain a sharp particle size distribution, but a low productivity of toner may result.

According to studies made by the present inventors, in the toner particles produced by pulverization and in order to keep any waste toner from occurring and also achieve good developing performance even in a high-temperature and high-humidity environment and a low-humidity environment by improving the transfer efficiency at the time of transfer of the toner image from the surface of the photosensitive member to the transfer medium, it is important that (1), in toner particles having a binder resin and a colorant, the toner particles contains a sulfur-containing compound so as to improve dispersion with other materials to obtain a toner capable of having a stable charge quantity and (2) the toner, which have toner particles formed by pulverization and classification by means of a production system set up with a specific grinding machine and a specific classifier in combination, has specific particle size distribution and circularity.

When the sulfur-containing compound is used, it may be used as it is without causing any problem. In view of an improvement in compatibility with other materials at the time of melt kneading or an improvement in dispersion when toner particles are made to have small particle diameter, it is preferable for the compound to be pulverized by a known pulverization means to have a uniform particle diameter. The sulfur-containing compound may preferably be made to have an average particle diameter of 300 μm or smaller, and more preferably 150 μm or smaller. This enables more improvement in its compatibility with and dispersibility in other materials, and is effective for keeping fog from occurring especially in a low-humidity environment.

When the toner having a specific circularity is produced, preferred is a toner having a weight-average particle diameter of from 5.0 to 12.0 μm, and more preferred is a toner also containing 40% by number or less of particles of 4.0 μm or smaller in particle diameter and 25% by volume or less of particles of 10.1 μm or larger in particle diameter.

Where a toner having a weight-average particle diameter larger than 12.0 μm is obtained, its production may be dealt with adequately in respect of particle diameter by making the load in the grinding machine as small as possible or treating materials in a large quantity, but toner particles have so squared a shape that it may be difficult to make them have the desired circularity.

Where a toner having a weight-average particle diameter smaller than 5.0 μm is obtained, its production may be dealt with adequately by making the load in the grinding machine as large as possible or treating materials in an extremely small quantity, but toner particles are so closely spherical that it may be difficult to make them have the desired circularity. Moreover, not only it may be difficult to make them have the desired circularity distribution, but also the finer powder or ultrafine powder can not completely be kept from occurring. The same applies also in respect of the content of particles of 4.0 μm or smaller and particles of 10.1 μm or larger.

The toner has, in its particles of 3 μm or larger in diameter, particles with a circularity a of 0.900 or higher as determined from the following expression (1), in a proportion of 90% or larger as number-based cumulative value:

$$\text{Circularity } a = L_0/L \quad (1)$$

where $L_0$ represents the circumferential length of a circle having the same projected area as a particle image, and L represents the circumferential length of the particle image; and in which;

a) the relationship between cut rate Z and toner weight-average particle diameter X satisfies the following expression (2):

$$\text{Cut rate } Z \leqq 5.3 \times X \quad (2)$$

provided that the cut rate Z is represented by the following expression (3):

$$Z = (1 - B/A) \times 100 \quad (3)$$

where A is the particle concentration (number of particles/μl) of the whole measured particles as measured with a flow-type particle image analyzer FPIA-1000, manufactured by Toa Iyou Denshi K.K., and B is the particle concentration (number of particles/μl) of measured particles of 3 μm or larger in circle-corresponding diameter; and in the particles of 3 μm or larger in diameter of the toner and in the number-based circularity distribution of the circularity a, the relationship between the number-based cumulative value Y of particles with a circularity a of 0.950 or higher and the toner weight-average particle diameter X satisfies the following expression (4):

$$\text{Number-based cumulative value } Y \text{ of particles with a circularity } a \text{ of 0.950 or higher} \geqq \exp 5.51 \times X^{-0.645} \quad (4)$$

provided that the toner weight-average particle diameter X is from 5.0 μm to 12.0 μm; or b) the relationship between the cut rate Z and the toner weight-average particle diameter X satisfies the following expression (5):

$$\text{Cut rate } Z > 5.3 \times X \quad (5);$$

and in the particles of 3 μm or larger in diameter of the toner and in the number-based circularity distribution of the circularity a, the relationship between the number-based cumulative value Y of particles with a circularity a of 0.950 or higher and the toner weight-average particle diameter X satisfies the following expression (6):

$$\text{Number-based cumulative value } Y \text{ of particles with a circularity } a \text{ of 0.950 or higher} \geqq \exp 5.37 \times X^{-0.545} \quad (6)$$

provided that the toner weight-average particle diameter X is from 5.0 μm to 12.0 μm. The above $\exp 5.51 \times X^{-0.645}$ indicates $e5.51 \times X^{-0.645}$.

The cut rate Z may preferably satisfy 0<cut rate Z≦5.3×X.

In the case when the toner has such a circularity, the charging of the toner can be controlled with ease and the charging can be made uniform and made stable during running. In addition, in the case when the toner has such a circularity, it has also been found that the toner can be improved in transfer efficiency. This is because, in the case when the toner has such a circularity, the contact area between the toner particles and the photosensitive member can be made small, so that the adherent force may less act between the toner particles and the photosensitive member. Moreover, the toner particles have a specific surface area made smaller than any toners produced by the conventional collision air grinding machine, and hence the toner has a smaller contact area between the toner particles themselves, and the toner powder can have a high bulk density, so that the conduction of heat at the time of fixing can be improved to also bring about the effect of improving fixing performance.

In addition, a case in which the particles with a circularity a of 0.900 or higher in the particles of 3 μm or larger in diameter are present in a proportion smaller than 90% as number-based cumulative value is undesirable because the contact area between the toner particles and the photosensitive member is so large that the adherent force of the toner particles may too greatly act on the photosensitive member to attain any satisfactory transfer efficiency.

Also undesirable is a case in which the relationship between the number-based cumulative value Y of particles with a circularity a of 0.950 or higher, the cut rate Z and the toner weight-average particle diameter X satisfies the expression:

$$\text{Cut rate } Z \leqq 5.3 \times X, \text{ preferably } 0 < \text{cut rate } Z \leqq 5.3 \times X;$$

but does not satisfy:

$$\text{Number-based cumulative value } Y \geqq \exp 5.51 \times X^{-0.645};$$

that is, a case in which it satisfies:

$$\text{Number-based cumulative value } Y < \exp 5.51 \times X^{-0.645};$$

or a case in which it satisfies the expression:

$$\text{Cut rate } Z > 5.3 \times X;$$

but does not satisfy:

$$\text{Number-based cumulative value } Y \geqq \exp 5.37 \times X^{-0.545};$$

that is a case in which it satisfies:

$$\text{Number-based cumulative value } Y < \exp 5.37 \times X^{-0.545}.$$

This is because the adhesion of toner to fixing members and so forth tends to rather more occur and hence not only no satisfactory transfer efficiency can be attained but also the toner may have a poor fluidity.

As one standard of the scattering in shape of particles having such a circularity, the circularity standard deviation SD may be used. In the present invention, the circularity standard deviation SD of the circularity may preferably be in the range of from 0.030 to 0.050, and more preferably from 0.030 to 0.045.

The average circularity referred to in the present invention is used as a simple method for expressing the shape of toner quantitatively. In the present invention, the shape of particles is measured with a flow type particle image analyzer FPIA-1000, manufactured by Toa Iyou Denshi K.K., and the circularity of particles thus measured is calculated according to the following equation (1). As also further shown in the following equation (5), the value obtained when the sum total of circularity of all particles measured is divided by the number of all particles is defined to be the average circularity.

$$\text{Circularity } a = L_0/L \quad (1)$$

wherein $L_0$ represents the circumferential length of a circle having the same projected area as a particle image, and L represents the circumferential length of the particle image.

$$\text{Average circularity } \bar{a} = \sum_{i=1}^{m} ai/m \quad (5)$$

The circularity standard deviation SD is calculated from the following equation (6), where the average circularity determined from the above equations (1) and (5) is represented by $\bar{a}$, the circularity in each particle is represented by ai, and the number of particles measured is represented by m.

$$\text{Circularity standard deviation } SD = \sum_{i=1}^{m} (\bar{a} - ai)^2 / m^{1/2} \quad (6)$$

The circularity referred to in the present invention is an index showing the degree of particle surface unevenness of the toner and toner particles. It is indicated as 1.00 when the particles are perfectly spherical. The more complicate the surface shape is, the smaller the value of circularity is. Also, the SD of circularity distribution in the present invention is an index showing the scattering. It indicates that, the smaller the numerical value is, the sharper distribution the toner and toner particles have.

The measuring device "FPIA-1000" used in the present invention employs a calculation method in which, in calculating the circularity of each particle and thereafter calculating the average circularity and circularity standard deviation, circularities of 0.4 to 1.0 are divided into 61 division ranges, and the average circularity and circularity standard deviation are calculated using the center values and frequencies of divided points. Between the values of the average circularity and circularity standard deviation calculated by this calculation method and the values of the average circularity and circularity standard deviation calculated by the above calculation equation which uses the circularity of each particle directly, there is only a very small accidental error, which is at a level that is substantially negligible. Accordingly, in the present invention, such a calculation method in which the concept of the calculation equation which uses the circularity of each particle directly is utilized and is partly modified may be used, for the reasons of handling data, e.g., making the calculation time short and making the operational equation for calculation simple.

As a specific method for the measurement, 0.1 to 0.5 ml of a surface-active agent (preferably alkylbenzene sulfonate) as a dispersant is added to 100 to 150 ml of water from which any impurities have previously been removed. To this solution, about 0.1 to 0.5 g of a measuring sample is further added. The resultant dispersion in which the sample has been dispersed is subjected to dispersion treatment by means of an ultrasonic dispersion machine for about 1 to 3 minutes. Adjusting the dispersion concentration to 12,000 to 20,000 particles/$\mu$l and using the above flow type particle image analyzer, the circularity distribution of particles having circle-corresponding diameters of from 0.60 $\mu$m to less than 159.21 $\mu$m are measured. Incidentally, since the dispersion concentration is adjusted to 12,000 to 20,000 particles/$\mu$l, particle concentration high enough to be able to keep the precision of analyzer can be maintained.

The summary of measurement is described in a catalog of FPIA-1000 (an issue of June, 1995), published by Toa Iyou Denshi K.K., and in an operation manual of the measuring apparatus and Japanese Patent Application Laid-Open No. 8-136439, and is as follows:

The sample dispersion is passed through channels (extending along the flow direction) of a flat flow cell (thickness: about 200 $\mu$m). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circularity of each particle is calculated from the projected area of the two-dimensional image of each particle and the circumferential length of the projected image according to the above equation for calculating the circularity.

The constitution of toner that is preferable in the present invention for achieving its objects is described below in detail.

The binder resin usable in the present invention may include vinyl resins, polyester resins and epoxy resins. In particular, vinyl resins and polyester resins are preferred in view of charging performance and fixing performance.

Monomers for the vinyl resins may include styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; a-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide; as well as $\alpha,\beta$-unsaturated esters and diesters of dibasic acids. Any of these vinyl monomers may be used alone or in combination of two or more monomers.

Of these, monomers may preferably be used in such a combination that may give a styrene copolymer and a styrene-acrylic copolymer.

Also usable are polymers or copolymers cross-linked with a cross-linkable monomer as exemplified below.

It may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether bond, as exemplified by polyoxyethylene (2)-2,2-bis(4-hydroxyphenyl)propane diacrylate, polyoxyethylene(4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.).

As polyfunctional cross-linkable monomers, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of from 0.01 to 10 parts by weight, and preferably from 0.03 to 5 parts by weight, based on 100 parts by weight of other monomer components.

Of these cross-linkable monomers, monomers preferably usable a resins for toners in view of the fixing performance and anti-offset properties are aromatic divinyl compounds (in particular, divinylbenzene) and diacrylate compounds linked with a chain containing an aromatic group and an ether bond.

In the present invention, a polyurethane, polyvinyl butyral, rosin, a modified rosin, a terpene resin, a phenolic resin, an aliphatic or alicyclic hydrocarbon resin or an aromatic petroleum resin may optionally be mixed with the above binder resin.

In the case when a mixture of two or more types of resins are used as the binder resin, as a more preferable form, those having different molecular weights may preferably be mixed in a suitable proportion.

The binder resin may preferably have a glass transition temperature of from 45 to 80° C., and more preferably from 55 to 70° C., a number-average molecular weight (Mn) of from 2,500 to 50,000 and a weight-average molecular weight (Mw) of from 10,000 to 1,000,000.

As processes for synthesizing vinyl polymers or vinyl copolymers, any of polymerization processes such as bulk polymerization, solution polymerization, suspension polymerization and emulsion polymerization may be used. Where carboxylic acid monomers or acid anhydride monomers are used, it is preferable in view of properties of monomers to use bulk polymerization or solution polymerization.

As an example, the following process is available: Using a monomer such as dicarboxylic acid, dicarboxylic anhydride or dicarboxylic monoester, a vinyl copolymer may be obtained by bulk polymerization or solution polymerization. In the solution polymerization, the dicarboxylic acid or dicarboxylic monoester may partly be converted into an anhydride by designing conditions for evaporation at the time of solvent evaporation. Also, the vinyl copolymer obtained by bulk polymerization or solution polymerization may be subjected to heat treatment to convert it further into an anhydride. The acid anhydride may also partly be esterified with a compound such as an alcohol.

Conversely, the vinyl copolymer thus obtained may be subjected to hydrolysis treatment to cause its acid anhydride group to undergo ring closure so as to be partly made into a dicarboxylic acid.

Meanwhile, using a dicarboxylic acid monoester monomer, a divinyl copolymer obtained by suspension polymerization or emulsion polymerization may be subjected to heat treatment to convert it into an anhydride, or may be subjected to hydrolysis treatment to obtain a dicarboxylic acid from an anhydride by ring opening. A process may be used in which the divinyl copolymer obtained by bulk polymerization or solution polymerization is dissolved in a monomer and then a vinyl polymer or copolymer is obtained by suspension polymerization or emulsion polymerization, where part of the acid anhydride undergoes ring opening and the dicarboxylic acid unit can be obtained. At the time of polymerization, other resin may be mixed in the monomer, and the resin obtained may be subjected to heat treatment to convert it into an acid anhydride, or the acid anhydride may be esterified by ring-opening alcohol treatment by treating it with weakly alkaline water.

The dicarboxylic acid or dicarboxylic anhydride monomer is strongly alternatingly copolymerizable and hence, in order to obtain a vinyl copolymer in which functional groups such as dicarboxylic acid have been dispersed at random, the following process is one of preferred processes. It is a process in which, using a dicarboxylic acid monoester monomer, a vinyl copolymer is obtained by solution polymerization, and this vinyl copolymer is dissolved in the monomer to effect suspension polymerization to obtain the binder resin. In this process, the whole or dicarboxylic acid monoester moiety can be converted into an anhydride by alcohol-removing ring closure to obtain an acid anhydride, controlling treatment conditions at the time of solvent evaporation after the solution polymerization. At the time of suspension polymerization, the acid anhydride group undergoes hydrolysis ring opening and a dicarboxylic acid is obtained.

In conversion into an acid anhydride in the polymer, infrared absorption of carbonyl shifts to a higher wave number side than that of an acid or ester. Thus, the formation or disappearance of an acid anhydride can be ascertained.

In the binder resin thus obtained, the carboxyl group, the anhydride group and the dicarboxylic acid group are uniformly dispersed in the binder resin matrix, and hence they can provide the toner with a good charging performance.

As the binder resin, a polyester resin shown below is also preferred.

In the polyester resin, from 45 to 55 mol % of the total components are alcohol components, and from 55 to 45 mol % are acid components.

The alcohol component may include polyhydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (B):

(B)

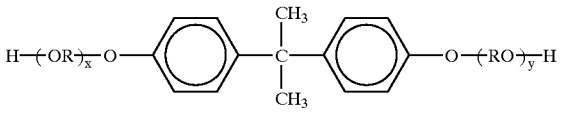

wherein R represents an ethylene group or a propylene group, x and y are each an integer of 1 or more, and an average value of x+y is 2 to 10;

and a diol represented by the following Formula (C):

(C)

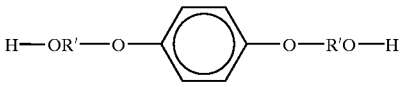

wherein R' represents

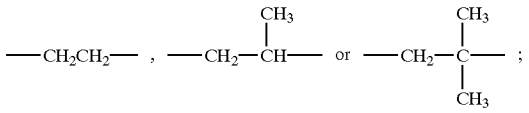

glycerol, sorbitol and sorbitan.

As a dibasic carboxylic acid component that holds 50 mol % or more of the whole acid component, it may include benzene dicarboxylic acids such as phthalic acid, terephthalic acid, isophthalic acid and phthalic anhydride, and anhydrides thereof; alkyldicarboxylic acids such as succinic acid, adipic acid, sebacic acid and azelaic acid, and anhydrides thereof, as well as succinic acid further substituted with an alkyl group or alkenyl group having 6 to 18 carbon atoms, or anhydrides thereof; unsaturated dicarboxylic acids such as fumaric acid, maleic acid, citraconic acid and itaconic acid, and anhydrides thereof. As a tribasic or higher carboxylic acid, it may include trimellitic acid, pyromellitic acid, benzophenonetetracarboxylic acid, and anhydrides thereof.

A particularly preferred alcohol component of the polyester resin is the bisphenol derivative represented by the above Formula (B). As the acid component, particularly preferred are dicarboxylic acids such as phthalic acid, terephthalic acid, isophthalic acid and anhydrides thereof, succinic acid, n-dodecenylsuccinic acid or anhydrides thereof, fumaric acid, maleic acid and maleic anhydride; and tricarboxylic acids such as trimellitic acid or anhydrides thereof.

A toner using as a binder resin the polyester resin obtained from these acid components and these alcohol components has good fixing performance and superior anti-offset properties as a toner for heat-roller fixing.

The polyester resin may preferably have an acid value of 90 mg·KOH/g or lower, and more preferably 50 mg·KOH/g or lower, and may preferably have an OH value (hydroxyl value) of 50 mg·KOH/g or lower, and more preferably 30 mg·KOH/g or lower. This is because a polyester resin having a large number of terminal groups in the molecular chain may make the charging performance of toner have a great environmental dependency.

The polyester resin may preferably have a glass transition temperature of from 50 to 75° C., and more preferably from 55 to 65° C., and also may preferably have a number-average molecular weight (Mn) of from 1,500 to 50,000, and more preferably from 2,000 to 20,000. The polyester resin may preferably have a weight-average molecular weight (Mw) of from 6,000 to 100,000, and more preferably from 10,000 to 90,000.

The sulfur-containing polymer or sulfur-containing copolymer used in the present invention as the sulfur-containing compound is added chiefly as a charge control agent. The sulfur-containing compound may preferably be a polymer or copolymer containing a sulfonic acid group, and has a monomer unit having the sulfonic acid group. Such a monomer may include styrylsulfonic acid, 2-acrylamido-2-methylpropanesulfonic acid, 2-methacrylamido-2-methylpropanesulfonic acid, vinylsulfonic acid, methacrylsulfonic, a maleic acid amide derivative having the following structural formula (1), a maleimide derivative having the following structural formula (2), and a styrene derivative having the following structural formula (3).

(1) Maleic acid amide derivative:

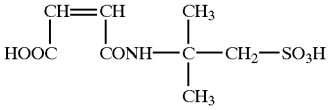

-continued (2) Maleimide derivative:

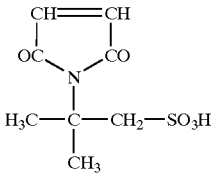

(3) Styrene derivative:

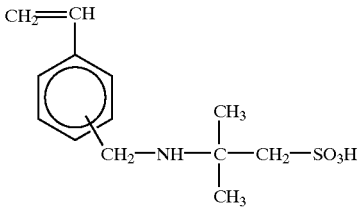

(bonded at the ortho-position or the para-position)

Monomers for forming the above sulfur-containing polymer or copolymer may include vinyl type polymerizable monomers. Usable are monofunctional polymerizable monomers and polyfunctional polymerizable monomers.

The monofunctional polymerizable monomers may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate and 2-benzoyloxyethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomers may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy.diethoxy)phenyl] propane, trimethyrolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy.diethoxy)phenyl]propane, 2,2'-bis[4-(methacryloxy.polyethoxy)phenyl]propane, trimethylolpropane trimethacrylate, tetramethyrolmethane tetramethacrylate, divinyl benzene, divinyl naphthalene, and divinyl ether.

The above polymers may be produced by a process including bulk polymerization, solution polymerization, emulsion polymerization and suspension polymerization. In view of operability and so forth, solution polymerization is preferred.

The counter ion of the polymer having a sulfonic acid group may be a hydrogen ion, a sodium ion, a potassium ion, a calcium ion or an ammonium ion. It may more preferably be a hydrogen ion.

In the present invention, among the above polymers having a sulfonic acid group, a copolymer of a styrene monomer and an acrylic monomer with a sulfonic-acid-containing acrylamide monomer (i.e., sulfonic-acid-group-containing copolymer) may particularly preferably be used.

The styrene monomer and acrylic monomer used in such a sulfonic-acid-group-containing copolymer may appropriately be selected from the vinyl monomers for forming the vinyl copolymer described above. They may preferably include combinations of styrene with acrylate, or styrene with methacrylate.

The sulfonic-acid-containing acrylamide monomer used in the sulfonic-acid-group-containing copolymer may include 2-acrylamidopropanesulfonic acid, 2-acrylamido-n-butanesulfonic acid, 2-acrylamido-n-hexanesulfonic acid, 2-acrylamido-n-octanesulfonic acid, 2-acrylamido-n-dodecanesulfonic acid, 2-acrylamido-n-tetradecanesulfonic acid, 2-acrylamido-2-methylpropanesulfonic acid, 2-acrylamido-2-methylphenylethanesulfonic acid, 2-acrylamido-2-(4-chlorophenyl)propanesulfonic acid, 2-acrylamido-2-carboxymethylpropanesulfonic acid, 2-acrylamido-2-(2-pyridine)propanesulfonic acid, 2-acrylamido-1-methylpropanesulfonic acid, 3-acrylamido-3-methylbutanesulfonic acid, 2-methacrylamido-n-decanesulfonic acid and 2-methacrylamido-n-tetradecanesulfonic acid. It may preferably include 2-acrylamido-2-methylpropanesulfonic acid.

As a polymerization initiator used when the sulfur-containing polymer or sulfur-containing copolymer is prepared, it may appropriately be selected from initiators used when the above vinyl copolymer is synthesized. Peroxide type initiators may preferably be used.

As a process for synthesizing the sulfur-containing polymer or sulfur-containing copolymer, there are no particular limitations. Any processes of solution polymerization, suspension polymerization and bulk polymerization may be used. Preferred is solution polymerization which carries out copolymerization in an organic solvent containing a lower alcohol.

The copolymerization of the styrene monomer and the acrylic monomer with the sulfonic-acid-containing acrylamide monomer may preferably be in a weight ratio of styrene monomer and acrylic monomer:sulfonic-acid-containing acrylamide monomer=98:2 to 80:20. A case in which the sulfonic-acid-containing acrylamide monomer is in a proportion smaller than 2% by weight is undesirable because the toner may have no sufficient charging characteristics. A case in which it is in a proportion larger than 20% by weight is undesirable because the toner may have an unstable environmental stability.

The sulfur-containing polymer or sulfur-containing copolymer may preferably have an acid value of from 3 to 80 mg·KOH/g, more preferably from 5 to 40 mg·KOH/g, and still more preferably from 10 to 30 mg·KOH/g. If it has an acid value smaller than 3 mg·KOH/g, it may have a low charge control action and also the toner may have a low environmental stability. If it has an acid value larger than 80 mg·KOH/g, the toner tends to be affected by water in a high-temperature high-humidity environment to tend to have a low environmental stability.

The sulfur-containing polymer or sulfur-containing copolymer may have a weight-average molecular weight (Mw) of from 2,000 to 200,000, preferably from 17,000 to 100,000, and more preferably from 27,000 to 50,000. A case in which it has a weight-average molecular weight (Mw) smaller than 2,000 is undesirable because the sulfur-containing polymer or sulfur-containing copolymer may mutually melt, or stand finely dispersed, in the binder resin, so that the charging characteristics may be improved with difficulty to cause a lowering of the fluidity or transfer performance of the toner. A case in which it has a weight-average molecular weight (Mw) larger than 200,000 is undesirable because the sulfur-containing polymer or sulfur-containing copolymer may phase-separate from the binder resin and may completely liberate from toner particles to cause fog or a lowering of environmental stability.

The sulfur-containing polymer or sulfur-containing copolymer may preferably have a glass transition point (Tg) of from 30° C. to 120° C., more preferably from 50° C. to 100° C., and still more preferably from 70° C. to 95° C. A case in which the sulfur-containing polymer or sulfur-containing copolymer has a glass transition point (Tg) lower than 30° C. is undesirable because the toner may have low fluidity and storage stability and also may have a poor transfer performance. A case in which it has a glass transition point (Tg) higher than 120° C. is undesirable because the toner may have a low fixing performance in the case of images having a high toner print percentage (image area percentage).

The sulfur-containing polymer or sulfur-containing copolymer may preferably have a volatile matter of from 0.01% to 2.0%, and more preferably from 0.01% to 1.0% or less. Making it have a volatile matter less than 0.01% requires a complicate step of removing the volatile matter. If it has a volatile matter more than 2.0%, the toner may be low charged in a high-temperature high-humidity environment, in particular, may be low triboelectrically charged after leaving. The volatile matter of the sulfur-containing polymer or sulfur-containing copolymer corresponds to the proportion of loss in mass or weight on heating for 1 hour at high temperature (135° C.).

The sulfur-containing polymer or sulfur-containing copolymer may preferably have a "MELT INDEX value" (MI value: g/10 min.) of from 0.1 to 200, and more preferably from 0.2 to 150. If it has an MI value smaller than 0.1, the polymer or copolymer may have a low compatibility with the binder resin to tend to be non-uniformly dispersed in toner particles, so that the toner may have a broad charge quantity distribution. If it has an MI value larger than 200, the polymer or copolymer may melt so sharply (sharp-melt) that the toner may have a low anti-blocking properties to have a low many-sheet running performance. The MI value is measured by a method prescribed in JIS K7210, Method A. Thereafter, the measurements obtained are calculated in the 10-minute value.

There are no particular limitations on the manner of extracting the sulfur-containing polymer or sulfur-containing copolymer from the toner, and any methods may be used.

(A) The "molecular weight and molecular weight distribution" of the sulfur-containing polymer or sulfur-containing copolymer are measured by GPC (gel permeation chromatography) in the following way.

Columns are stabilized in a heat chamber of 40° C. To the columns kept at this temperature, THF (tetrahydrofuran) as a solvent is flowed at a flow rate of 1 ml per minute, and about 100 $\mu$l of a sample THF solution is injected thereinto to make measurement. In measuring the molecular weight of the sample, the molecular weight distribution ascribed to the sample is calculated from the relationship between the logarithmic value and number of count of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from, e.g., Toso Co., Ltd. or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H ($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK Guard Column, available from Toso Co., Ltd.

The sample is prepared in the following way.

The sample is put in tetrahydrofuran (THF), and is left for several hours, followed by thorough shaking so as to be well mixed with the THF (until coalescent matter of the sample has disappeared), which is further left for at least 12 hours. Here, the sample is so left as to stand in THF for at least 24 hours in total. Thereafter, the solution having been passed through a sample-treating filter (pore size: 0.45 to 0.5 $\mu$m; for example, MAISHORIDISK-25-5, available from Toso Co., Ltd. or EKIKURODISK 25CR, available from German Science Japan, Ltd., may be utilized) is used as the sample for GPC. The sample is so adjusted as to have resin components in a concentration of from 0.5 to 5 mg/ml.

(B) The "glass transition point" of the sulfur-containing polymer or sulfur-containing copolymer is determined by measurement by DSC (differential scanning calorimetry).

In the DSC measurement, in view of the principle of measurement, the measurement may preferably be made with a highly precise differential scanning calorimeter. For example, DSC-7, manufactured by Perkin Elmer Co., may be used.

The measurement is carried out according to ASTM D3418-82. To make the measurement, temperature is once raised and then dropped to take a previous history and thereafter the temperature is raised at a temperature rate of 10° C./min, and the DSC curve thus obtained is used.

(C) The "acid value" of the sulfur-containing polymer or sulfur-containing copolymer is determined in the following way. Basic operation is made according to JIS K0070.

The number of milligrams of potassium hydroxide required for the neutralization of free fatty acids or resin acids present in 1 g of a sample is called the acid value (or acid number). A test is made in the following way.

(1) Reagent (a) Solvent: An ethyl ether/ethyl alcohol mixed solution (1+1 or 2+1) or a benzene/ethyl alcohol mixed solution (1+1 or 2+1) is used. These solutions are each kept neutralized with an N/10 potassium hydroxide ethyl alcohol solution using phenolphthalein as an indicator immediately before use.

(b) Phenolphthalein solution: 1 g of phenolphthalein is dissolved in 100 ml of ethyl alcohol (95 v/v%).

(c) N/10 potassium hydroxide ethyl alcohol solution: 7.0 g of potassium hydroxide is dissolved in water used in a quantity as small as possible, and ethyl alcohol (95 v/v%) is added thereto to make up a 1 liter solution, which is then left for 2 or 3 days, followed by filtration. Standardization is made according to JIS K-8006 (basic items relating to titration during a reagent content test).

(2) Operation

From 1 to 20 g of the sample is precisely weighed, and 100 ml of the solvent and few drops of the phenolphthalein solution as an indicator are added thereto, which are then thoroughly shaked until the sample dissolves completely. In the case of a solid sample, it is dissolved by heating on a water bath. After cooling, the resultant solution is titrated with the N/10 potassium hydroxide ethyl alcohol solution, and the time by which the indicator has stood sparingly red for 30 seconds is regarded as the end point of neutralization.

(3) Calculation:

The acid value is calculated from the following equation.

$$A=(B\times f\times 5.611)/S$$

where;

A is the acid value;

B is the amount (ml) of the N/10 potassium hydroxide ethyl alcohol solution used;

f is the factor of the N/10 potassium hydroxide ethyl alcohol solution; and

S is the sample (g).

(D) The "hydroxyl value" of the sulfur-containing polymer or sulfur-containing copolymer is determined in the following way. Basic operation is made according to JIS K0070.

The number of milligrams of potassium hydroxide required for the neutralization of acetic acid bonded to hydroxyl groups when 1 g of a sample is acetylated by a prescribed method is called the hydroxyl value (or hydroxyl number). A test is made using the following reagent and calculation expression.

(1) Reagent (a) Acetylating reagent: 25 g of acetic anhydride is put into 100 ml of a measuring flask, and pyridine is added to make up a 100 ml solution in total weight, followed by thorough shaking (pyridine may optionally further be added). The acetylating reagent is so stored in a brown bottle that it does not come into contact with any moisture or any vapor of carbon dioxide or acid.

(b) Phenolphthalein solution: 1 g of phenolphthalein is dissolved in 100 ml of ethyl alcohol (95 v/v%).

(c) N/2 potassium hydroxide ethyl alcohol solution: 35 g of potassium hydroxide is dissolved in water used in a quantity as small as possible, and ethyl alcohol (95 v/v%) is added thereto to make up a 1 liter solution, which is then left for 2 or 3 days, followed by filtration. Standardization is made according to JIS K-8006.

(2) Operation

From 0.5 to 2.0 g of the sample is precisely weighed in a round flask, and just 5 ml of the acetylating reagent is added. A small funnel is hooked on the mouth of the flask, and its bottom is immersed by about 1 cm in a 95 to 100° C. glycerol bath and heated. Here, in order to prevent the neck of the flask from being heated by the heat of the bath, the base of the neck of the flask is covered with a cardboard disk with a round hole made in the middle. One hour later, the flask is taken out of the bath. After it was left to cool, 1 ml of water is added through the funnel, followed by shaking to decompose acetic anhydride. In order to effect the decomposition further completely, the flask is again heated in the glycerol bath for 10 minutes. After it was left to cool, the walls of the funnel and flask are washed with 5 ml of ethyl alcohol, followed by titration with the N/2 potassium hydroxide ethyl alcohol solution using the phenolphthalein solution as a reagent. Here, an empty test is made in parallel to the main test. If necessary, a KOH-THF solution may be used as an indicator.

(3) Calculation:

The hydroxyl value is calculated from the following equation.

$$A=[(B-C)\times f\times 28.05]/S+D$$

where;

A is the hydroxyl value;

B is the amount (ml) of the N/2 potassium hydroxide ethyl alcohol solution used in the empty test;

C is the amount (ml) of the N/2 potassium hydroxide ethyl alcohol solution used in the main test;

f is the factor of the N/2 potassium hydroxide ethyl alcohol solution;

S is the sample (g); and

D is the acid value.

The sulfur-containing polymer or sulfur-containing copolymer may be used as it is. In view of an improvement in compatibility with and dispersion in other materials, it is preferable for the polymer or copolymer to be pulverized by a known pulverization means to have a uniform particle diameter. Particles thus formed by pulverization may preferably have an average particle diameter of 300 $\mu$m or smaller, and more preferably 150 $\mu$m or smaller. This enables good dispersion in other materials and especially prevention of fog in respect of image quality.

The sulfur-containing polymer or sulfur-containing copolymer may be contained in an amount of from 0.01 to 15 parts by weight, preferably from 0.1 to 10 parts by weight, and more preferably from 0.5 to 8 parts by weight.

If the sulfur-containing polymer or sulfur-containing copolymer is in a content less than 0.01 part by weight, sufficient charge control action may be attained with difficulty. If it is in a content more than 15 parts by weight, it may have a low compatibility with other materials or may provide excess charge in a low-humidity environment, undesirably.

The content of the sulfur-containing polymer or sulfur-containing copolymer in the toner can be measured by capillary electrophoresis or the like.

The toner of the present invention, in order to make its charging performance more stable, may optionally be used in combination with another charge control agent. Such an additional charge control agent may preferably be used in an amount of from 0.1 to 10 parts by weight, and more preferably from 0.1 to 5 parts by weight based on 100 parts by weight of the binder resin.

The additional charge control agent may include the following.

As charge control agents capable of controlling the toner to be negatively chargeable, organic metal complexes or chelate compounds are available, which include monoazo metal complexes, metal complexes of aromatic hydroxycarboxylic acids and metal complexes of aromatic dicarboxylic acids. Besides, they include aromatic hydroxycarboxylic acid, aromatic mono- or polycarboxylic acids and metal salts thereof, anhydrides thereof or esters thereof, and phenol derivatives such as bisphenol.

Charge control agents capable of controlling the toner to be positively chargeable include Nigrosine and modified products of Nigrosine, modified with a fatty acid metal salt; quaternary ammonium salts such as tributylbenzylammonium 1-hydroxy-4-naphthosulfonate and tetrabutylammonium tetrafluoroborate; onium salts such as phosphonium salts of these, and, as chelate pigments of these, triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate.

Where the toner of the present invention is used as a magnetic toner, a magnetic material is used as a colorant. The magnetic material incorporated in the magnetic toner may include iron oxides such as magnetite, hematite and ferrite, and iron oxides including other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

The magnetic material may specifically include triiron tetraoxide ($Fe_3O_4$), iron sesquioxide ($\gamma$-$Fe_2O_3$), zinc iron oxide ($ZnFe_2O_4$), yttrium iron oxide ($Y_3Fe5O_{12}$), cadmium iron oxide ($CdFe_2O_4$), gadolinium iron oxide ($Gd_3Fe5O_{12}$), copper iron oxide ($CuFe_2O_4$), lead iron oxide ($PbFe12O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of the above magnetic materials may be alone or in combination of two or more kinds. A particularly preferred magnetic material is fine powder of triiron tetraoxide or $\gamma$-iron sesquioxide.

These magnetic materials may preferably be those having an average particle diameter of from 0.05 to 2 $\mu$m, and a coercive force of from 1.6 to 12.0 kA/m, a saturation magnetization of from 50 to 200 $Am^2/kg$ (preferably from 50 to 100 $Am^2/kg$) and residual magnetization of from 2 to 20 $Am^2/kg$, as magnetic properties under application of a magnetic field of 795.8 kA/m.

The magnetic material may be used in an amount of from 10 to 200 parts by weight, and preferably from 20 to 150 parts by weight, based on 100 parts by weight of the binder resin.

As non-magnetic colorants usable in the toner of the present invention, they may be any suitable pigments or dyes. As the pigments, usable are carbon black, aniline black, acetylene black, Naphthol Yellow, Hanza Yellow, Rhodamine Lake, Alizarine Lake, red iron oxide, Phthalocyanine Blue and Indanethrene Blue. Any of these may be added in an amount of from 0.1 part by weight to 20 parts by weight, and preferably from 1 to 10 parts by weight, based on 100 parts by weight of the binder resin. As the dyes, usable are anthraquinone dyes, xanthene dyes and methine dyes, any of which may be added in an amount of from 0.1 part by weight to 20 parts by weight, and preferably from 0.3 to 10 parts by weight, based on 100 parts by weight of the binder resin.

In the present invention, at least one kind of release agent may optionally be incorporated in the toner particles. The release agent may include the following.

Aliphatic hydrocarbon waxes such as low-molecular weight polyethylene, low-molecular weight polypropylene, microcrystalline wax and paraffin wax, oxides of aliphatic hydrocarbon waxes such as polyethylene wax oxide, and block copolymers of these; waxes composed chiefly of a fatty ester, such as carnauba wax, sazol wax and montanic acid ester wax; and those obtained by subjecting part or the whole of a fatty ester to deoxydation treatment, such as deoxidized carnauba wax. It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; long-chain alkyl alcohols; polyhydric alcohols such as sorbitol; fatty amides such as linolic acid amide, oleic acid amide and lauric acid amide; saturated fatty bisamides such as methylenebis(stearic acid amide), ethylenebis(capric acid amide), ethylenebis(lauric acid amide) and hexamethylenebis(stearic acid amide); unsaturated fatty amides such as ethylenebis(oleic acid amide), hexamethylenebis(oleic acid amide), N,N'-dioleyladipic acid amide and N,N'-dioleylsebacic acid amide; aromatic bisamides such as m-xylenebis(stearic acid amide) and N,N'-distearylisophthalic acid amide; fatty metal salts (what is commonly called metal soap) such as calcium stearate, calcium laurate, zinc stearate and magnesium stearate; grafted waxes obtained by graft-polymerizing vinyl monomers such as styrene or acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

The release agent may preferably be used in an amount of from 0.1 to 20 parts by weight, and more preferably from 0.5 to 10 parts by weight, based on 100 parts by weight of the binder resin.

The release agent is incorporated into the binder resin usually by a method in which a resin is dissolved in a solvent and, raising the temperature of the resin solution, the release agent is added and mixed therein with stirring, or a method in which they are mixed at the time of kneading so as to be incorporated into the binder resin.

A fluidity improver may be added to the toner of the present invention. The fluidity improver is an agent which can improve the fluidity of the toner by its external addition to toner particles, as seen in comparison before and after its addition. For example, it may include fluorine resin powders such as fine vinylidene fluoride powder and fine polytetrafluoroethylene powder; fine silica powders such as wet-process silica and dry-process silica, and hydrophobic fine silica powder obtained by subjecting these fine silica powders to surface treatment with a silane coupling agent, a titanium coupling agent or a silicone oil.

A preferred fluidity improver is dry-process fine silica powder or fine fumed silica powder, produced by vapor phase oxidation of a silicon halide. For example, it is a process that utilizes heat decomposition oxidation reaction in oxyhydrogen frame of silicon tetrachloride gas. The reaction basically proceeds as follows.

$$SiCl_4+2H_2+O_2 \rightarrow SiO_2+4HCl$$

In this production step, it is also possible to us e other metal halide such as aluminum chloride or titanium chloride together with the silicon halide to obtain a composite fine powder of silica with other metal oxide. As to its particle diameter, it is preferable to use fine silica powder having an average primary particle diameter within the range of from 0.001 to 2 $\mu$m, and particularly preferably within the range of from 0.002 to 0.2 $\mu$m.

Commercially available fine silica powders produced by the vapor phase oxidation of silicon halides, include, e.g., those which are on the market under the following trade names.

Aerosil 130, 200, 300, 380, TT600, MOX170, MOX80, COK84 (Aerosil Japan, Ltd.);

Ca-O-SiL M-5, MS-7, MS-75, HS-5, EH-5 (CABOT CO.);

Wacker HDK N20, V15, N20E, T30, T40 (WACKER-CHEMIE GMBH);

D-C Fine Silica (Dow-Corning Corp.); and

Fransol (Franzil Co.).

It is also preferable to use hydrophobic fine silica powder obtained by making hydrophobic the fine silica powder produced by vapor phase oxidation of a silicon halide . In the hydrophobic fine silica powder, a fine silica powder is particularly preferred which has been so treated that its hydrophobicity as measured by a methanol titration test shows a value within the range of from 30 to 80.

As methods for making hydrophobic, the fine silica powder may be made hydrophobic by chemical treatment with an organosilicon compound capable of reacting with or physically adsorbing the fine silica powder. As a preferable method, the fine silica powder produced by vapor phase oxidation of a silicon halide may be treated with an organosilicon compound.

The organosilicon compound may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals. It may further include silicone oils such as dimethylsilicone oil. Any of these may be used alone or in the form of a mixture of two or more types.

As the fluidity improver, those having a specific surface area of 30 $m^2/g$ or larger, preferably 50 $m^2/g$ or larger, and more preferably from 80 to 400 $m^2/g$, as measured by the BET method utilizing nitrogen absorption provides good results. The fluidity improver may preferably be used in an amount of from 0.01 to 8 parts by weight, and preferably from 0.1 to 4 parts by weight, based on 100 parts by weight of the toner.

In the present invention, other inorganic fine powder may externally be added to the toner particles. Such an inorganic fine powder usable in the present invention may include a compound represented by the following formula:

$$[M_1]_a[Ti]_bO_c$$

wherein M1 represents a metallic element selected from the group consisting of Sr, Mg, Zn, Co, Mn, Ca, Ba and Ce; a represents an integer of 1 to 9; b represents an integer of 1 to 9; and c represents an integer of 3 to 9.

Strontium titanate ($SrTiO_3$) and calcium titanate ($CaTiO_3$) are particularly preferred because the effect of the present invention can more be brought out.

The inorganic fine powder used in the present invention may preferably be, e.g., a powder obtained by forming a material by sintering, and mechanically pulverizing the material, followed by air classification to have the desired particle size distribution.

The inorganic fine powder may be added in an amount of from 0.1 to 10 parts by weight, and preferably from 0.2 to 8 parts by weight, based on 100 parts by weight of the toner particles. A case in which it is added in an amount smaller than 0.1 part by weight is undesirable because no sufficient cleaning performance or polishing performance may be exhibited against any residual toner, paper duct and ozone deposits remaining on the photosensitive member. A case in which it is added in an amount larger than 10 parts by weight is undesirable because fog tends to occur or the photosensitive member surface may excessively be abraded.

The inorganic fine powder used in the present invention may have a weight-average particle diameter of from 0.2 to 4 $\mu$m, and preferably from 0.5 to 3 $\mu$m. A case in which it has a weight-average particle diameter smaller than 0.2 $\mu$m is undesirable because no sufficient polishing effect may be obtained. A case in which it has a weight-average particle diameter larger than 4 $\mu$m can not be said to be preferable because fog tends occur or the photosensitive member may be damaged.

A preferred process for producing the toner of the present invention is specifically described with reference to the accompanying drawings.

Figure 2:
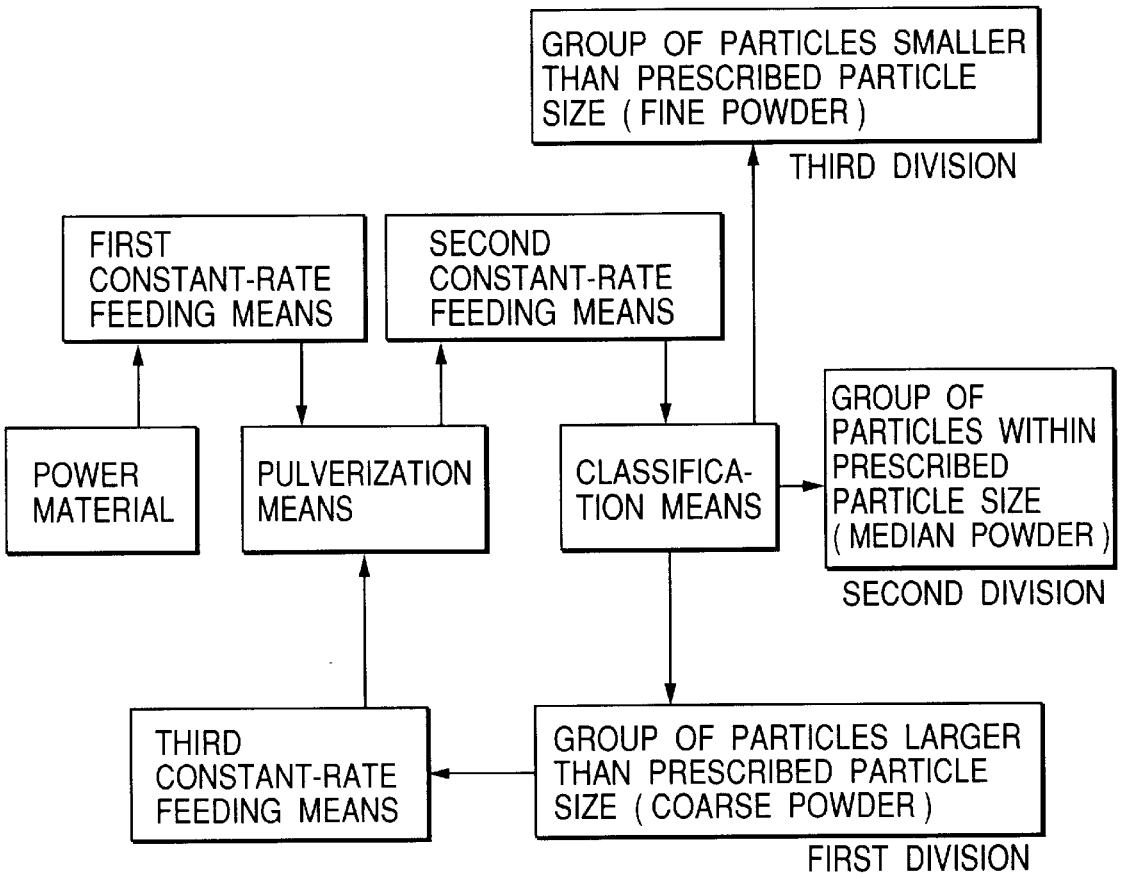
FIG. 2 is a flow chart for describing another preferred process for producing the toner of the present invention.

FIGS. 1 and 2 are examples of a flow chart showing an outline of the toner production process. As shown in the flow charts, the toner production process is characterized in that it does not require any classification step before pulverization treatment and the pulverization step and the classification step are carried out in one pass.

In the toner production, a mixture containing at least the binder resin, the colorant and the sulfur-containing compound is melt kneaded to obtain a kneaded product. After the kneaded product is cooled, the cooled product is crushed by a crushing means to obtain a crushed product, which is used as a powder material. Then, the powder material is first introduced in a stated quantity into a mechanical grinding machine having at least a rotor which is a rotator attached to the center rotating shaft and a stator which is provided around the rotor, keeping a certain space between it and the rotor surface; the grinding machine being so constructed that a circular space formed by keeping that space stands airtight. The rotor of the mechanical grinding machine is rotated at a high speed to finely pulverize the powder material (product to be pulverized). Next, the finely pulverized powder material is introduced to a classification step and is classified there to obtain a classified product serving as a toner base material, comprised of a group of particles having the prescribed particle size. Here, in the classification step, a multi-division gas current classifier having at least a coarse-powder region, a median-powder region and a fine-powder region may preferably be used as a classifying means. For example, when a triple-division gas current classifier is used, the powder material is classified at least into three fractions of fine powder, median powder and coarse powder. In the classification step making use of such a classifier, the coarse powder consisting of a group of particles having particle diameters larger than the desired particle size and fine powder consisting of a group of particles having particle diameters smaller than the desired particle size are removed, and the median powder (toner particles) is blended with the inorganic fine powder described above and an external additive such as hydrophobic colloidal silica and thereafter used as a toner.

Ultrafine powder consisting of a group of particles having particle diameters smaller than the desired particle size is usually reused by feeding it to the step of melt kneading for producing the powder material comprised of toner materials which is to be introduced to the step of pulverization, or discarded.

Figure 3:
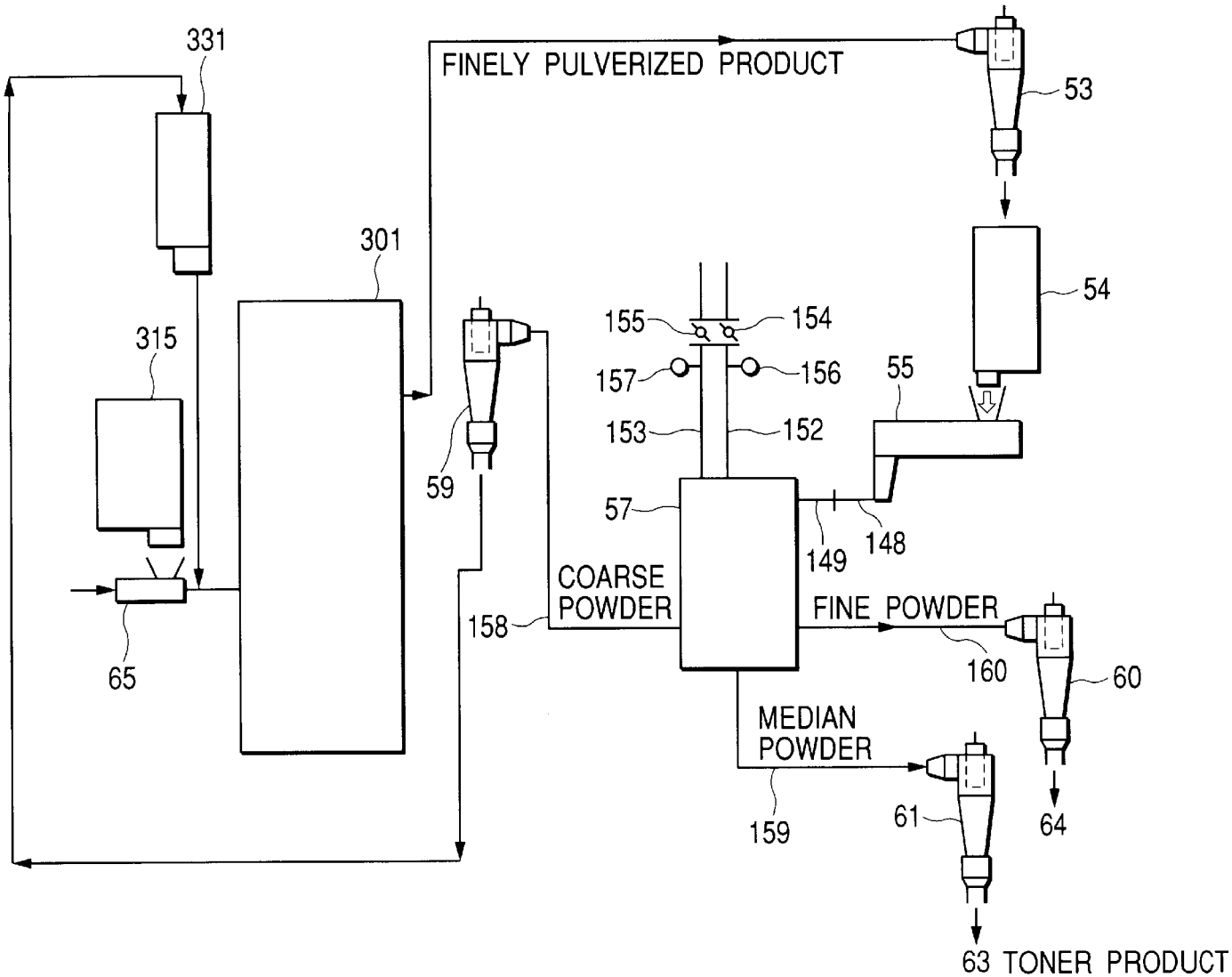
FIG. 3 is a schematic view of an example of a unit system for carrying out a preferred process for producing the toner of the present invention.
Figure 4:
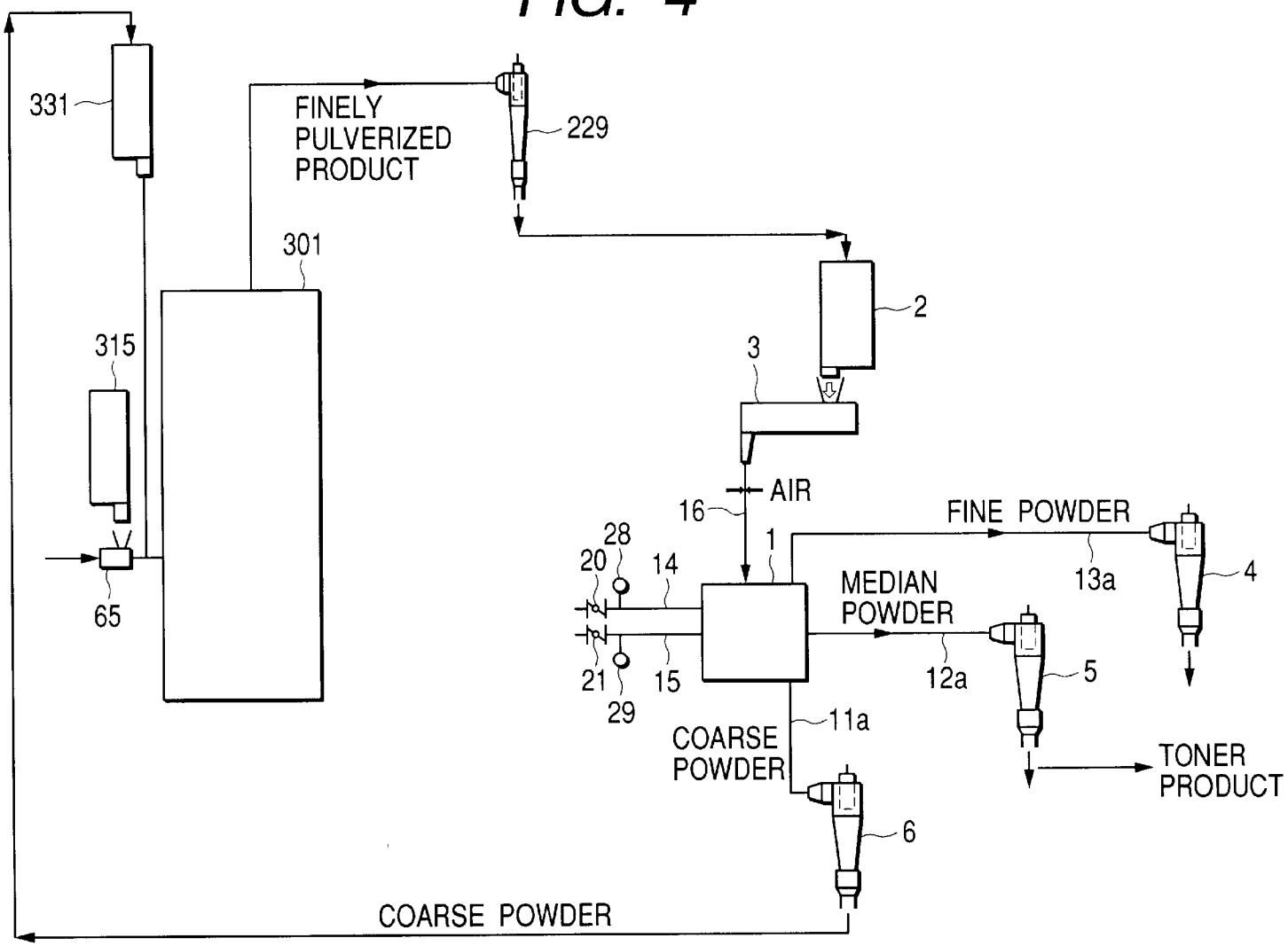
FIG. 4 is a schematic view of another example of a unit system for carrying out a preferred process for producing the toner of the present invention.

FIGS. 3 and 4 show examples of a unit system to which the above toner production process has been applied. The process is further specifically described below with reference to this drawing. As the toner base material powder material introduced into this unit system, a colored resin particle powder containing at least the binder resin, the colorant and the sulfur-containing compound is used. As the powder material, a material is used which is obtained by, e.g., melt-kneading the mixture comprised of the binder resin, the colorant and the sulfur-containing compound, cooling the kneaded product obtained and further crushing the cooled product by a crushing means.

In this unit system, the toner base material powder material is introduced in a stated quantity into a mechanical grinding machine 301 which is the pulverization means, via a first constant-rate feeder 315. The powder material introduced into it is instantaneously pulverized by means of the mechanical grinding machine 301, and then introduced into a second constant-rate feeder 2 (54 in FIG. 3) via a collecting cyclone 229 (53 in FIG. 3). Then, via vibrating feeder 3 (55 in FIG. 3) and further via a material feed nozzle 16 (148 in FIG. 3), it is fed into a multi-division gas current classifier 1 (57 in FIG. 3) which is the classification means.

In this unit system, the relationship between the stated quantity of the powder material introduced from the first constant-rate feeder 315 into the mechanical grinding machine 301 which is the pulverization means and the stated quantity of the powder material introduced from the second constant-rate feeder 2 (54 in FIG. 3) into the multi-division gas current classifier 1 (57 in FIG. 3) which is the classification means may preferably be set to be from 0.7 to 1.7, more preferably from 0.7 to 1.5, and still more preferably from 1.0 to 1.2, assuming as 1 the former stated quantity of the powder material introduced from the first constant-rate feeder 315 into the mechanical grinding machine 301. This is preferable in view of the productivity and production efficiency of the toner.

The gas current classifier is usually used as a component unit of a unit system in which correlated equipments are connected through communicating means such as pipes. In the unit system shown in FIG. 3, a multi-(triple-)division classifier 57 (the classifier shown in FIG. 8), a second constant-rate feeder 54, a vibrating feeder 55, a collecting cyclone 59, a collecting cyclone 60 and a collecting cyclone 61 are connected through communicating means. Also, in the unit system shown in FIG. 4, a multi-(triple-)division classifier 1 (the classifier shown in FIG. 9), a constant-rate feeder 2, a vibrating feeder 3, a collecting cyclone 4, a collecting cyclone 5 and a collecting cyclone 6 are connected through communicating means.

In this unit system, in the case of that of FIG. 4, the material powder is fed into the constant-rate feeder 2 through a suitable means, and then introduced into the triple-division classifier 1 from the vibrating feeder 3 through the material feed nozzle 16. When introduced, the material powder may preferably be fed into the triple-division classifier 1 at a flow velocity of 10 to 350 m/second. The classifying chamber of the triple-division classifier 1 is constructed usually with a size of [10 to 50 cm]×[10 to 50 cm], so that the material powder can instantaneously be classified in 0.1 to 0.01 second or less, into three or more groups of particles. Then, the material powder is classified by the triple-division classifier 1 into the group of larger particles (coarse particles), group of median particles and group of smaller particles. Thereafter, the group of larger particles is passed through a discharge guide pipe 11*a*, sent to and collected in the collecting cyclone 6, and returned to the mechanical grinding machine 301. The group of median particles is discharged outside the classifier through the discharge pipe 12*a,* and collected in the collecting cyclone 5 so as to be used as the toner. The group of smaller particles is discharged outside the classifier through the discharge pipe 13*a* and collected in the collecting cyclone 4, where it is reused by feeding it to the step of melt kneading for producing the powder material comprised of toner materials, or discarded. The collecting cyclones 4, 5 and 6 may also function as suction evacuation means for suction feeding the material powder to the classifying chamber through the material feed nozzle 16. Also, the group of larger particles classified here may preferably be again introduced into the first constant-rate feeder 315 so as to be mixed in the powder material and again pulverized by the mechanical grinding machine 301.

As shown in FIG. 3, the larger particles (coarse particles) to be again introduced into the first constant-rate feeder 315 from the multi-division gas current classifier 57 may preferably be again introduced in an amount of from 0 to 10.0% by weight, and more preferably from 0 to 5.0% by weight, based on the weight of the finely pulverized product fed from the second constant-rate feeder 54. This is preferable in view of the productivity of toner. If the larger particles (coarse particles) to be again introduced into the first constant-rate feeder 315 from the multi-division gas current classifier 57 are again introduced in an amount larger than 10.0% by weight, the dust may be in so a large concentration in the mechanical grinding machine 301 that the unit itself may receive a large load and at the same time the toner particles may excessively be pulverized at the time of pulverization to tend to undergo surface deterioration due to heat or cause in-machine melt adhesion. This is undesirable in view of the productivity of toner.

As shown in FIG. 4, the larger particles (coarse particles) classified in the multi-division gas current classifier 1 may more preferably be introduced into a third constant-rate feeder 331 and then introduced from the third constant-rate feeder 331 into the mechanical grinding machine 301. This is more preferable in view of the productivity of toner. Here, the larger particles (coarse particles) classified in the multi-division gas current classifier 1 may preferably be back introduced into the third constant-rate feeder 331 in an amount of from 0 to 10.0% by weight, and more preferably from 0 to 5.0% by weight, based on the weight of the finely pulverized product fed from the second constant-rate feeder 2. This is preferable in view of the productivity of toner. If the larger particles (coarse particles) to be back introduced into the third constant-rate feeder 331 from the multi-division gas current classifier 1 are back introduced in an amount larger than 10.0% by weight, the dust must be in so a large concentration in the mechanical grinding machine 301 that the unit itself may receive a large load and at the same time the toner particles may excessively be pulverized at the time of pulverization to tend to undergo surface deterioration due to heat or cause in-machine melt adhesion. This is undesirable in view of the productivity of toner.

In this system, the powder material may preferably have such particle size that 18 mesh-pass (ASTM E-11-61) particles are in a proportion of from 95 to 100% by weight and 100 mesh-on (ASTM E-11-61) particles are in a proportion of from 90 to 100% by weight.

In this unit system, in order to obtain the toner having the weight-average particle diameter of from 5.0 to 12.0 $\mu$m, and preferably from 5.0 to 10 $\mu$m, having a sharp particle size distribution, the finely pulverized product obtained by means of the mechanical grinding machine 301 may preferably have a weight-average particle diameter of from 5.0 to 12.0 $\mu$m and contain 70% by number or less, more preferably 65% by number or less, of 4.00 $\mu$m or smaller particles, and 25% by volume or less, more preferably 15% by volume or less, of 10.1 $\mu$m or larger particles. Also, the median powder obtained by classification may preferably have a weight-average particle diameter of from 5 to 12 $\mu$m and contain 40% by number or less, more preferably 35% by number or less, of 4.00 $\mu$m or smaller particles, and 25% by volume or less, more preferably 15% by volume or less, of 10.1 $\mu$m or larger particles.

In the above unit system which has applied the production process for the toner of the present invention, the system does not require any first classification step before pulverization treatment, and the pulverization step and the classification step can be carried out in one pass.

A mechanical grinding machine preferably used as the pulverization means used in the production process for the toner of the present invention is described. The mechanical grinding machine may include, e.g., a grinding machine Inomizer, manufactured by Hosokawa Micron K. K.; a grinding machine KTM, manufactured by Kawasaki Heavy Industries, Ltd.; and Turbo mill, manufactured by Turbo Kogyo K. K. These machines may be used as they are, or may preferably be used after they are appropriately remodeled.

Figure 5:
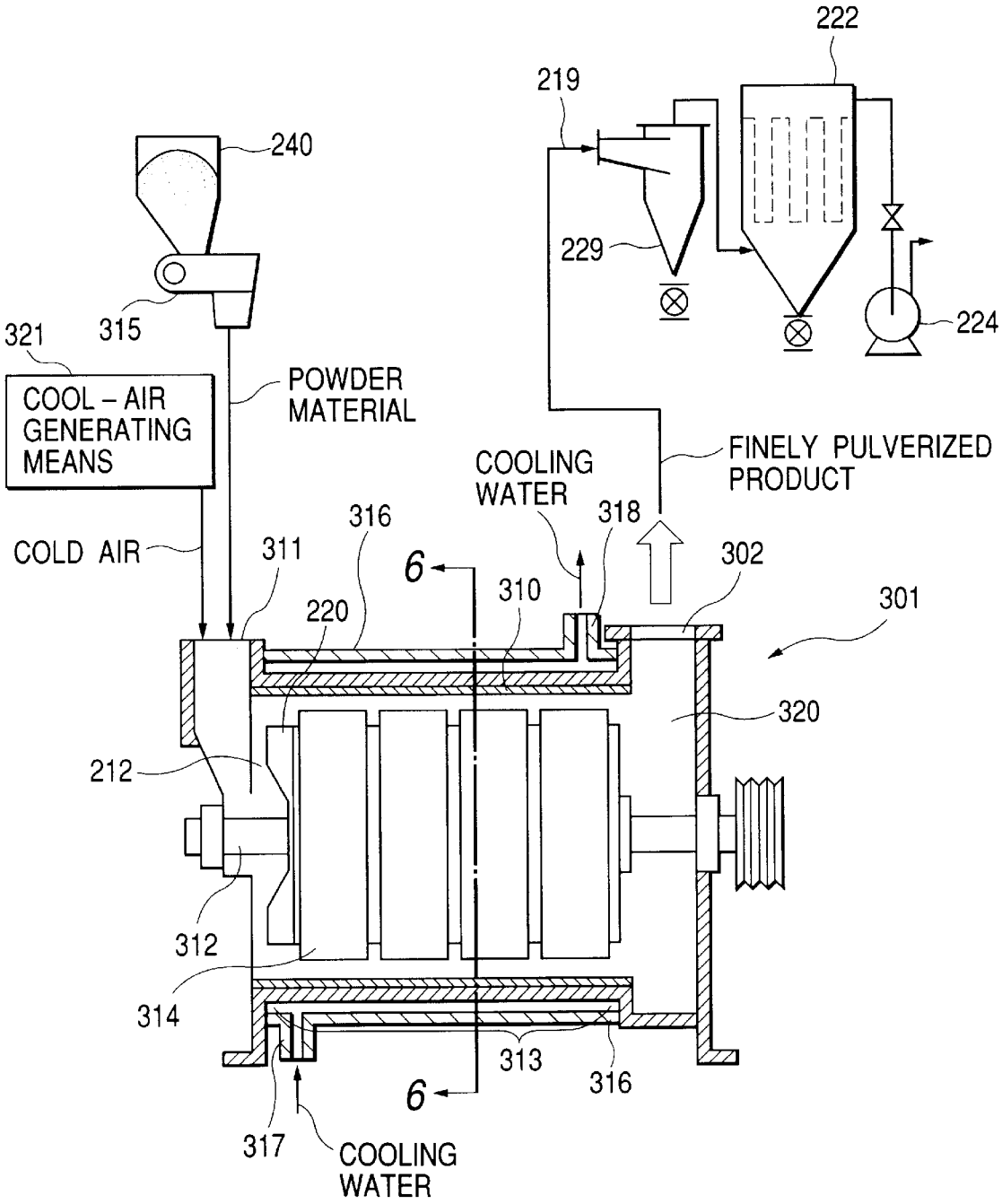
FIG. 5 is a schematic cross-sectional view of an example of a mechanical grinding machine used in a pulverization step of for producing toner particles.
Figure 6:
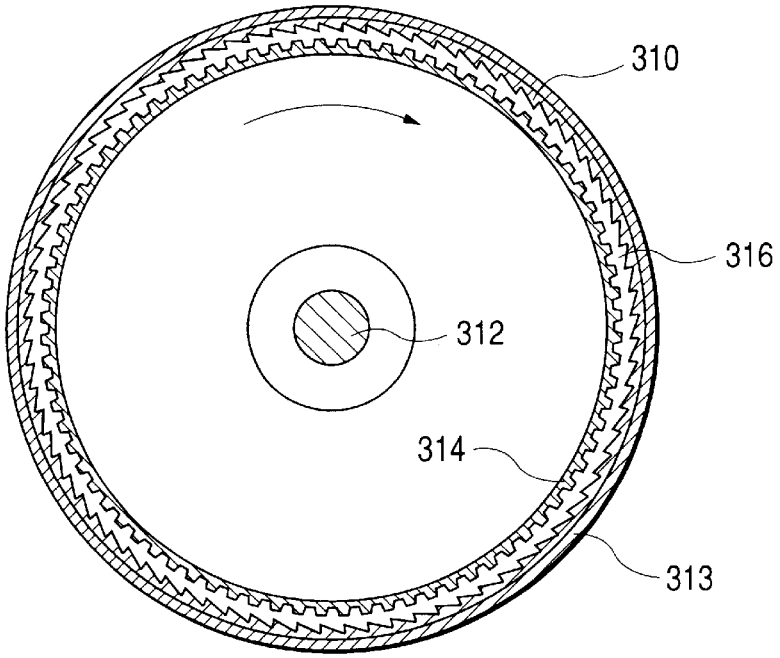
FIG. 6 is a schematic cross-sectional view along the line 6—6 in FIG. 5.
Figure 7:
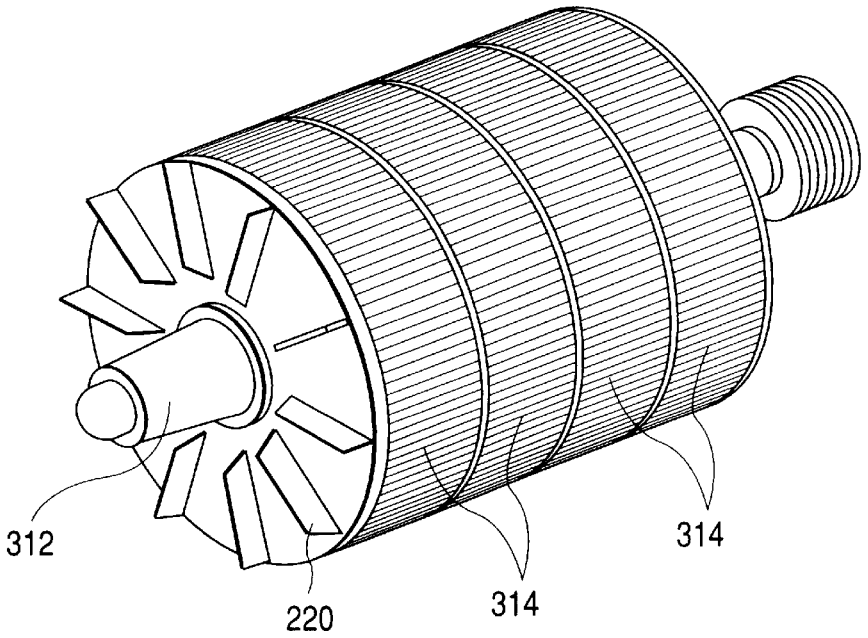
FIG. 7 is a perspective view of a rotor shown in FIG. 5.

In particular, a mechanical grinding machine as shown in FIGS. 5 to 7 may be used. This enables easy pulverization treatment of the powder material and hence the improvement in efficiency can be achieved, advantageously.

The mechanical grinding machine shown in FIGS. 5 to 7 is described below. FIG. 5 is a schematic cross-sectional view of an example of the mechanical grinding machine. FIG. 6 is a schematic cross-sectional view along the line 6—6 in FIG. 5. FIG. 7 is a perspective view of a rotor 314 shown in FIG. 5. This apparatus is constituted of, as shown in FIG. 5, a casing 313, a jacket 316, a distributor 220, a rotor 314 which is provided in the casing 3, constituted of a rotator attached to a center rotating shaft 312, rotatable at a high speed and provided with a large number of grooves on its surface, a stator 310 which is disposed keeping a certain space along the periphery of the rotor 314 and provided with a large number of grooves on its surface, a material feed opening 311 for introducing therethrough the material to be treated, and also a material discharge opening 302 for discharging therethrough the powder having been treated.

The pulverization using the mechanical grinding machine constituted as described above is operated, e.g. in the following way.

The powder material is put in a stated quantity into the mechanical grinding machine from its material feed opening 311, where the powder material is introduced into a pulverizing chamber front chamber 212, and is instantaneously pulverized by the action of i) the impact produced between the rotor 314 rotating at a high speed in the pulverizing chamber and provided with a large number of grooves on its surface and the stator 310 provided with a large number of grooves on its surface, ii) a large number of ultrahigh-speed whirls produced on the back of this impact and iii) the pressure vibration with high frequency that is caused by such whirls. Thereafter, the powder material is discharged passing through the material discharge opening 302. The air which is transporting the material particles is discharged outside the unit system via a pulverizing chamber rear chamber 320 and through the material discharge opening 302, a pipe 219, a collecting cyclone 229 a bag filter 222 and a suction blower 224. In the present invention, the powder material is pulverized in this way and hence the desired pulverization can be performed with ease without increasing the fine powder and coarse powder.

When the powder material is pulverized by means of the mechanical grinding machine, cold air may preferably be sent into the mechanical grinding machine by a cold-air generating means 321 together with the powder material. The cold air may also preferably have a temperature of from 0 to −18° C. Also, as an in-machine cooling means of the main body of the mechanical grinding machine, the mechanical grinding machine may be so constructed as to have the jacket 316 structure and cooling water (or preferably an anti-freeze such as ethylene glycol) may be passed therethrough. Still also, using the above cooling unit and jacket structure, the chamber temperature T1 of the pulverizing chamber front chamber (whirl chamber) 212 communicating the powder material feed inlet in the mechanical grinding machine may preferably be controlled to 0° C. or below, preferably from −5 to −15° C., and more preferably from −7 to −12° C. This is preferable in view of the productivity of toner. Controlling the chamber temperature T1 of the whirl chamber 212 in the mechanical grinding machine to 0° C. or below, preferably from −5 to −15° C., and more preferably from −7 to −12° C., can keep toner particles from undergoing surface deterioration due to heat, and enables pulverization of the powder material in a good efficiency. A case in which the chamber temperature T1 of the whirl chamber in the mechanical grinding machine is higher than 0° C. is undesirable in view of the productivity of toner because the toner particles tend to undergo surface deterioration due to heat at the time of pulverization or cause in-machine melt adhesion. Also, in an attempt to operate at such a temperature that the chamber temperature T1 of the whirl chamber in the mechanical grinding machine is lower than −15° C., the refrigerant (an alternative chlorofluorocarbon) used in the cold-air generating means 321 will have to be changed to a chlorofluorocarbon.

At present, the abolition of chlorofluorocarbons is on progress from the viewpoint of protecting the ozone shield. The use of a chlorofluorocarbon in the cold-air generating means 321 is undesirable in view of the environmental problems of the whole earth.

The alternative chlorofluorocarbons may include R134A, R404A, R407C, R410A, R507A and R717A. Of these, R404A is particularly preferred in view of the advantages of energy saving and safety.

The cooling water (or preferably an anti-freeze such as ethylene glycol) is fed into the jacket from a cold water feed opening 317 and is discharged through a cold water discharge opening 318.

The finely pulverized product formed in the mechanical grinding machine is discharged through the powder material discharge opening 302 via the rear chamber 320 of the mechanical grinding machine. Here, the chamber temperature T2 at the rear chamber 320 of the mechanical grinding machine may be controlled to 30 to 60° C. This is preferable in view of the productivity of toner. Controlling the chamber temperature T2 at the rear chamber 320 of the mechanical grinding machine to 30 to 60° C. can keep toner particles from undergoing surface deterioration due to heat, and enables pulverization of the powder material in a good efficiency. A case in which the chamber temperature T2 at the rear chamber 320 of the mechanical grinding machine is lower than 30° C. is undesirable in view of the performance of toner because there is a possibility that the material is not pulverized to have caused short pass. A case in which the T2 is higher than 60° C. is also undesirable in view of the productivity of toner because there is a possibility that the material has been over-pulverized at the time of pulverization to tend to cause the surface deterioration due to heat or the in-machine melt adhesion.

When the powder material is pulverized by means of the mechanical grinding machine, the chamber temperature T1 at the whirl chamber 212 and the chamber temperature T2 at the rear chamber 320 may preferably be so controlled as to be in a temperature difference ΔT (T2−T1) of from 40 to 70° C., more preferably from 42 to 67° C., and still more preferably from 45 to 65° C. This is preferable in view of the productivity of toner. Controlling the ΔT between the temperature T1 and the temperature T2 of the mechanical grinding machine to from 40 to 70° C., more preferably from 42 to 67° C., and still more preferably from 45 to 65° C., can keep toner particles from undergoing surface deterioration due to heat and enables pulverization of the powder material in a good efficiency. A case in which the ΔT between the temperature T1 and the temperature T2 of the mechanical grinding machine is smaller than 40° C. is undesirable in view of the performance of toner because there is a possibility that the material is not pulverized to have caused short pass. A case in which the ΔT is greater than 70° C. is also undesirable in view of the productivity of toner because there is a possibility that the material has been over-pulverized at the time of pulverization to tend to cause the surface deterioration due to heat or the in-machine melt adhesion.

When the powder material is pulverized by means of the mechanical grinding machine, the binder resin may also preferably have a glass transition point (Tg) of from 45 to 75° C., and more preferably from 55 to 65° C. Also, with respect to the Tg, the chamber temperature T1 at the whirl chamber 212 of the mechanical grinding machine may be 0° C. or below and may be lower by 60 to 75° C. than the Tg. This is preferable in view of the productivity of toner. Controlling the chamber temperature T1 at the whirl chamber 212 of the mechanical grinding machine to be 0° C. or below, or be lower by 60 to 75° C. than the Tg, can keep toner particles from undergoing surface deterioration due to heat and enables pulverization of the powder material in a good efficiency. Also, the chamber temperature T2 at the rear chamber 320 of the mechanical grinding machine may preferably be lower by 5 to 30° C., and more preferably 10 to 20° C., than the Tg. Controlling the chamber temperature T2 at the rear chamber 320 of the mechanical grinding machine to be lower by 5 to 30° C., and more preferably 10 to 20° C., than the Tg can keep toner particles from undergoing surface deterioration due to heat and enables pulverization of the powder material in a good efficiency.

The rotor 314 may preferably be rotated at a peripheral speed of from 80 to 180 m/sec, more preferably from 90 to 170 m/sec, and still more preferably from 100 to 160 m/sec. This is preferable in view of the productivity of toner. Rotating the rotor 314 preferably at a peripheral speed of from 80 to 180 m/sec, more preferably from 90 to 170 m/sec, and still more preferably from 100 to 160 m/sec, can keep the powder material from being insufficiently pulverized or excessively pulverized, and enables pulverization of the powder material in a good efficiency. A case in which the rotor 314 is rotated at a peripheral speed lower than 80 m/sec is undesirable in view of the performance of toner because the material tends to be not pulverized to cause short pass. A case in which the rotor 314 is rotated at a peripheral speed higher than 180 m/sec is also undesirable in view of the productivity of toner because the unit itself may receive a large load and at the same time the toner particles may excessively be pulverized at the time of pulverization to tend to undergo surface deterioration due to heat or cause in-machine melt adhesion.

The space between the rotor 314 and the stator 310 may preferably be set at a minimum gap of from 0.5 to 10.0 mm, more preferably from 1.0 to 5.0 mm, and still more preferably from 1.0 to 3.0 mm. Setting the space between the rotor 312 and the stator 310 preferably at a gap of from 0.5 to 10.0 mm, more preferably from 1.0 to 5.0 mm, and still more preferably from 1.0 to 3.0 mm, can keep the powder material from being insufficiently pulverized or excessively pulverized and enables pulverization of the powder material in a good efficiency. A case in which the space between the rotor 314 and the stator 310 is larger than 10.0 mm is undesirable in view of the performance of toner because the material tends to be not pulverized to cause short pass. A case in which the space between the rotor 314 and the stator 310 is smaller than 0.5 mm is also undesirable in view of the productivity of toner because the unit itself may receive a large load and at the same time the toner particles may excessively be pulverized at the time of pulverization to tend to undergo surface deterioration due to heat or cause in-machine melt adhesion.

Figure 13:
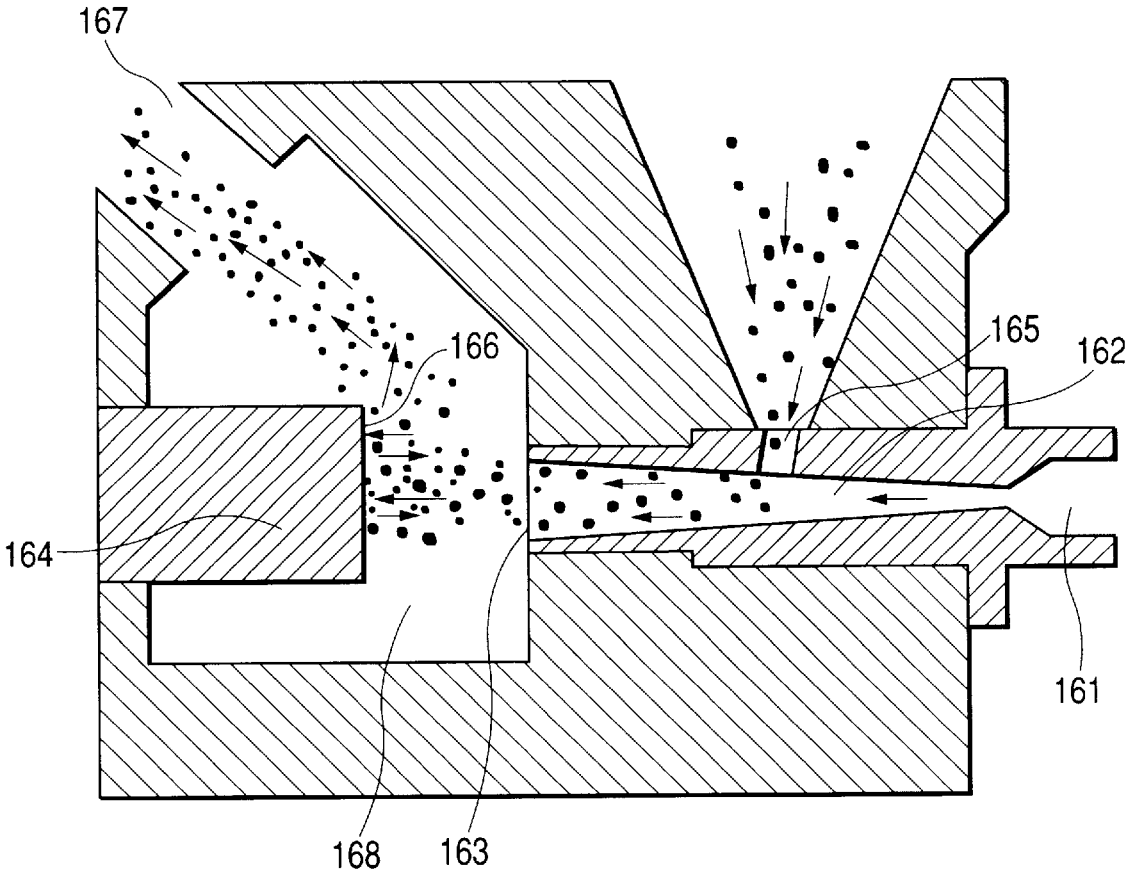
FIG. 13 PRIOR ART
FIG. 13 is a schematic cross-sectional view of a conventional collision air grinding machine.

This pulverization method does not require any primary classification before the step of pulverization and can be of simple construction. In addition thereto, it does not require the air in a large quantity for the pulverization of powder material. Hence, the amount of electric power consumed per kg of the toner in the step of pulverization can be about ⅓ or less compared with the case when toners are produced using the conventional collision air grinding machine shown in FIG. 13, thus the energy cost can be kept low.

The gas current classifier is described below.

Figure 9:
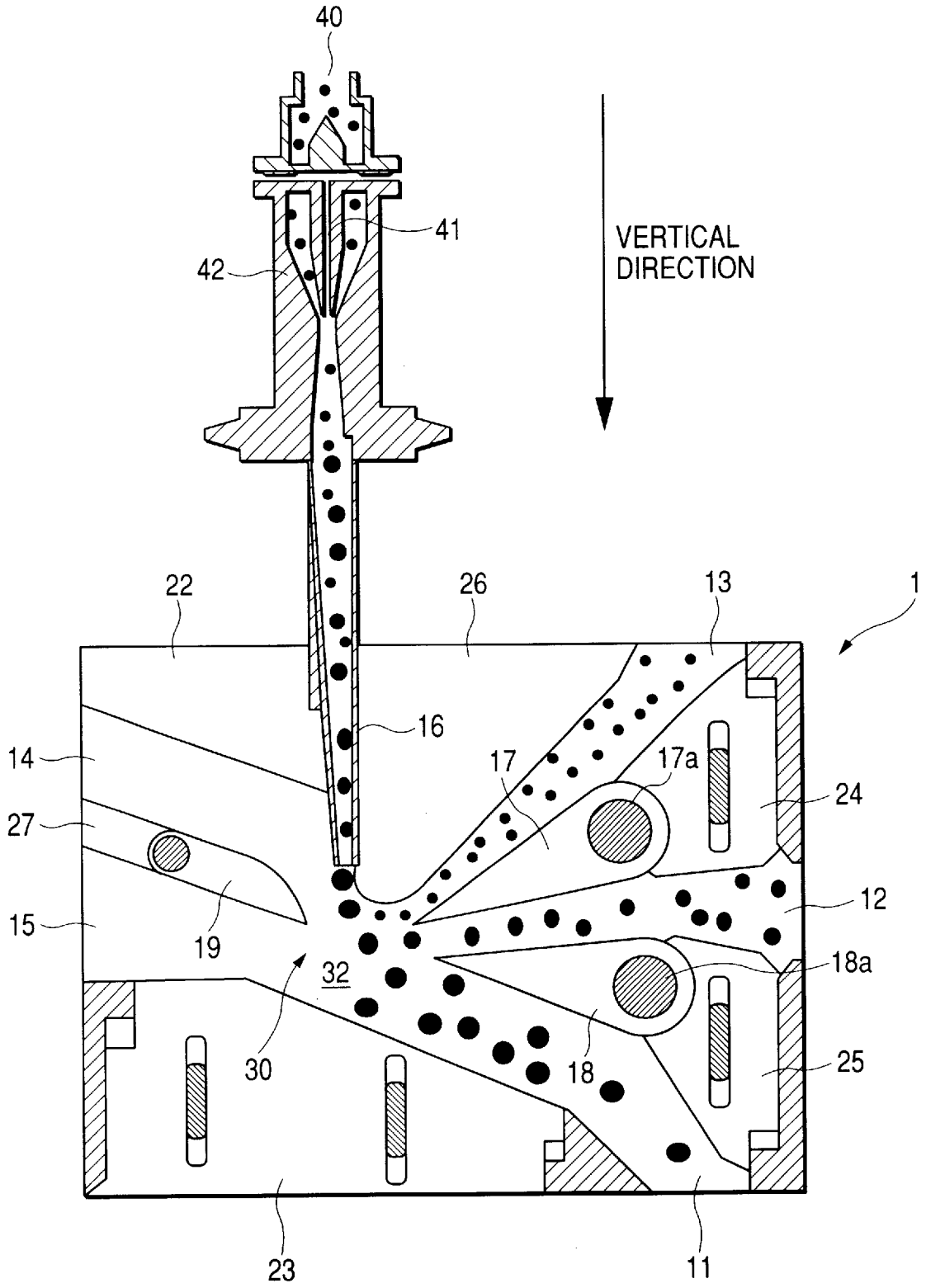
FIG. 9 is a schematic cross-sectional view of a multi-division gas current classifier used preferably in the step of classifying toner particles.

As an example of a preferred multi-division gas current classifier, an apparatus having the form as shown in FIG. 9 (cross-sectional view) is shown as a specific example.

As shown in FIG. 9, a sidewall 22 and a G-block 23 form part of a classifying chamber, and classifying edge blocks 24 and 25 have classifying edges 17 and 18, respectively. The G-block 23 is right and left slidable for its setting position. Also, the classifying edges 17 and 18 stand swing-movable around shafts 17*a* and 18*a*, respectively, and thus the tip position of each classifying edge can be changed by the swinging of the classifying edge. The respective classifying edge blocks 24 and 25 are so set up that their locations can be slided right and left. As they are slided, the corresponding knife-edge type classifying edges 17 and 18 are also slided right and left. These classifying edges 17 and 18 divide a classification zone 30 of the classifying chamber 32 into three sections.

A material feed nozzle 16 having at its rearmost-end part a material feed opening 40 for introducing a material powder therethrough, having at its rear-end part a high-pressure air nozzle 41 and a material powder guide nozzle 42 and also having an orifice in the classifying chamber 32 is provided on the right side of the sidewall 22, and a Coanda block 26 is disposed along an extension of the lower tangential line of the material feed nozzle 16 so as to form a long elliptic arc. The classifying chamber 32 has a left-part block 27 provided with a knife edge-shaped air-intake edge 19 extending toward the classifying chamber 32, and further provided with air-intake pipes 14 and 15 on the left side of the classifying chamber 32, which open to the classifying chamber 32. Also, as shown in FIG. 4, the air-intake pipes 14 and 15 are provided with a first gas feed control means 20 and a second gas feed control means 21, respectively, comprising, e.g. a damper, and also provided with static pressure gauges 28 and 29, respectively.

The locations of the classifying edges 17 and 18, the G-block 23 and the air-intake edge 19 are adjusted according to the kind of the toner particles, the material powder to be classified, and also according to the desired particle size.

At the bottom, sidewall and top of the classifying chamber 32, discharge outlets 11, 12 and 13, respectively, which open to the classifying chamber are provided correspondingly to the respective divided zones. The discharge outlets 11, 12 and 13 are connected with communicating means such as pipes, and may respectively be provided with shutter means such as valve means.

The material feed nozzle 16 comprises a rectangular pipe section and a pyramidal pipe section, and the ratio of the inner diameter of the rectangular pipe section to the inner diameter of the narrowest part of the pyramidal pipe section may be set at from 20:1 to 1:1, and preferably from 10:1 to 2:1, to obtain a good feed velocity.

The classification in the multi-division classifying zone having the above construction is operated, for example, in the following way. The inside of the classifying chamber is evacuated through at least one of the discharge outlets 11, 12 and 13. The material powder is jetted, and dispersed, into the classifying chamber 32 through the material feed nozzle 16 at a flow velocity of preferably from 10 to 350 m/sec, utilizing the gas stream flowing at a reduced pressure through the path inside the material feed nozzle 16 opening into the classifying chamber 32 and utilizing the ejector effect of compressed air jetted from the high-pressure air nozzle 41.

The particles in the material powder fed into the classifying chamber 32 is moved to draw curves by the action attributable to the Coanda effect of the Coanda block 26 and the action of gases such as air concurrently flowed in, and are classified according to the particle size and inertia force of the individual particles in such a way that larger particles (coarse particles) are classified to the outside of gas streams, i.e., the first division on the outer side of the classifying edge 18, median particles are classified to the second division defined between the classifying edges 18 and 17, and smaller particles are classified to the third division at the inner side of the classifying edge 17. The larger particles separated by classification, the median particles separated by classification and the smaller particles separated by classification are discharged from the discharge outlets 11, 12 and 13, respectively.

In the above classification of material powder, the classification points chiefly depend on the tip positions of the classifying edges 17 and 18 with respect to the lower end of the Coanda block 26 at which end the material powder is jetted out into the classifying chamber 32. The classification points are also affected by the suction flow rate of classification gas streams or the velocity of the material powder jetted out of the material feed nozzle 16.

In addition, in the multi-division gas current classifier having the form as shown in FIG. 9, the material feed nozzle 16, the material powder guide nozzle 42 and the high-pressure air nozzle 41 are provided at the upper part of the multi-division gas current classifier, and the classifying edge blocks have classifying edges are set positionally changeable so that the classification zone can be changed in shape. Hence, the classifier can dramatically been more improved in classification efficiency than any conventional gas current classifiers.

Various physical properties shown in the following Examples are measured by methods as described below.

(1) Measurement of particle size distribution:

The particle size distribution can be measured by various means. In the present invention, it is measured with a Coulter counter Multisizer.

A Coulter counter Multisizer Model II (manufactured by Coulter Electronics, Inc.) is used as a measuring instrument. An interface (manufactured by Nikkaki K. K.) that outputs number distribution and volume distribution and a personal computer CX-1 (manufactured by CANON INC.) are connected. As an electrolytic solution, an aqueous 1% NaCl solution is prepared using first-grade sodium chloride. Measurement is made by adding as a dispersant from 0.1 to 5 ml of a surface-active agent (preferably alkylbenzenesulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Measurement is made with the above Coulter counter Multisizer Model II, using as an aperture an aperture of 100 $\mu$m when toner's particle diameter is measured and an aperture of 13 $\mu$m when inorganic fine powder's particle diameter is measured. The volume and number of the toner and inorganic fine powder are measured and the volume distribution and number distribution are calculated. Then, the weight-based, weight-average particle diameter determined from the volume distribution is determined.

(2) Measurement of glass transition point (Tg) of toner and toner particles:

Measured according to ASTM D3418-82, using a differential thermal analyzer (DSC measuring instrument) DSC-7, manufactured by Perkin Elmer Co.

A sample for measurement is precisely weighed within the range of 5 to 20 mg, preferably 10 mg. This sample is put in a pan made of aluminum and an empty aluminum pan is used as reference. Measurement is made in a normal-temperature normal-humidity environment at a heating rate of 10° C./min within the measuring temperature range of from 30 to 200° C. In the course of this heating, main-peak endothermic peaks in the temperature range of from 40 to 100° C. are obtained. The point at which the line at a middle point of the base line before and after the appearance of the endothermic peak thus obtained and the differential thermal curve intersect is regarded as the glass transition point Tg.

(3) Measurement of molecular weight distribution of binder resin material:

Molecular weight of a chromatogram is measured by GPC (gel permeation chromatography) under the following conditions.

Columns are stabilized in a heat chamber of 40° C. To the columns kept at this temperature, tetrahydrofuran (THF) as a solvent flows at a flow rate of 1 ml per minute. A sample is dissolved in THF, and thereafter filtered with a filter of 0.2 $\mu$m in pore size, and the resultant filtrate is used as a sample. From 50 to 200 $\mu$l of a THF sample solution of resin which has been regulated to have a sample concentration of from 0.05 to 0.6% by weight is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Pressure Chemical Co. or Toso Co., Ltd., and to use at least about 10 standard polystyrene samples. An RI (refractive index) detector is used as a detector.

As columns, in order to make precise measurement in the region of molecular weight from 1,000 to 2,000,000, it is desirable to use a plurality of commercially available polystyrene gel columns in combination. For example, they may preferably comprise a combination of $\mu$-Styragel 500, 1,000, 10,000 and 100,000, available from Waters Co., and Shodex KA-801, KA-802, KA-803, KA-804, KA-805, KA-806 and KA-807, available from Showa Denko K. K.

An example of the image-forming method of the present invention is described below with reference to FIG. 20.

The surface of a photosensitive drum 701 is negatively charged by a contact charging means 742 which is a primary charging means, and exposed to laser light 705 to form a digital latent image by image scanning. The latent image thus formed is developed by reversal development using a dry-process magnetic toner (one-component type developer) 710, which is held in a developing assembly 709 having a magnetic blade 711 and a developing sleeve 704 internally provided with a magnet. In the developing zone, the conductive substrate of the photosensitive drum 701 is earthed, and an alternating bias, a pulse bias and/or a DC bias is/are applied to the developing sleeve 704 through a bias applying means 712. A transfer paper P is fed and transported to the transfer zone, where the transfer paper P is electrostatically charged by a contact transfer means 702 on its back surface (the surface opposite to the photosensitive drum side) through a voltage applying means 723, so that the toner image on the surface of the photosensitive drum 701 is transferred to the transfer paper P through the contact transfer means 702. The transfer paper P separated from the photosensitive drum 701 is subjected to fixing using a heat-pressure roller fixing assembly 707 in order to fix the toner image on the transfer paper P. The toner image may be transferred from the photosensitive drum 701 to the transfer paper P via an intermediate transfer member, or may be transferred to the transfer paper P not via any intermediate transfer member.

The dry-process magnetic toner remaining on the photosensitive drum 701 after the step of transfer is removed by a cleaning means 708 having a cleaning blade. When the remaining dry-process magnetic toner 704 is in a small quantity, the cleaning step may be omitted. After the cleaning, the residual charge on the surface of the photosensitive drum 701 is eliminated by erase exposure 706, thus the procedure again starting from the charging step using the contact charging means 742 is repeated.

The photosensitive drum 701 (i.e., the electrostatic-image-bearing member) comprises a photosensitive layer and a conductive substrate, and is rotated in the direction of an arrow. The developing sleeve 704 formed of a non-magnetic cylinder, which is a toner-carrying member, is rotated so as to move in the same direction as the surface movement of the photosensitive drum 701 in the developing zone. Inside the developing sleeve 704, a multi-polar permanent magnet (magnet roll) serving as a magnetic-field-generating means is provided in an unrotatable state. The dry-process magnetic toner 710 held in the developing assembly 709 is coated on the surface of the developing sleeve 704, and, for example, negative triboelectric charges are imparted to the magnetic toner as a result of the friction between the surface of the developing sleeve 704 and the magnetic toner. A magnetic doctor blade 711 made of iron is also disposed in proximity to the cylinder surface (space: 50 $\mu$m to 500 $\mu$m) so as to face one magnetic-pole position of the multi-polar permanent magnet. Thus, the thickness of magnetic toner layer Is controlled to be small (30 $\mu$m to 300 $\mu$m) and uniform so that a magnetic toner layer with a thickness smaller than the gap between the photosensitive drum 701 and the developing sleeve 704 in the developing zone is formed. The rotational speed of this developing sleeve 704 is regulated so that the peripheral speed of the developing sleeve 704 can be substantially equal or close to the peripheral speed of the photosensitive drum 701. As the magnetic doctor blade 711, a permanent magnet may be used in place of Iron to form an opposing magnetic pole. In the developing zone, an AC bias or a pulse bias may b e applied to the developing sleeve 704 through a bias means 712. This AC bias may have a frequency (f) of 200 to 4,000 Hz and a Vpp of 500 to 3,000 V.

When the magnetic toner is moved in the developing zone, the magnetic toner moves to the side of the electrostatic latent image by the electrostatic force of the surface of the photosensitive drum 70 and the action of the AC bias or pulse bias.

In place of the magnetic doctor blade 711, an elastic blade formed of an elastic material such as silicone rubber may be used so as to regulate the layer thickness of the magnetic toner layer by pressure to coat the magnetic toner on the developing sleeve.

Figure 21:
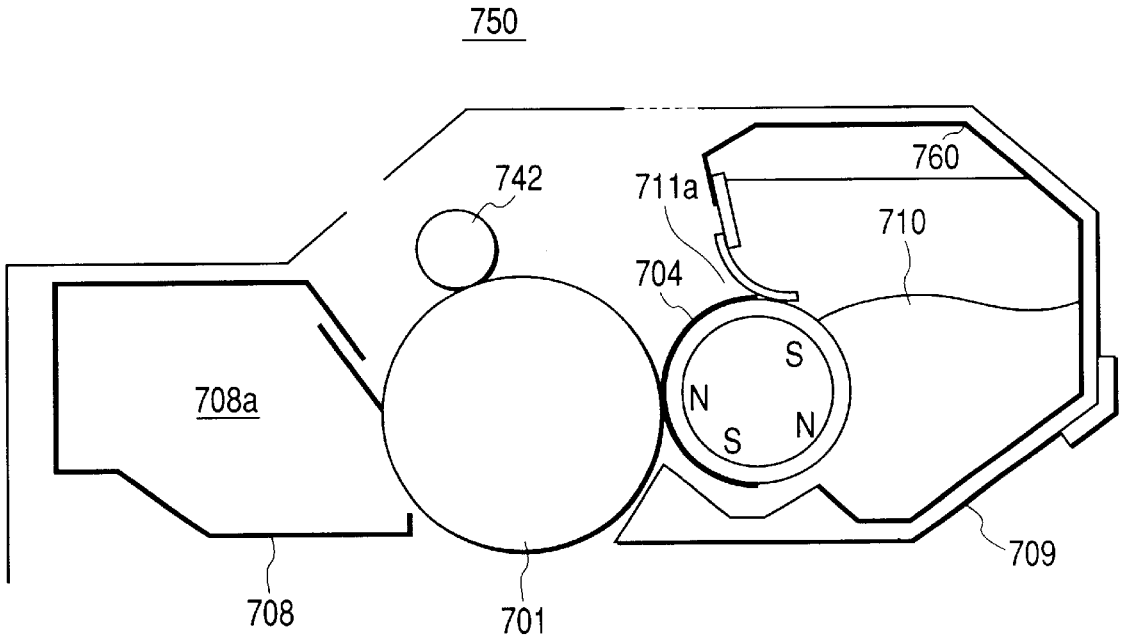
FIG. 21 is a schematic illustration for describing an example of the process cartridge of the present invention.

FIG. 21 illustrates a specific example of the process cartridge of the present invention. In the process cartridge, at least the developing means and the electrostatic-image-bearing member are joined into one unit as a cartridge, and the process cartridge is provided detachably in the body of the image forming apparatus (e.g., a copying machine or a laser beam printer).

In FIG. 21, a process cartridge 750 is exemplified in which a developing means 709, a drum-type electrostatic-image-bearing member (a photosensitive drum) 701, a cleaner 708 having a cleaning blade 708*a* and a primary charging means (a charging roller) 742 are joined into one unit.

In the process cartridge shown in FIG. 21, the developing means 709 has in a toner container 760 an elastic blade 711*a* and a magnetic toner 710. At the time of development, a prescribed electric field is formed across the photosensitive drum 701 and the developing sleeve 704 by applying a bias voltage from a bias applying means. In order for the developing step to be carried out preferably, the distance between the photosensitive drum 701 and the developing sleeve 704 is very important.

The present invention is described below in greater detail by giving Examples and Comparative Example of the invention.

Sulfur-containing Copolymer

Production Example 1

| | (by weight) |
|---|---|
| Methanol | 300 parts |
| Toluene | 100 parts |
| Styrene | 480 parts |
| 2-Ethylhexyl acrylate | 78 parts |
| 2-Acrylamido-2-methylpropanesulfonic acid | 42 parts |
| Lauroyl peroxide | 6 parts |

The above materials were loaded into a flask, and a stirrer, a thermometer and a nitrogen feeder were fitted thereto. Solution polymerization was carried out at 70° C. in an atmosphere of nitrogen, which was continued for 10 hours, until the polymerization reaction was completed. The polymer thus obtained was dried under reduced pressure and then crushed to obtain sulfur-containing copolymer (a), having a weight-average molecular weight Mw of 27,000, a glass transition temperature Tg of 73° C. and an average particle diameter of 420 μm. Physical properties of the sulfur-containing copolymer (a) are shown in Table 1.

Sulfur-containing Copolymer

Production Examples 2 & 3

Sulfur-containing copolymers (b) and (c) as shown in Table 1 were obtained in the same manner as in Sulfur-containing Copolymer Production Example 1 except for changing the compositional ratio of the monomers used therein.

Sulfur-containing Copolymer

Production Examples 4 & 5

The sulfur-containing copolymer (a) was polymerized by means of a 1 mm screen speed mill and a jet mill to obtain sulfur-containing copolymer (d), having an average particle diameter of 290 μm, and sulfur-containing copolymer (e), having an average particle diameter of 150 μm, respectively, shown in Table 1.

Sulfur-containing Copolymer

Production Example 6

| | (by weight) |
|---|---|
| Methanol | 300 parts |
| Toluene | 100 parts |
| Styrene | 468 parts |
| 2-Ethylhexyl acrylate | 90 parts |
| 2-Acrylamido-2-methylpropanesulfonic acid | 42 parts |
| Lauroyl peroxide | 6 parts |

Sulfur-containing copolymer (f) as shown in Table 1 was obtained in the same manner as in Production Example 1 except for using the above materials. Physical properties of the sulfur-containing copolymer (f) are shown in Table 1.

Sulfur-containing Copolymer

Production Example 7

| | (by weight) |
|---|---|
| Methanol | 300 parts |
| Toluene | 100 parts |
| Styrene | 470 parts |
| 2-Ethylhexyl acrylate | 90 parts |
| 2-Acrylamido-2-methylpropanesulfonic acid | 40 parts |
| Lauroyl peroxide | 10 parts |

The above materials were loaded into a flask for 2 liters fitted with a stirrer, a condenser, a thermometer and a nitrogen feed pipe. Solution polymerization was carried out at 65° C. for 10 hours with stirring and under the feeding of nitrogen. Its contents were taken out of the flask, and dried under reduced pressure and then crushed by means of a hammer mill to obtain sulfur-containing copolymer (g), having physical properties shown in Table 1.

Sulfur-containing Copolymer

Production Example 8

| | (by weight) |
|---|---|
| Methanol | 100 parts |
| Toluene | 300 parts |
| Styrene | 470 parts |
| 2-Ethylhexyl acrylate | 90 parts |
| 2-Acrylamido-2-methylpropanesulfonic acid | 40 parts |
| Lauroyl peroxide | 12 parts |

Sulfur-containing copolymer (h), having physical properties shown in Table 1, was obtained in the same manner as in Production Example 6 except for using the above materials.

Sulfur-containing Copolymer

Production Example 9

| | (by weight) |
|---|---|
| Methanol | 300 parts |
| Toluene | 100 parts |
| Styrene | 550 parts |
| 2-Acrylamido-2-methylpropanesulfonic acid | 50 parts |
| Lauroyl peroxide | 12 parts |

Sulfur-containing copolymer (i), having physical properties shown in Table 1, was obtained in the same manner as in Production Example 6 except for using the above materials.

Sulfur-containing Copolymer

Production Example 10

| | (by weight) |
|---|---|
| Methanol | 300 parts |
| Toluene | 100 parts |
| 4-t-Butylstyrene | 570 parts |
| Methacrylsulfonic acid | 30 parts |
| Lauroyl peroxide | 10 parts |

Sulfur-containing copolymer (j), having physical properties shown in Table 1, was obtained in the same manner as in Production Example 1 except for using the above materials.

Sulfur-containing Copolymer

Production Example 11

| | (by weight) |
|---|---|
| Methanol | 300 parts |
| Toluene | 100 parts |
| Styrene | 560 parts |
| 2-Acrylamido-2-methylpropanesulfonic acid | 40 parts |
| Lauroyl peroxide | 12 parts |

Sulfur-containing copolymer (k), having physical properties shown in Table 1, was obtained in the same manner as in Production Example 6 except for using the above materials.

Sulfur-containing Copolymer

Production Example 12

| | (by weight) |
|---|---|
| Styrene | 510 parts |
| n-Butyl acrylate | 66 parts |
| Methacrylsulfonic acid | 24 parts |

Using the above materials, bulk polymerization was carried out for 8 hours, heating them to 120° C., without addition of any polymerization solvent and polymerization initiator. Then, 300 parts by weight of xylene was added and the reaction mixture was cooled to 110° C., and 300 parts by weight of xylene with 6 parts by weight of t-butyl peroxy-2-ethylhexanoate dissolved therein was dropwise added for 6 hours, which was continued for 2 hours, until the polymerization reaction was completed. The polymer thus obtained was dried under reduced pressure and then crushed to obtain sulfur-containing copolymer (1), having physical properties shown in Table 1.

Sulfur-containing Copolymer

Production Example 13

| | (by weight) |
|---|---|
| Methanol | 100 parts |
| 2-Butanone | 300 parts |
| Styrene | 470 parts |
| 2-Ethylhexyl acrylate | 90 parts |
| 2-Acrylamido-2-methylpropanesulfonic acid | 40 parts |
| 2,2-Azobis(2-methylbutyronitrile) | 6 parts |
| Divinylbenzene | 0.05 part |

Sulfur-containing copolymer (m), having physical properties shown in Table 1, was obtained in the same manner as in Production Example 1 except for using the above materials.

EXAMPLE 1

| | (by weight) |
|---|---|
| Binder resin (polyester resin; Tg: 60° C.; acid value: 20 mg.KOH/g; hydroxyl value: 30 mg.KOH/g; molecular weight, Mp: 7,000, Mn: 3,000 and Mw: 55,000) | 100 parts |
| Magnetic iron oxide (average particle diameter: 0.20 μm; characteristics under application of magnetic field of 795.8 kA/m, Hc: 9.2 kA/m; σs: 82 $Am^2/kg$ and σr: 11.5 $Am^2/kg$) | 90 parts |
| Sulfur-containing copolymer (a) | 2 parts |
| Low-molecular-weight ethylene-propylene copolymer | 3 parts |

The above materials were thoroughly mixed using a Henschel mixer (FM-75 Type, manufactured by Mitsui Miike Engineering Corporation), and thereafter kneaded using a twin-screw kneader (PCM-30 Type, manufactured by Ikegai Corp.) set to a temperature of 130° C. The kneaded product obtained was cooled, and then crushed by means of a hammer mill to a size of 1 mm or smaller to obtain powder material (A) (crushed product).

The powder material (A) was finely pulverized and classified by means of the unit system shown in FIG. 4. Turbo mill Model T-250, (manufactured by Turbo Kogyo K. K.) was used as the mechanical grinding machine 301. The distance between the rotor 314 and stator 310 shown in FIG. 5 was set to be 1.5 mm, and the rotor 314 was driven at a peripheral speed of 115 m/sec.

In the present Example, the powder material consisting of a crushed product is fed into the mechanical grinding machine 301 through the table-type, first constant-rate feeder 315 at a rate of 20 kg/h, and pulverized there. The powder material pulverized in the mechanical grinding machine 301 is collected by a cyclone 229 while being accompanied with suction air drawn from an evacuation fan 224, and then introduced into the second constant-rate feeder 2. Here, the inlet temperature in the mechanical grinding machine was −10° C., the outlet temperature was 46° C. and the ΔT between the inlet temperature and the outlet temperature was 56° C. Also, finely pulverized product A obtained here by the pulverization using the mechanical grinding machine 301 had a weight average particle diameter of 6.6 μm and had a sharp particle size distribution, containing 53% by number of particles of 4.0 μm or smaller in particle diameter and 5.4% by volume of particles of 10.1 μm or larger in particle diameter.

Next, the finely pulverized product A obtained by the pulverization using the mechanical grinding machine 301 was introduced into the second constant-rate feeder 2, and then introduced into the multi-division gas current classifier 1, having the construction as shown in FIG. 9, through the vibrating feeder 3 and the material feed nozzle 16 at a rate of 22 kg/h. In the multi-division gas current classifier 1, the finely pulverized product is classified into the three fractions, coarse powder, median powder and fine powder by utilizing the Coanda effect. When the finely pulverized product was introduced into the multi-division gas current classifier 1, the inside of the classification chamber was evacuated through at least one of the discharge outlets 11, 12 and 13, where the gas streams flowing inside the material feed nozzle 16, having an opening in the classification chamber, by the action of evacuation was utilized, and also the compression air jetted from the high-pressure air feed nozzle 41 was utilized. The finely pulverized product thus introduced was classified into the three fractions, coarse powder G, median powder A-1 and fine powder, instantaneously in 0.1 second or shorter. Among those having been obtained by classification, the coarse powder G was collected by the collecting cyclone 6. Thereafter, it was introduced into the mechanical grinding machine 301 at a rate of 1.0 kg/h, and again introduced into the pulverization step.

The median powder A-1 (magnetic toner particles) thus obtained by classification in the above classification step had a weight average particle diameter of 6.5 μm and had a sharp particle size distribution, containing 20.5% by number of particles of 4.0 μm or smaller in particle diameter and 3.8% by volume of particles of 10.1 μm or larger in particle diameter.

Here, the ratio of the weight of the median powder (magnetic toner particles) obtained finally to the total weight of the powder material having been introduced (i.e., classification yield) was 82%.

To 100 parts by weight of this median powder A-1, 1.2 parts by weight of hydrophobic fine silica powder (BET specific surface area: 300 $m^2/g$) was externally added using a Henschel mixer to obtain an insulating negatively chargeable magnetic toner (A).

The magnetic toner (A) had a weight average particle diameter of 6.5 μm. Measurement with FPIA-1000 on the magnetic toner (A) revealed that it contained 95.7% by number of particles with a circularity a of 0.900 or higher and 78.4% by number of particles with a circularity a of 0.950 or higher. Also, the particle concentration A before the cut of particles of 3 μm or smaller (the whole particles) was 15,209 particles/μl, and the particle concentration B of measured particles of 3 μm or larger was 13,028.3 particles/μl.

Figure 14:
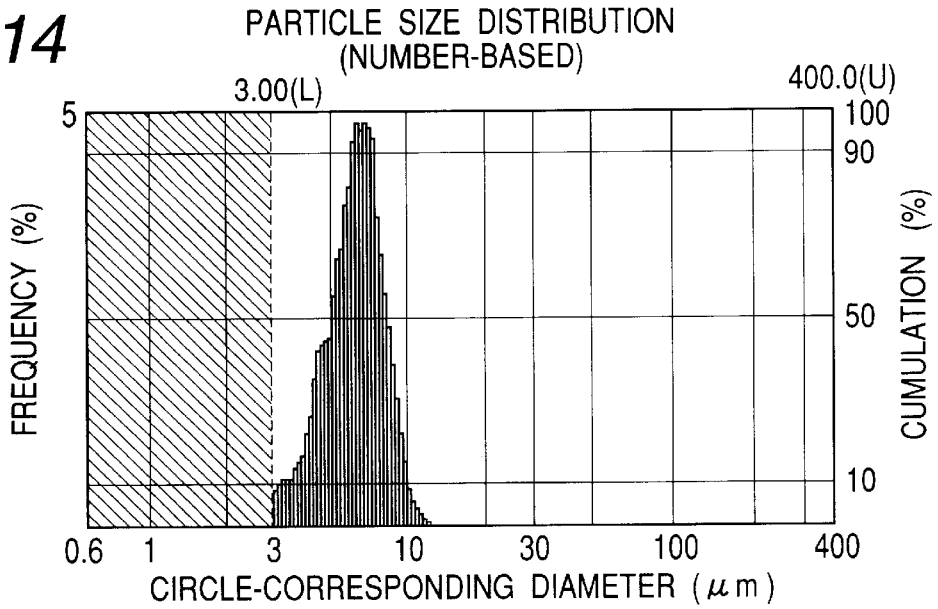
FIG. 14 is a graphic representation of the particle size distribution of median powder A-1.
Figure 15:
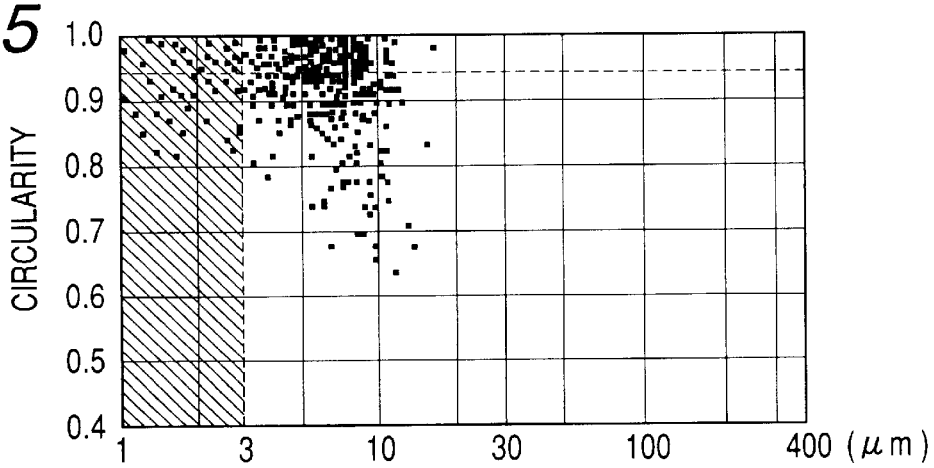
FIG. 15 is a graphic representation of the circularity distribution of median powder A-1.
Figure 16:
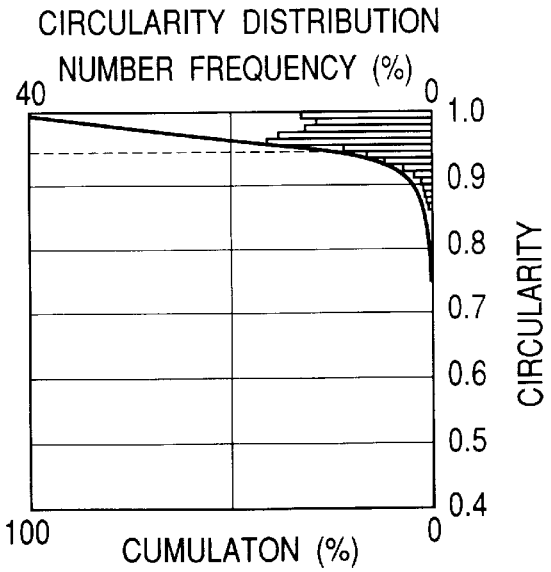
FIG. 16 is a graphic representation of the circularity-corresponding diameter of median powder A-1.

The particle size distribution, circularity distribution and circle-corresponding diameter measured with FPIA-1000 are graphically shown in FIGS. 14 to 16.

Evaluation 1

Figure 20:
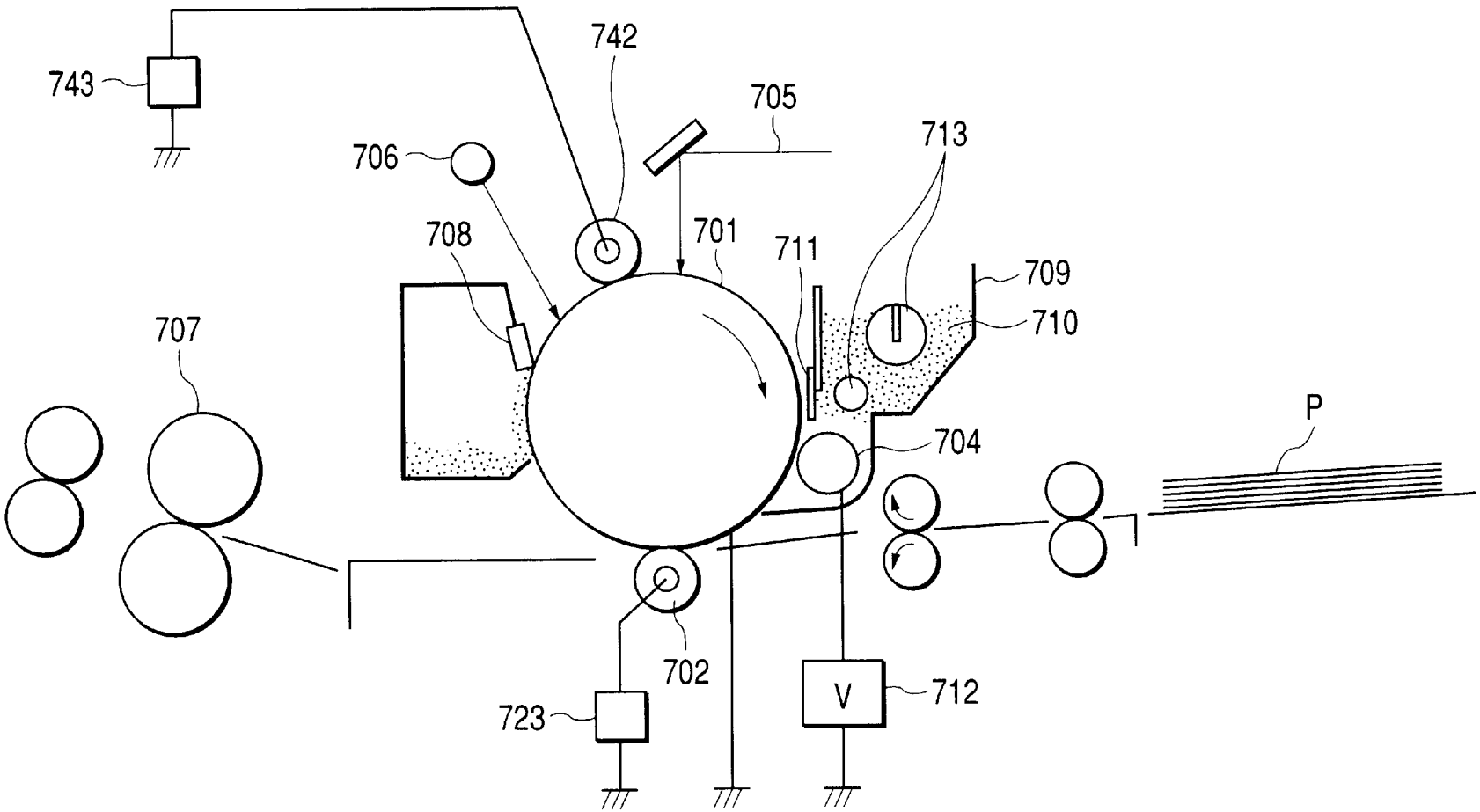
FIG. 20 is a schematic illustration for describing an example of the image-forming method of the present invention.

The dry-process, magnetic toner (A) was put in a developing assembly of a copying machine NP6350, manufactured by CANON INC., employing the electrophotographic process shown in FIG. 20, and was left overnight (12 hours or longer) in a normal-temperature normal-humidity chamber (23° C./50%RH). After the weight of the developing assembly was measured, the developing assembly was set in the NP6350, and its developing sleeve was rotated for 3 minutes. Here, the cleaner part and waste toner collection part in the main body were once detached and their weight was measured beforehand. Using a test chart having a print percentage (image area percentage) of 6%, images were reproduced on 500 sheets to evaluate toner transfer efficiency. The transfer efficiency of the magnetic toner (A) was 96%.

The transfer efficiency was calculated according to the following calculating expression.

Transfer efficiency (%)=[{weight loss of developing assembly−(weight gain at cleaner part+weight gain at waste toner collection part)}/weight loss of developing assembly]×100

Evaluation 2

After the above transfer efficiency was measured, the copying machine having the developing assembly was moved to a normal-temperature low-humidity chamber (23° C./5%RH). Then, the developing assembly was taken outside the copying machine and was left for 3 days. Thereafter, the developing assembly was set in NP6350, and its developing sleeve was rotated for 1 minute. Using a test chart having a print percentage (image area percentage) of 6%, images were reproduced on 1,000 sheets to evaluate images on the basis of fog at white areas on the test charge. Evaluation ranks are shown below.

Using a fog-measuring, reflection measuring instrument REFLECTOMETER (manufactured by Tokyo Denshoku K. K.), the reflectance at the white areas of the image and that of virgin paper were measured, and a difference between the both is regarded as fog. Reflectance of virgin paper−reflectance at image white areas=fog (%)

A: Fog is less than 0.1%.
B: Fog is 0.1% or more to less than 0.5%.
C: Fog is 0.5% or more to less than 1.5%.
D: Fog is 1.5% or more to less than 2.0%.
E: Fog is 2.0% or more.

Evaluation 3

The magnetic toner (A) was used in a copying machine NP6085, manufactured by CANON INC., and images were reproduced on 100,000 sheets in a normal-temperature low-humidity chamber (23° C./5%RH), where the image density (F) of final images was measured beforehand. Then, the developing assembly was detached from the copying machine and was left in a high-temperature high-humidity chamber (32.5° C./85%RH) for 2 days. Here, as a measure for preventing the developing assembly from moisture condensation, the developing assembly was sealed in a plastic bag when it was put in the high-temperature high-humidity chamber. After the conditioning of temperature and humidity for 5 hours or longer, the bag was opened and the developing assembly was taken out. The developing assembly was set in NP6085, and its developing sleeve was rotated for 1 minute. Thereafter, images were reproduced on 10 sheets, and an average value of image densities on the 10 sheets was regarded as density after leaving (R).

The charging performance of the magnetic toner was evaluated on the basis of the image density (F) before leaving and the image density after leaving (R). Evaluation ranks are shown below.

A: The value of (F)–(R) is less than 0.02.
B: The value of (F)–(R) is 0.02 or more to less than 0.05.
C: The value of (F)–(R) is 0.05 or more to less than 0.10.
D: The value of (F)–(R) is 0.10 or more to less than 0.15.
E: The value of (F)–(R) is 0.15 or more.

The results of evaluation on the foregoing are shown in Table 6.

EXAMPLE 2

Figure 8:
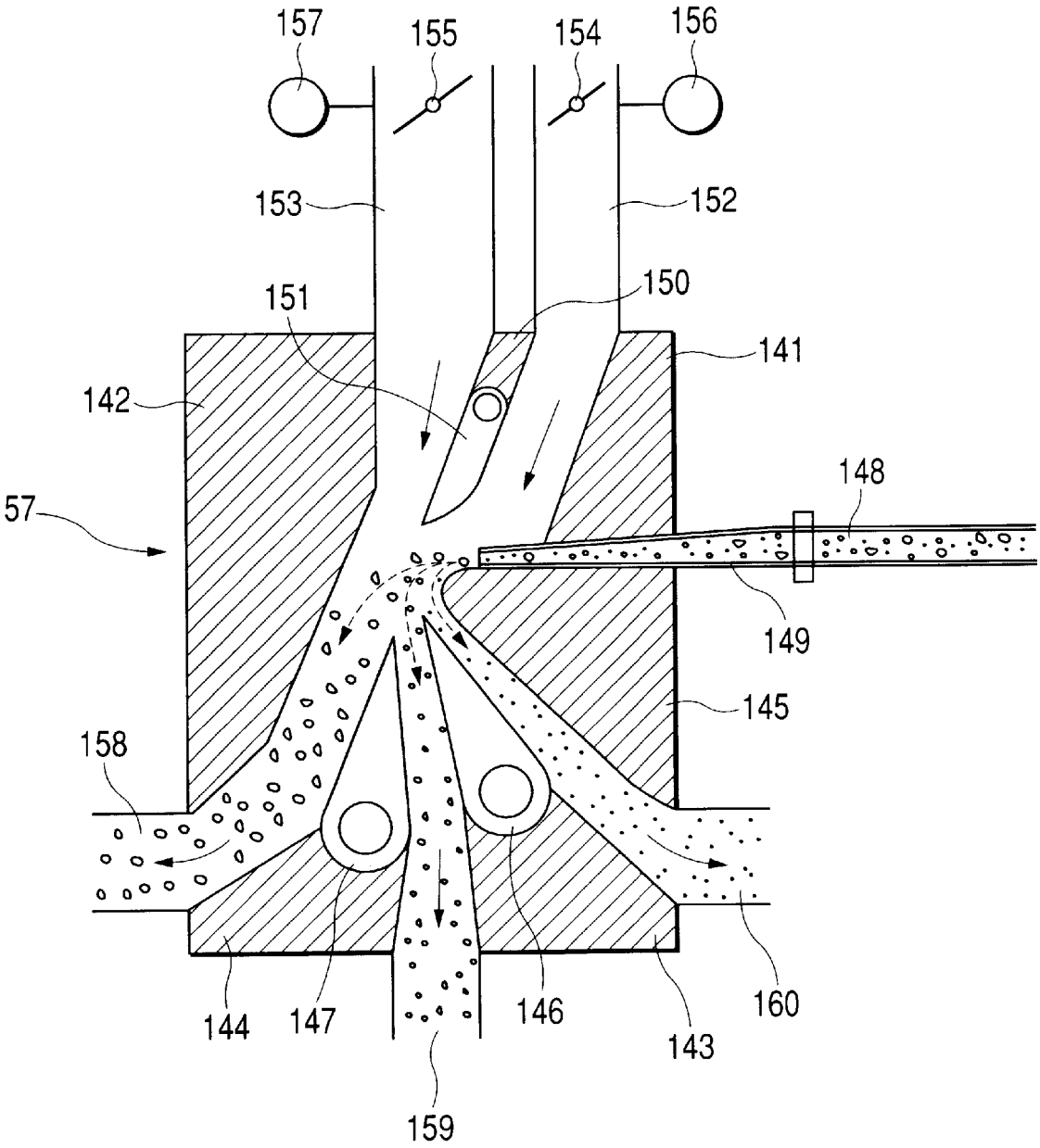
FIG. 8 is a schematic cross-sectional view of a multi-division gas current classifier used in the step of classifying toner particles.

Median powder A-2 (magnetic toner particles) was obtained from finely pulverized product A2 in the same manner as in Example 1 except that the multi-division gas current classifier used was changed to the type shown in FIG. 8. Here, the ratio of the weight of the median powder (magnetic toner particles) obtained finally to the total weight of the powder material having been introduced (i.e., classification yield) was 78%.

The particle size of the median powder A-2 was as shown in Table 3.

EXAMPLES 3 to 6

Median powders A-3, A-4, A-5 and A-6 (magnetic toner particles) were obtained from finely pulverized products A3, A4, A5 and A6, respectively, in the same manner as in Example 1 except that the conditions for pulverization and classification were changed in the unit system shown in FIG. 4.

The particle size of the finely pulverized products A3, A4, A5 and A6 and the median powders A-3, A-4, A-5 and A-6 each were as shown in Tables 2 and 3. Also, here, the unit system was operated under conditions as shown in Table 5.

To 100 parts by weight of the median powder A-3, 1.0 part by weight of hydrophobic fine silica powder (BET specific surface area: 300 $m^2/g$); to 100 parts by weight of the median powders A-4 and A-6, 0.6 part by weight of hydrophobic fine silica powder (BET specific surface area: 300 $m^2/g$); and to 100 parts by weight of the median powder A-5, 1.2 parts by weight of hydrophobic fine silica powder (BET specific surface area: 300 $m^2/g$) were externally added using a Henschel mixer to obtain magnetic toners (B), (C), (D) and (E), respectively.

The weight-average particle diameter and circularity (measured with FPIA-1000) of each of the above magnetic toners were as shown in Table 4.

Subsequently, evaluation was made in the same manner as in Example 1 to obtain the results shown in Table 6.

EXAMPLES 7 to 18

Finely pulverized products B to M and their corresponding median powders B-1 to M-1 were produced and the hydrophobic fine silica powder was externally added thereto to obtain magnetic toners (F) to (Q), respectively, in the same manner as in Example 1 except that the sulfur-containing copolymer was changed to types (b) to (m) to form powder materials (B) to (M), respectively.

The weight-average particle diameter and circularity (measured with FPIA-1000) of each of the above magnetic toners were as shown in Table 4.

Here, the particle size of the finely pulverized products B to M and the median powders B-1 to M-1 each were as shown in Tables 2 and 3. Also, the unit system was operated under conditions as shown in Table 5.

Subsequently, evaluation was made in the same manner as in Example 1 to obtain the results shown in Table 6.

Comparative Example 1

Figure 11:
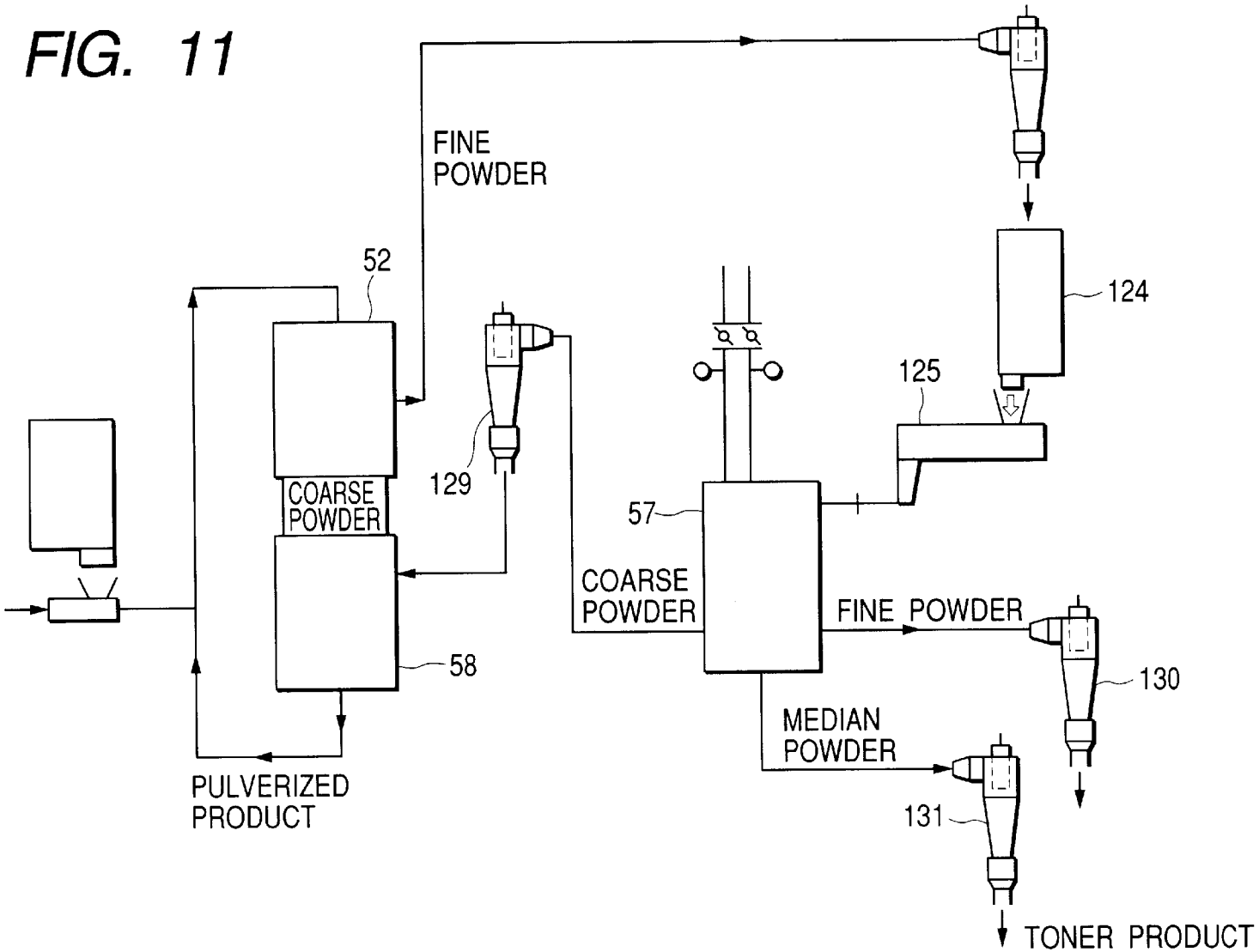
FIG. 11 is a system diagram showing a conventional toner production process.

The powder material (A) was finely pulverized and then classified using a unit system shown in FIG. 11. The pulverizer shown in FIG. 13 was used as the collision air grinding machine, a means constructed as shown in FIG. 12 was used as a first classification means (52 in FIG. 11), and a means constructed as shown in FIG. 8 was used as a second classification means (57 in FIG. 11).

Figure 12:
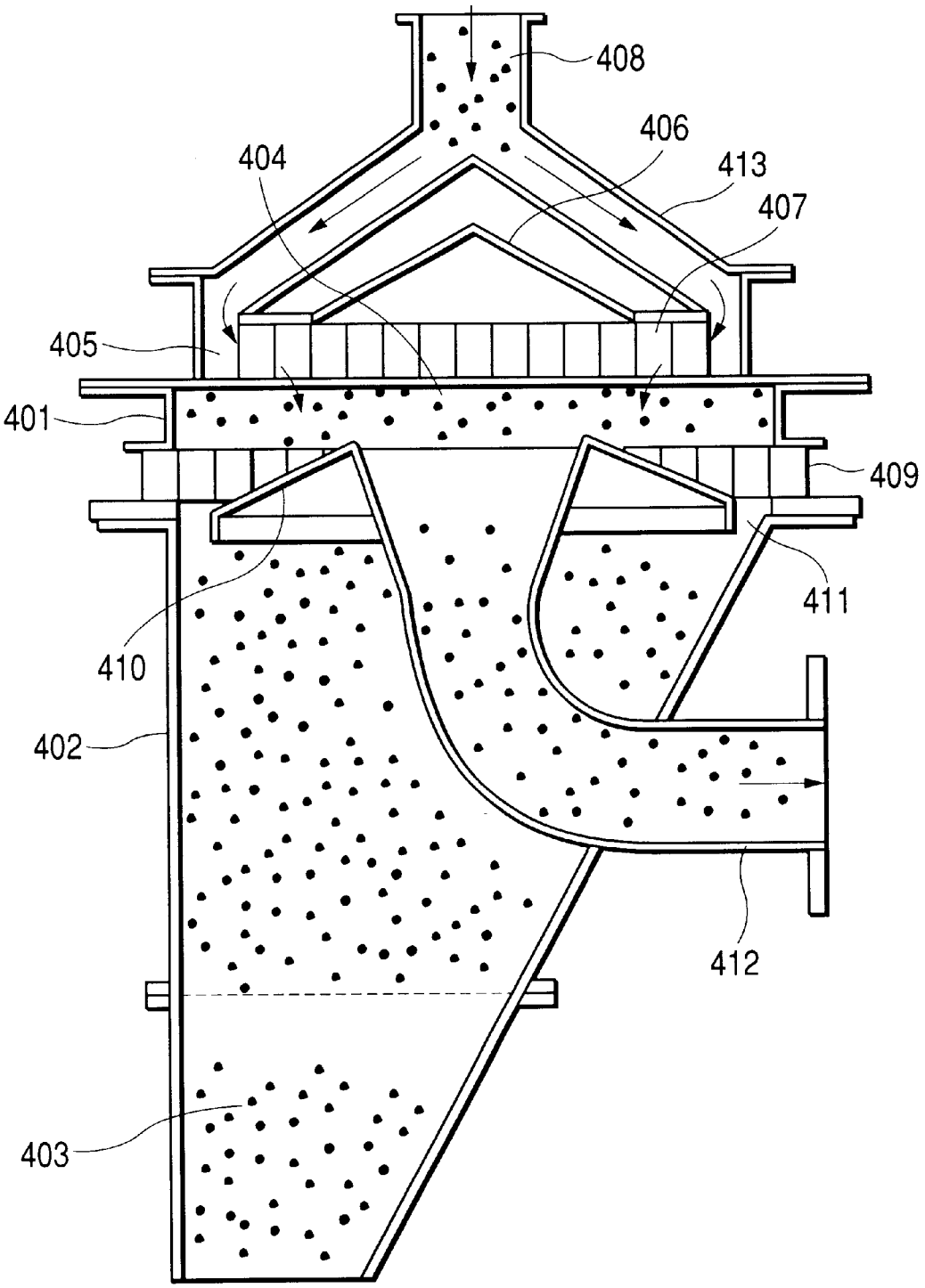
FIG. 12 PRIOR ART
FIG. 12 is a schematic cross-sectional view of an example of a classifier used conventionally in a first classification means and a second classification means.

In FIG. 12, reference numeral 401 denotes a cylindrical main-body casing; and 402 denotes a lower-part casing, to the lower part of which a hopper 403 for discharging coarse powder is connected. In the interior of the main-body casing 401, a classifying chamber 404 is formed, and is closed with a circular guide chamber 405 attached to the upper part of this classifying chamber 404 and with a conical (umbrella-shaped) upper-part cover 406 having a vertex at the center.

A plurality of louvers 407 arranged in the peripheral direction are provided on a partition wall between the classifying chamber 404 and the guide chamber 405. The powder material and air sent into the guide chamber 405 are whirlingly flowed from the openings of the individual louvers 407.

The upper part of the guide chamber 405 consists of a space formed between a conical upper-part casing 413 and a conical upper-part cover 406.

The main-body casing 401 is provided at its lower part with classifying louvers 409 arranged in the circumferential direction, and classifying air which causes whirls is taken into the classifying chamber 404 from the outside via the classifying louvers 409.

The classifying chamber 404 is provided at its bottom with a conical (umbrella-shaped) classifying plate 410 having an imaginary vertex at the center, and a coarse-powder discharge opening 411 is formed along the periphery of the classifying plate 410. Also, to the center of the classifying plate 410, a fine powder discharge chute 412 is connected. The chute 412 is bent in L-shape at its lower part, and the end of this bent portion is positioned on the outside of the sidewall of the lower-part casing 402. The chute is further connected to a suction fan via fine-powder collection means such as a cyclone or a dust collector. The suction fan causes suction force to act in the classifying chamber 404 to produce whirls necessary for classification by the action of suction air flowing into the classifying chamber 404 through the louvers 409.

In the present Comparative Example, a gas current classifier constructed as described above is used as the first classification means. The air holding the above powder material for producing the toner is fed into the guide chamber 405 from an air feed pipe 408, whereupon the air holding this powder material passes through the individual louvers 407 from the guide chamber 405 and flows into the classifying chamber 404 while being whirled and being dispersed in a uniform concentration.

The powder material whirlingly flowed into the classifying chamber 404 is carried on the suction air flowing through the classifying louvers 409, provided at the lower part of the classifying chamber 404, to become whirled increasingly, and is separated centrifugally into coarse powder and fine powder by the action of centrifugal force acting on individual particles. The coarse powder, which turns along the inner periphery of the classifying chamber 404, is discharged from the coarse-powder discharge opening 411 and is discharged out of the classifier from the lower-part hopper (coarse-powder discharge hopper) 403.

The fine powder, which moves toward the center along the upper-part slope of the classifying chamber 404 is discharged through the fine powder discharge chute 412.

The powder material was fed at a rate of 10.0 kg/h by means of a table-type first constant-rate feeder 121 through an injection feeder 135, which was fed through the feed pipe 408 into the gas current classifier shown in FIG. 12, and was classified by the action of centrifugal force acting on individual particles. Via the coarse-powder discharge hopper 403, the coarse powder fractionated by classification was fed into the collision air grinding machine shown in FIG. 13, through its pulverizing material feed opening 165, and then pulverized using compression air of 0.588 MPa (6.0 kg/cm$^2$) in pressure and 6.0 Nm3/min. Thereafter, the pulverized product was mixed with the toner pulverizing material being fed into the material feed zone, during which the material was circulated to the gas current classifier to carry out closed-path pulverization again. Meanwhile, the fine powder obtained by classification was collected in a cyclone 131 while being accompanied with suction air drawn from an evacuation fan to obtain finely pulverized product N.

The finely pulverized product N obtained here had a particle size distribution that it had a weight average particle diameter of 6.7 $\mu$m and contained 63.3% by number of particles of 4.0 $\mu$m or smaller in particle diameter and 11.1% by volume of particles of 10.1 $\mu$m or larger in particle diameter.

The finely pulverized product N thus obtained was introduced into the multi-division gas current classifier shown in FIG. 8, through a second constant-rate feeder 124 so as to be classified into the three fractions, coarse powder, median powder N-1 and fine powder by utilizing the Coanda effect through a vibrating feeder 125 and nozzles 148 and 149 at a rate of 13.0 kg/h. When introduced, suction force was utilized which was derived from reduced pressure in the system by suction evacuation attributable to collecting cyclones 129, 130 and 131 communicating with discharge openings 158, 159 and 160, respectively. Among those having been obtained by classification, the coarse powder was collected by the collecting cyclone 129. Thereafter, it was introduced into the above collision air grinding machine 58 at a rate of 1.0 kg/h, and again introduced into the pulverization step.

The median powder N-1 thus obtained by classification in the above classification step was in a particle size distribution that it had a weight average particle diameter of 6.6 $\mu$m and contained 23.3% by number of particles of 4.0 $\mu$m or smaller in particle diameter and 5.1% by volume of particles of 10.1 $\mu$m or larger in particle diameter.

Here, the ratio of the weight of the median powder obtained finally to the total weight of the powder material having been introduced (i.e., classification yield) was 69%.

To 100 parts by weight of this median powder N-1, 1.2 parts by weight of hydrophobic fine silica powder (BET specific surface area: 300 m$^2$/g) was externally added using a Henschel mixer to obtain comparative magnetic toner (a).

The comparative magnetic toner (a) had a weight average particle diameter of 6.5 $\mu$m. Measurement with FPIA-1000 on the comparative magnetic toner (a) revealed that it contained 94.0% by number of particles with a circularity a of 0.900 or higher and 67.8% by number of particles with a circularity a of 0.950 or higher.

Figure 17:
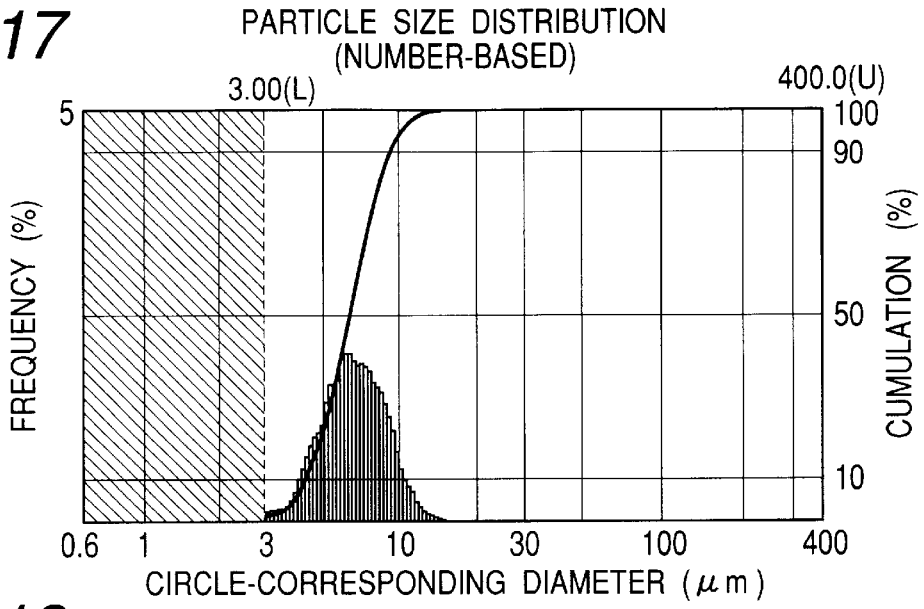
FIG. 17 is a graphic representation of the particle size distribution of median powder N-1.
Figure 18:
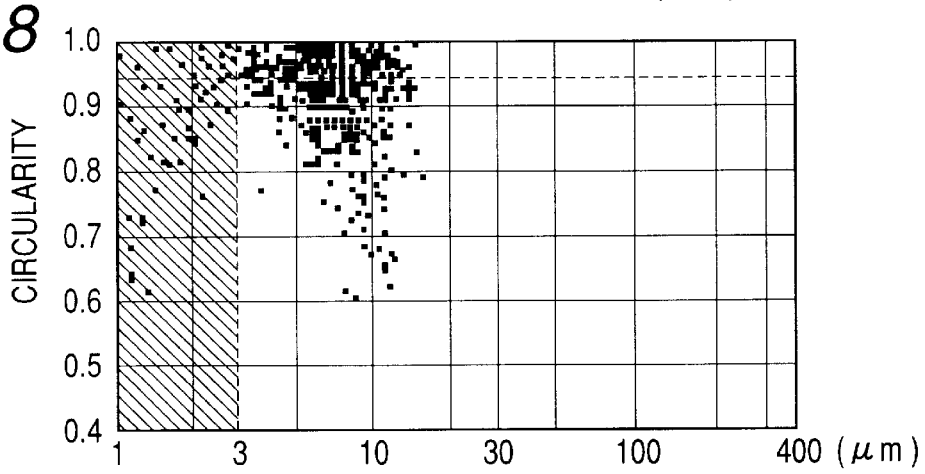
FIG. 18 is a graphic representation of the circularity distribution of median powder N-1.
Figure 19:
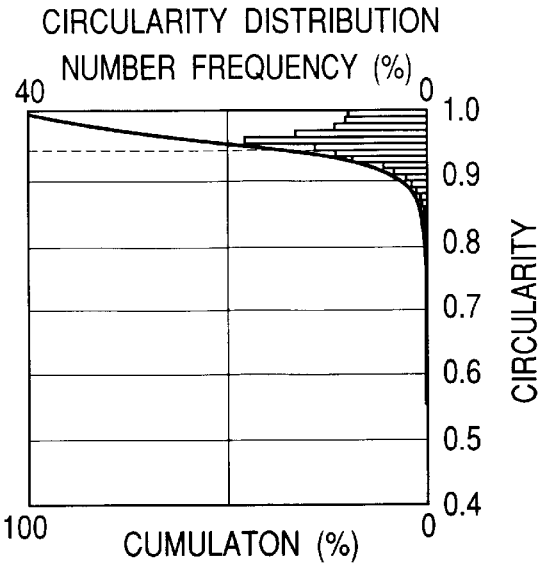
FIG. 19 is a graphic representation of the circularity-corresponding diameter of median powder N-1.

The particle size distribution, circularity distribution and circle-corresponding diameter measured with FPIA-1000 are graphically shown in FIGS. 17 to 19.

Evaluation was made in the same manner as in Example 1 to obtain the results shown in Table 6.

Comparative Example 2

The powder material (A) was finely pulverized and then classified using the unit system shown in FIG. 11. The conventional pulverizer shown in FIG. 13 was used as the collision air grinding machine. As a first classification means, the gas current classifier constructed as shown in FIG. 12 was used like Comparative Example 1. As the result, feeding the powder material at a rate of 8.0 kg/h, finely pulverized product O was obtained which had a weight average particle diameter of 5.9 $\mu$m and contained 72.3% by number of particles of 4.0 $\mu$m or smaller in particle diameter and 8.0% by volume of particles of 10.1 $\mu$m or larger in particle diameter.

Then, the finely pulverized product O thus obtained was introduced into the multi-division gas current classifier constructed as shown in FIG. 8, to effect classification at a rate of 10.0 kg/h. Among those having been obtained by classification, the coarse powder was collected by the collecting cyclone 129. Thereafter, it was introduced into the above collision air grinding machine 58 at a rate of 1.0 kg/h, and again introduced into the pulverization step.

The median powder O-1 thus obtained by classification in the above classification step was in a particle size distribution that it had a weight average particle diameter of 6.0 $\mu$m and contained 33.8% by number of particles of 4.0 $\mu$m or smaller in particle diameter and 4.1% by volume of particles of 10.1 $\mu$m or larger in particle diameter.

Here, the ratio of the weight of the median powder obtained finally to the total weight of the powder material having been introduced (i.e., classification yield) was 63%.

To 100 parts by weight of this median powder O-1, 1.2 parts by weight of hydrophobic fine silica powder (BET specific surface area: 300 m$^2$/g) was externally added using a Henschel mixer to obtain comparative magnetic toner (b).

The results of measurement with FPIA-1000 on the comparative magnetic toner (b) were as shown in Table 4.

Evaluation was made in the same manner as in Example 1 to obtain the results shown in Table 6.

Comparative Example 3

Powder material (P) was obtained in the same manner as in Example 1 except that the sulfur-containing copolymer (a) was changed to a monoazo metal complex (negative charge control agent). This powder material (P) was finely pulverized and then classified using the same unit system as that in Example 1. Finely pulverized product P and median powder P-1 obtained had particle size as shown in Tables 2 and 3. Also, the system was operated here under conditions shown in Table 5. Here, the ratio of the weight of the median powder obtained finally to the total weight of the powder material having been introduced (i.e., classification yield) was 81%.

To 100 parts by weight of this median powder P-1, 1.2 parts by weight of hydrophobic fine silica powder (BET specific surface area: 300 $m^2/g$) was externally added using a Henschel mixer to obtain comparative magnetic toner (c).

The results of measurement with FPIA-1000 on the comparative magnetic toner (c) were as shown in Table 4.

Evaluation was made in the same manner as in Example 1 to obtain the results shown in Table 6.

Comparative Example 4

Finely pulverized product Q and median powder Q-1 were obtained in the same manner as in Example 1 except that the powder material (P) prepared in Comparative Example 3 was used. The finely pulverized product Q and median powder Q-1 obtained had particle size as shown in Tables 2 and 3. Here, the system was operated under conditions shown in Table 5. Also, the ratio of the weight of the median powder obtained finally to the total weight of the powder material having been introduced (i.e., classification yield) was 83%.

To 100 parts by weight of this median powder Q-1, 1.2 parts by weight of hydrophobic fine silica powder (BET specific surface area: 300 $m^2/g$) was externally added using a Henschel mixer to obtain comparative magnetic toner (d).

The results of measurement with FPIA-1000 on the comparative magnetic toner (d) were as shown in Table 4.

Evaluation was made in the same manner as in Example 1 to obtain the results shown in Table 6.

EXAMPLES 19 & 20

Using the powder material (A), median powders A-7 and A-8 (classified products) were prepared in the same manner as in Example 1 except that the conditions for pulverization and classification using the unit system shown in FIG. 4 were changed. Finely pulverized products A7 and A8 and median powders A-7 and A-8 obtained had particle size as shown in Tables 2 and 3. Here, the system was operated under conditions shown in Table 5.

To 100 parts by weight of the median powder A-7, 1.5 parts by weight of hydrophobic fine silica powder (BET specific surface area: 180 $m^2/g$); and to 100 parts by weight of the median powder A-8, 1.0 part by weight of hydrophobic fine silica powder (BET specific surface area: 180 $m^2/g$) were externally added using a Henschel mixer to obtain magnetic toners (R) and (S), respectively.

The weight-average particle diameter and circularity (measured with FPIA-1000) of each of the magnetic toners (R) and (S) were as shown in Table 4.

Evaluation was made in the same manner as in Example 1 to obtain the results shown in Table 6.

Comparative Example 5

Using the powder material (A), median powder R-1 (classified products) was prepared in the same manner as in Comparative Example 1 except that the conditions for pulverization and classification using the unit system shown in FIG. 11 were changed. Finely pulverized product RI and median powder R-1 obtained had particle size as shown in Tables 2 and 3. Here, the system was operated under conditions shown in Table 5.

To 100 parts by weight of this median powder R-1, 1.5 parts by weight of hydrophobic fine silica powder (BET specific surface area: 180 $m^2/g$) was externally added using a Henschel mixer to obtain comparative magnetic toner (e).

The weight-average particle diameter and circularity (measured with FPIA-1000) of the comparative magnetic toner (e) were as shown in Table 4.

Evaluation was made in the same manner as in Example 1 to obtain the results shown in Table 6.

Inorganic Fine Powder Production Example 1

(Fine Strontium Titanate Powder)

Using a ball mill, 600 g of strontium carbonate and 320 g of titanium oxide were wet-process mixed for 8 hours, followed by filtration and drying. The resultant mixture was molded under a pressure of 0.49 MPa (5 $kg/cm^2$), followed by calcination at 1,100° C. for 8 hours. The calcined product obtained was mechanically pulverized to obtain fine strontium titanate powder (M-1) having a weight-average particle diameter of 2.0 $\mu$m.

Inorganic Fine Powder Production Examples 2 & 3

(Fine Strontium Titanate Powder)

The calcined product obtained in the same manner as in Production Example 1 was pulverized and classified under different conditions to obtain fine strontium titanate powders having a weight-average particle diameter of 4.8 $\mu$m (M-2) and a weight-average particle diameter of 0.3 $\mu$m (M-3).

Inorganic Fine Powder Production Example 4

(Fine Calcium Titanate Powder)

Using a ball mill, 505 g of calcium carbonate and 400 g of titanium oxide were wet-process mixed for 8 hours, followed by filtration and drying. The resultant mixture was molded under a pressure of 0.49 MPa (5 $kg/cm^2$), followed by calcination at 1,100° C. for 8 hours. The calcined product obtained was mechanically pulverized to obtain fine calcium titanate powder (M-4) having a weight-average particle diameter of 1.8 $\mu$m.

EXAMPLE 21

To 100 parts by weight of the median powder A-1 (toner particles) obtained in Example 1, 1.0 part by weight of hydrophobic fine silica powder (BET specific surface area: 300 $m^2/g$) and 4.0 parts by weight of the fine strontium titanate powder (M-1) were externally added to prepare magnetic toner (T). Its various properties are shown in Table 7.

EXAMPLE 22

To 100 parts by weight of the median powder A-1 (toner particles) obtained in Example 1, 1.0 part by weight of hydrophobic fine silica powder (BET specific surface area: 300 $m^2/g$) and 4.0 parts by weight of the fine strontium titanate powder (M-2) were externally added to prepare magnetic toner (U). Its various properties are shown in Table 7.

EXAMPLE 23

To 100 parts by weight of the median powder A-1 (toner particles) obtained in Example 1, 1.0 part by weight of hydrophobic fine silica powder (BET specific surface area: 300 $m^2/g$) and 4.0 parts by weight of the fine strontium titanate powder (M-3) were externally added to prepare magnetic toner (V). Its various properties are shown in Table 7.

EXAMPLE 24

To 100 parts by weight of the median powder A-1 (toner particles) obtained in Example 1, 1.0 part by weight of hydrophobic fine silica powder (BET specific surface area: 300 $m^2/g$) and 4.0 parts by weight of the fine calcium titanate powder (M-4) were externally added to prepare magnetic toner (W). Its various properties are shown in Table 7.

Comparative Example 6

To 100 parts by weight of the median powder N-1 (toner particles) obtained in Comparative Example 1, 1.0 part by weight of hydrophobic fine silica powder (BET specific surface area: 300 $m^2/g$) and 4.0 parts by weight of the fine strontium titanate powder (M-1) were externally added to prepare comparative magnetic toner (f). Its various properties are shown in Table 7.

Comparative Example 7

To 100 parts by weight of the median powder P-1 (toner particles) obtained in Comparative Example 3, 1.0 part by weight of hydrophobic fine silica powder (BET specific surface area: 300 $m^2/g$) and 4.0 parts by weight of the fine strontium titanate powder (M-1) were externally added to prepare comparative magnetic toner (g). Its various properties are shown in Table 7.

TABLE 1

| Sulfur = containing copolymer | Styrene/ acrylic mono- mer (wt. %) | Sulfonic = acid = containing monomer (wt. %) | Polymer- ization initiator (wt. %) | Weight = average molecular weight (Mw) | Glass trans- ition point (Tg) (° C.) | Residual styrene monomer (ppm) | Vola- tile matter | Average particle diameter (∞m) |
|---|---|---|---|---|---|---|---|---|
| (a) | 93 | 7 | 1 | 27,000 | 73 | 900 | ≦1% | 420 |
| (b) | 81 | 19 | 3 | 3,300 | 55 | 800 | ≦1% | 380 |
| (c) | 96 | 4 | 0.3 | 30,000 | 78 | 950 | ≦1% | 430 |
| (d) | 93 | 7 | 1 | 27,000 | 73 | 900 | ≦1% | 290 |
| (e) | 93 | 7 | 1 | 27,000 | 73 | 900 | ≦1% | 150 |
| (f) | 93 | 7 | 1 | 10,000 | 61 | 900 | ≦1% | 450 |
| (g) | 93.3 | 6.7 | 1.7 | 20,000 | 75 | 950 | ≦1% | 430 |
| (h) | 93.3 | 6.7 | 2 | 36,000 | 72 | 900 | ≦1% | 460 |
| (i) | 91.7 | 8.3 | 2 | 40,000 | 70 | 850 | ≦1% | 480 |
| (j) | 95 | 5 | 1.7 | 16,000 | 132 | 900 | ≦1% | 430 |
| (k) | 93.3 | 6.7 | 2 | 1,800 | 29 | 950 | ≦1% | 390 |
| (l) | 96 | 4 | 1 | 270,000 | 60 | 850 | ≦1% | 490 |
| (m) | 93.3 | 6.7 | 1 | 170,000 | 63 | 800 | ≦1% | 485 |

Using the magnetic toners (T), (U), (V) and (W) and the comparative magnetic toners (f) and (g), evaluation was made on transfer efficiency (%), fog and charging performance. Evaluation was also made in the following way on whether or not any faulty cleaning, drum abrasion and smeared images occurred. The results of evaluation are shown in Table 8.

Faulty Cleaning & Drum Abrasion

Using a remodeled copying machine of NP6085, manufactured by CANON INC., so remodeled that all the development, drum, optical and paper feed systems were adjusted to make the copying speed higher by 20%, images were reproduced on 100,000 sheets in a normal-temperature low-humidity environment (23° C./5%RH) to make evaluation on whether or not any faulty cleaning occurred and on the depth of drum abrasion. Here, the cleaning blade was brought into contact with the drum surface at a total pressure of 5.88 N (600 g). Cleaning evaluation ranks:

A: No faulty cleaning occurs.

B: Faulty cleaning is slightly recognizable on the white background.

C: Faulty cleaning is clearly recognizable on images.

Drum Abrasion Evaluation Ranks

A: Abrasion is in a depth of less than 10.0 Å.

B: Abrasion is in a depth of 10.0 Å to less than 25.0 Å.

C: Abrasion is in a depth of 25.0 Å to less than 50.0 Å.

D: Abrasion is in a depth of 50.0 Å to less than 150.0 Å.

E: Abrasion is in a depth of 150.0 Å or more.

Smeared Images

Using a remodeled copying machine of NP6085, manufactured by CANON INC., so remodeled that all the development, drum, optical and paper feed systems were adjusted to make the copying speed higher by 20%, images were reproduced on 500,000 sheets in a high-temperature high-humidity environment (32.5° C./85%RH) to examine whether or not any smearing images occurred. Here, the cleaning blade was brought into contact with the drum surface at a total pressure of 5.49 N (560 g).

Smeared-image Evaluation Ranks

A: Blank images have an area of zero.

B: Blank images have an area of less than 1 $cm^2$.

C: Blank images have an area of 1 $cm^2$ to less than 5 $cm^2$.

D: Blank images have an area of 5 $cm^2$ to less than 10 $cm^2$.

D: Blank images have an area of 10 $cm^2$ or more.

TABLE 2

Results of Particle-Size Measurement with Coulter Multisizer on Finely Pulverized Product before Classification

| Finely pulver- ized product | Weight-average particle diameter (μm) | Particles of 4.0 μm or smaller (% by number) | Particles of 10.1 μm or larger (% by volume) | Glass transition point (° C.) |
|---|---|---|---|---|
| A | 6.6 | 53.0 | 5.4 | 61 |
| A2 | 6.6 | 53.0 | 5.4 | 61 |
| A3 | 7.5 | 48.0 | 8.7 | 61 |
| A4 | 9.2 | 35.0 | 19.4 | 61 |
| A5 | 5.8 | 60.9 | 2.2 | 61 |
| A6 | 12.0 | 26.4 | 25.2 | 61 |
| A7 | 7.7 | 48.0 | 7.9 | 61 |
| A8 | 11.5 | 30.2 | 23.1 | 61 |
| B | 6.4 | 55.1 | 5.1 | 59 |
| C | 6.6 | 52.2 | 5.3 | 62 |
| D | 6.6 | 53.3 | 5.5 | 61 |
| E | 6.6 | 52.7 | 5.4 | 61 |
| F | 6.7 | 51.5 | 5.5 | 60 |
| G | 6.8 | 51.6 | 5.6 | 61 |
| H | 6.8 | 51.1 | 5.6 | 61 |
| I | 6.7 | 51.3 | 5.5 | 61 |

TABLE 2-continued

Results of Particle-Size Measurement with Coulter Multisizer on Finely Pulverized Product before Classification

| Finely pulverized product | Weight-average particle diameter (μm) | Particles of 4.0 μm or smaller (% by number) | Particles of 10.1 μm or larger (% by volume) | Glass transition point (° C.) |
|---|---|---|---|---|
| J | 6.6 | 53.0 | 5.4 | 64 |
| K | 6.7 | 50.8 | 5.5 | 57 |
| L | 6.5 | 54.1 | 5.4 | 60 |
| M | 6.8 | 52.0 | 5.6 | 60 |
| N | 6.7 | 63.3 | 11.1 | 61 |
| O | 5.9 | 72.3 | 8.0 | 61 |
| P | 6.6 | 53.0 | 5.4 | 60 |
| Q | 6.7 | 63.5 | 11.2 | 60 |
| R | 7.0 | 61.2 | 12.6 | 61 |

TABLE 3

Results of Particle-Size Measurement with Coulter Multisizer on Median Powder after Classification

| Toner particles | Weight-average particle diameter (μm) | Particles of 4.0 μm or smaller (% by number) | Particles of 10.1 μm or larger (% by volume) |
|---|---|---|---|
| A-1 | 6.5 | 20.5 | 3.8 |
| A-2 | 6.5 | 21.1 | 4.0 |
| A-3 | 7.4 | 15.0 | 7.0 |

TABLE 3-continued

Results of Particle-Size Measurement with Coulter Multisizer on Median Powder after Classification

| Toner particles | Weight-average particle diameter (μm) | Particles of 4.0 μm or smaller (% by number) | Particles of 10.1 μm or larger (% by volume) |
|---|---|---|---|
| A-4 | 9.1 | 10.0 | 18.0 |
| A-5 | 5.9 | 33.0 | 3.0 |
| A-6 | 11.6 | 6.6 | 24.0 |
| A-7 | 7.2 | 25.0 | 5.0 |
| A-8 | 10.8 | 18.0 | 14.0 |
| B-1 | 6.5 | 21.0 | 3.9 |
| C-1 | 6.5 | 19.9 | 3.6 |
| D-1 | 6.5 | 20.7 | 3.8 |
| E-1 | 6.5 | 20.5 | 3.8 |
| F-1 | 6.5 | 20.0 | 3.7 |
| G-1 | 6.5 | 20.2 | 3.8 |
| H-1 | 6.5 | 20.3 | 3.8 |
| I-1 | 6.5 | 21.0 | 3.9 |
| J-1 | 6.5 | 21.1 | 4.0 |
| K-1 | 6.5 | 19.8 | 3.6 |
| L-1 | 6.5 | 21.2 | 3.9 |
| M-1 | 6.5 | 21.2 | 3.9 |
| N-1 | 6.6 | 23.3 | 5.1 |
| O-1 | 6.0 | 33.8 | 4.1 |
| P-1 | 6.5 | 20.3 | 3.8 |
| Q-1 | 6.5 | 23.8 | 5.3 |
| R-1 | 6.4 | 35.0 | 2.8 |

TABLE 4

Results of Measurement of Weight-average Particle Diameter and Circularity Measurement with FPIA-1000 on Toner Particles

| Toner | Charge control agent | Wt.-av. particle diam. (μm) | Circularity (I) (%) | Circularity (II) (%) | (III) Ex-pression | (III) Right = hand member | Measured-particle concentration A (particles/μl) | Measured-particle concentration B (particles/μl) | Cut rate Z | * SD | ** Tg (° C.) |
|---|---|---|---|---|---|---|---|---|---|---|---|
| Example: | | | | | | | | | | | |
| 1 (A) | Resin(a) | 6.5 | 95.7 | 78.4 | (4) | 73.9 | 15,209.7 | 13,028.3 | 14.3 | 0.040 | 61 |
| 3 (B) | Resin(a) | 7.4 | 94.7 | 74.5 | (4) | 68.0 | 14,302.1 | 12,068.3 | 15.6 | 0.038 | 61 |
| 4 (C) | Resin(a) | 9.1 | 92.5 | 63.1 | (4) | 59.5 | 14,930.5 | 12,975.4 | 13.1 | 0.037 | 61 |
| 5 (D) | Resin(a) | 5.9 | 97.3 | 80.4 | (4) | 78.7 | 12,680.6 | 11,423.5 | 9.9 | 0.046 | 61 |
| 6 (E) | Resin(a) | 11.6 | 90.2 | 52.4 | (4) | 50.9 | 12,506.4 | 6,587.2 | 47.3 | 0.033 | 61 |
| 7 (F) | Resin(b) | 6.5 | 95.8 | 79.1 | (4) | 73.9 | 12,987.1 | 11,403.1 | 12.2 | 0.039 | 59 |
| 8 (G) | Resin(c) | 6.5 | 95.2 | 78.2 | (4) | 73.9 | 14,772.2 | 12,694.4 | 14.1 | 0.040 | 62 |
| 9 (H) | Resin(d) | 6.5 | 94.6 | 78.3 | (4) | 73.9 | 15,111.2 | 13,101.1 | 13.3 | 0.038 | 61 |
| 10 (I) | Resin(e) | 6.5 | 95.1 | 77.9 | (4) | 73.9 | 14,887.3 | 12,865.2 | 13.6 | 0.041 | 61 |
| 11 (J) | Resin(f) | 6.5 | 94.4 | 78.6 | (4) | 73.9 | 13,997.2 | 12,054.2 | 13.9 | 0.039 | 60 |
| 12 (K) | Resin(g) | 6.5 | 94.5 | 77.7 | (4) | 73.9 | 15,143.2 | 12,986.3 | 14.2 | 0.042 | 61 |
| 13 (L) | Resin(h) | 6.5 | 95.2 | 78.1 | (4) | 73.9 | 14,443.2 | 12,566.1 | 13.0 | 0.037 | 61 |
| 14 (M) | Resin(i) | 6.5 | 95.6 | 78.8 | (4) | 73.9 | 13,561.3 | 11,779.5 | 13.1 | 0.041 | 61 |
| 15 (N) | Resin(j) | 6.5 | 95.1 | 77.6 | (4) | 73.9 | 13,258.1 | 12,003.6 | 9.5 | 0.043 | 64 |
| 16 (O) | Resin(k) | 6.5 | 95.8 | 78.2 | (4) | 73.9 | 14,065.3 | 13,051.1 | 7.2 | 0.040 | 57 |
| 17 (P) | Resin(l) | 6.5 | 95.4 | 76.6 | (4) | 73.9 | 14,658.3 | 12,303.3 | 16.1 | 0.044 | 60 |
| 18 (Q) | Resin(m) | 6.5 | 93.9 | 73.3 | (4) | 73.9 | 16,421.9 | 13,832.6 | 15.8 | 0.042 | 60 |
| 19 (R) | Resin(a) | 7.2 | 95.3 | 75.7 | (6) | 73.3 | 15,324.6 | 9,271.4 | 39.5 | 0.032 | 61 |
| 20 (S) | Resin(a) | 10.8 | 91.0 | 61.3 | (6) | 58.7 | 14,873.4 | 6,232.0 | 58.1 | 0.033 | 61 |
| Comparative Example: | | | | | | | | | | | |
| 1 (a) | Resin(a) | 6.6 | 94.0 | 67.8 | (4) | 73.2 | 14,066.7 | 12,018.3 | 14.6 | 0.040 | 61 |
| 2 (b) | Resin(a) | 6.0 | 93.4 | 65.9 | (4) | 77.8 | 13,764.4 | 12,251.9 | 11.0 | 0.045 | 61 |
| 3 (c) | Monoazoe metal complex | 6.5 | 89.7 | 63.2 | (4) | 73.9 | 14,581.3 | 12,587.6 | 13.7 | 0.049 | 60 |

TABLE 4-continued

Results of Measurement of Weight-average Particle Diameter and Circularity Measurement with FPIA-1000 on Toner Particles

| Toner | Charge control agent | Wt.-av. particle diam. (μm) | Circularity (I) (%) | Circularity (II) (%) | (III) Ex-pres-sion | (III) Right = hand member | Measured-particle concentration A (particles/μl) | Measured-particle concentration B (particles/μl) | Cut rate Z | * SD | ** Tg (° C.) |
|---|---|---|---|---|---|---|---|---|---|---|---|
| 4 (d) | Monoazoe metal complex | 6.5 | 95.4 | 76.5 | (4) | 73.9 | 14,335.2 | 12,156.3 | 15.2 | 0.040 | 60 |
| 5 (e) | Resin(a) | 6.4 | 94.2 | 72.6 | (6) | 78.1 | 16,325.9 | 10,595.5 | 35.1 | 0.051 | 61 |

(I): 0.900 or higher particles
(II): 0.950 or higher particles, Y
(III): Number-based cumulative value of particles with circularity of 0.950 or higher
*Circularity standard deviation
**Toner glass transition point

TABLE 5

Unit System, Pulverization/Classification Conditions and Yield

| | System diagram | Pulverization step: Pulverizer | Rotor peri-pheral speed | Temp. T1 | Temp. T2 | ΔT | Feed rate | Classification step: Classifier | Feed rate | Yield |
|---|---|---|---|---|---|---|---|---|---|---|
| Example: | | | | | | | | | | |
| 1 | FIG. 4 | FIG. 5 | 115 | −10 | 46 | 56 | 20 | FIG. 9 | 22 | 82 |
| 2 | FIG. 3 | FIG. 5 | 115 | −10 | 46 | 56 | 20 | FIG. 8 | 22 | 78 |
| 3 | FIG. 4 | FIG. 5 | 110 | −10 | 42 | 52 | 25 | FIG. 9 | 25 | 83 |
| 4 | FIG. 4 | FIG. 5 | 108 | −10 | 41 | 51 | 20 | FIG. 9 | 33 | 84 |
| 5 | FIG. 4 | FIG. 5 | 140 | −10 | 52 | 62 | 15 | FIG. 9 | 20 | 78 |
| 6 | FIG. 4 | FIG. 5 | 100 | −10 | 40 | 50 | 20 | FIG. 9 | 38 | 86 |
| 7 | FIG. 4 | FIG. 5 | 115 | −10 | 45 | 55 | 20 | FIG. 9 | 22 | 81 |
| 8 | FIG. 4 | FIG. 5 | 115 | −10 | 45 | 55 | 20 | FIG. 9 | 22 | 80 |
| 9 | FIG. 4 | FIG. 5 | 115 | −10 | 47 | 57 | 20 | FIG. 9 | 22 | 81 |
| 10 | FIG. 4 | FIG. 5 | 115 | −10 | 46 | 56 | 20 | FIG. 9 | 22 | 82 |
| 11 | FIG. 4 | FIG. 5 | 115 | −10 | 47 | 57 | 20 | FIG. 9 | 22 | 80 |
| 12 | FIG. 4 | FIG. 5 | 115 | −10 | 45 | 55 | 20 | FIG. 9 | 22 | 81 |
| 13 | FIG. 4 | FIG. 5 | 115 | −10 | 45 | 55 | 20 | FIG. 9 | 22 | 81 |
| 14 | FIG. 4 | FIG. 5 | 115 | −10 | 45 | 55 | 20 | FIG. 9 | 22 | 81 |
| 15 | FIG. 4 | FIG. 5 | 115 | −10 | 46 | 56 | 20 | FIG. 9 | 22 | 81 |
| 16 | FIG. 4 | FIG. 5 | 115 | −10 | 45 | 55 | 20 | FIG. 9 | 22 | 82 |
| 17 | FIG. 4 | FIG. 5 | 115 | −10 | 47 | 57 | 20 | FIG. 9 | 22 | 80 |
| 18 | FIG. 4 | FIG. 5 | 115 | −10 | 46 | 56 | 20 | FIG. 9 | 22 | 81 |
| 19 | FIG. 4 | FIG. 5 | 115 | −10 | 53 | 63 | 20 | FIG. 9 | 22 | 84 |
| 20 | FIG. 4 | FIG. 5 | 115 | −10 | 54 | 64 | 20 | FIG. 9 | 22 | 86 |
| Comparative Example: | | | | | | | | | | |
| 1 | FIG. 11 | FIG. 13 | — | — | — | — | 10 | FIG. 8 | 13 | 69 |
| 2 | FIG. 11 | FIG. 13 | — | — | — | — | 8 | FIG. 8 | 10 | 63 |
| 3 | FIG. 4 | FIG. 5 | 115 | −10 | 46 | 56 | 20 | FIG. 9 | 22 | 81 |
| 4 | FIG. 4 | FIG. 5 | 110 | −10 | 50 | 60 | 20 | FIG. 9 | 22 | 83 |
| 5 | FIG. 11 | FIG. 13 | — | — | — | — | 10 | FIG. 8 | 11 | 71 |

TABLE 6

Evaluation Results

| | Toner | Transfer efficiency (%) | Fog | Charging performance |
|---|---|---|---|---|
| Example: | | | | |
| 1 | (A) | 96 | B | A |
| 3 | (B) | 95 | B | B |
| 4 | (C) | 91 | A | C |

TABLE 6-continued

Evaluation Results

| | Toner | Transfer efficiency (%) | Fog | Charging performance |
|---|---|---|---|---|
| 5 | (D) | 94 | C | B |
| 6 | (E) | 90 | A | C |
| 7 | (F) | 94 | B | B |
| 8 | (G) | 96 | B | B |
| 9 | (H) | 96 | A | A |

TABLE 6-continued

| | Evaluation Results | | | |
|---|---|---|---|---|
| | Toner | Transfer efficiency (%) | Fog | Charging performance |
| 10 | (I) | 94 | A | A |
| 11 | (J) | 95 | B | B |
| 12 | (K) | 95 | B | B |
| 13 | (L) | 94 | B | B |
| 14 | (M) | 95 | B | B |
| 15 | (N) | 94 | C | C |
| 16 | (O) | 93 | B | C |
| 17 | (P) | 94 | C | C |
| 18 | (Q) | 95 | C | B |
| 19 | (R) | 95 | B | B |
| 20 | (S) | 92 | B | C |
| Comparative Example: | | | | |
| 1 | (a) | 82 | B | B |
| 2 | (b) | 80 | C | B |
| 3 | (c) | 95 | B | E |
| 4 | (d) | 81 | C | E |
| 5 | (e) | 80 | B | C |

TABLE 8-continued

| | Evaluation Results | | | | | |
|---|---|---|---|---|---|---|
| | Toner | Transfer efficiency (%) | Fog | Cleaning performance | Drum abrasion | Smeared images |
| Comparative Example: | | | | | | |
| 6 | (f) | 83 | C | C | D | C |
| 7 | (g) | 95 | D | B | C | B |

What is claimed is:

1. A toner comprising toner particles containing at least (i) a binder resin, (ii) a colorant and (iii) a sulfur-containing compound selected from the group consisting of a sulfur-containing polymer and a sulfur-containing copolymer, wherein:

the toner has a weight-average particle diameter of from 5 μm to 12 μm; and at least 90% of the total number of particles of the toner having a diameter of 3 μm or larger have a circularity a of 0.900 or higher as determined from the following expression (1):

$$\text{Circularity } a = L_0/L \quad (1)$$

where $L_0$ represents the circumferential length of a circle having the same projected area as a particle image of a particle of the toner, and L represents the circumferential length of the particle image;

and in which:

a) the relationship between cut rate Z and toner weight-average particle diameter X satisfies the following expression (2):

$$\text{Cut rate } Z \leqq 5.3 \times X \quad (2)$$

TABLE 7

Results of Measurement of Weight-average Particle Diameter and Circularity Measurement with FPIA-1000 on Toner Particles

| Toner | Charge control agent | Wt.-av. particle diam. (μm) | Circularity (I) (%) | Circularity (II) (%) | (III) Ex-pression | (III) Right = hand member | Measured-particle concentration A (particles/μl) | Measured-particle concentration B (particles/μl) | Cut rate Z | * SD | ** Tg (° C.) |
|---|---|---|---|---|---|---|---|---|---|---|---|
| Example: | | | | | | | | | | | |
| 21 (T) | Resin(a) | 6.5 | 96.0 | 78.0 | (6) | 77.5 | 12,066.7 | 3,420.2 | 71.7 | 0.038 | 61 |
| 22 (U) | Resin(a) | 6.5 | 95.8 | 79.1 | (6) | 77.5 | 14,178.1 | 4,494.1 | 68.3 | 0.043 | 61 |
| 23 (V) | Resin(a) | 6.5 | 94.2 | 78.6 | (6) | 77.5 | 13,625.3 | 3,665.4 | 73.1 | 0.035 | 61 |
| 24 (W) | Resin(a) | 6.5 | 96.5 | 79.2 | (6) | 77.5 | 14,722.5 | 4,284.3 | 70.9 | 0.040 | 61 |
| Comparative Example: | | | | | | | | | | | |
| 6 (f) | Resin(a) | 6.6 | 92.1 | 70.3 | (6) | 76.8 | 13,872.5 | 3,884.5 | 72.0 | 0.044 | 61 |
| 7 (g) | Monoazoe metal complex | 6.5 | 90.1 | 69.4 | (6) | 77.5 | 14,213.6 | 4,107.7 | 71.7 | 0.046 | 60 |

(I): 0.900 or higher particles
(II): 0.950 or higher particles, Y
(III): Number-based cumulative value of particles with circularity of 0.950 or higher
*Circularity standard deviation
**Toner glass transition point

TABLE 8

| | Evaluation Results | | | | | |
|---|---|---|---|---|---|---|
| | Toner | Transfer efficiency (%) | Fog | Cleaning performance | Drum abrasion | Smeared images |
| Example: | | | | | | |
| 21 | (T) | 96 | B | A | B | A |
| 22 | (U) | 94 | B | A | B | C |
| 23 | (V) | 93 | B | B | B | B |
| 24 | (W) | 95 | B | B | B | C |

provided that the cut rate Z is represented by the following expression (3):

$$Z=(1-B/A)\times 100 \quad (3)$$

where A is the particle concentration of the whole measured particles as measured with a flow-type particle image analyzer FPIA-1000, manufactured by Toa Iyou Denshi K. K., and B is the particle concentration of measured particles of 3 μm or larger in circle-corresponding diameter; and for the toner particles of 3 μm or larger in diameter having a number-based circularity distribution of the circularity a, the relationship between the number-based cumulative value Y of particles with a circularity a of 0.950 or higher and the toner weight-average particle diameter X satisfies the following expression (4):

$$\text{Number-based cumulative value } Y \text{ of particles with a circularity } a \text{ of 0.950 or higher} \geqq \exp 5.51\times X^{-0.645} \quad (4)$$

provided that the toner weight-average particle diameter X is from 5.0 μm to 12.0 μm; or b) the relationship between the cut rate Z and the toner weight-average particle diameter X satisfies the following expression (5):

$$\text{Cut rate } Z>5.3\times X \quad (5);$$

and for the toner particles of 3 μm or larger in diameter having a number-based circularity distribution of the circularity a, the relationship between the number-based cumulative value Y of particles with a circularity a of 0.950 or higher and the toner weight-average particle diameter X satisfies the following expression (6):

$$\text{Number-based cumulative value } Y \text{ of particles with a circularity } a \text{ of 0.950 or higher} \geqq \exp 5.37\times X^{-0.545} \quad (6)$$

provided that the toner weight-average particle diameter X is from 5.0 μm to 12.0 μm.

2. The toner according to claim 1, wherein said sulfur-containing compound is a polymer having a sulfonic acid group.

3. The toner according to claim 1, wherein said sulfur-containing compound is a copolymer having a sulfonic acid group.

4. The toner according to claim 1, wherein said sulfur-containing compound is a copolymer of an acrylamide sulfonic acid monomer with a vinyl monomer.

5. The toner according to claim 1, wherein said sulfur-containing compound is a copolymer of 2-acrylamido-2-methylpropanesulfonic acid with a vinyl monomer.

6. The toner according to claim 1, wherein said sulfur-containing compound is a copolymer of a styrene monomer and an acrylic monomer with a sulfonic-acid-containing acrylamide monomer.

7. The toner according to claim 1, wherein said sulfur-containing compound is a negative charge control agent.

8. The toner according to claim 1, wherein said sulfur-containing compound has a weight-average molecular weight Mw of from 2,000 to 200,000.

9. The toner according to claim 1, wherein said sulfur-containing compound has a weight-average molecular weight Mw of from 17,000 to 100,000.

10. The toner according to claim 1, wherein said sulfur-containing compound has a weight-average molecular weight Mw of from 27,000 to 50,000.

11. The toner according to claim 1, wherein said sulfur-containing compound has a glass transition temperature Tg of from 30° C. to 120° C.

12. The toner according to claim 1, wherein said sulfur-containing compound has a glass transition temperature Tg of from 50° C. to 100° C.

13. The toner according to claim 1, wherein said sulfur-containing compound has a glass transition temperature Tg of from 70° C. to 95° C.

14. The toner according to claim 1, wherein said sulfur-containing compound is a copolymer of a styrene monomer and an acrylic monomer with 2-acrylamido-2-methylpropanesulfonic acid.

15. The toner according to claim 1, wherein said toner particles are toner particles obtained by melt-kneading a mixture containing at least a binder resin, a colorant and a sulfur-containing compound, cooling the resultant kneaded product, crushing the resultant cooled product, and pulverizing the resultant crushed product by means of a mechanical grinding machine.

16. The toner according to claim 15, wherein said sulfur-containing compound has been pulverized before the step of melt kneading, to have an average particle diameter of 300 μm or smaller.

17. The toner according to claim 15, wherein said sulfur-containing compound has been pulverized before the step of melt kneading, to have an average particle diameter of 150 μm or smaller.

18. The toner according to claim 15, wherein said crushed product is pulverized by means of the mechanical grinding machine and the resultant pulverized product is classified by means of an air classifier to obtain the toner particles.

19. The toner according to claim 18, wherein said toner particles are toner particles formed from a median powder obtained by:

melt-kneading the mixture containing at least a binder resin, a colorant and a sulfur-containing compound, cooling the obtained kneaded product, and thereafter crushing the cooled product by a crushing means;

introducing the crushed product obtained as a powder material, into a first constant-rate feeder;

introducing the powder material in a stated quantity into a mechanical grinding machine from the first constant-rate feeder via a powder material inlet of the mechanical grinding machine; the mechanical grinding machine having at least a rotor comprising a rotator attached to the center rotating shaft and a stator which is provided around the rotor, keeping a certain space between it and the rotor surface, and being so constructed that a circular space formed by keeping the space stands airtight;

rotating the rotor of the mechanical grinding machine at a high speed to finely pulverize the powder material to form a finely pulverized product having a weight-average particle diameter of from 5 to 12 μm and containing 70% by number or less of particles of 4.0 μm or smaller in particle diameter and 25% by volume or less of particles of 10.1 μm or larger in particle diameter;

discharging the finely pulverized product from a powder material discharge opening of the mechanical grinding machine and introducing the finely pulverized product into a second constant-rate feeder;

introducing the finely pulverized product in a stated quantity into a multi-division gas current classifier which classifies the powder material by utilizing crossed gas streams and the Coanda effect;

classifying the finely pulverized powder in the multi-division gas current classifier into at least fine powder, median powder and coarse powder to obtain the median powder; and mixing the classified coarse powder with the powder material and introducing them into the mechanical grinding machine to carry out pulverization and classification to obtain the median powder.

20. The toner according to claim 1, which contains 40% by number or less of particles of 4.0 μm or smaller in particle diameter and 25% by volume or less of particles of 10.1 μm or larger in particle diameter.

21. The toner according to claim 1, wherein the toner has a circularity standard deviation SD of from 0.030 to 0.045.

22. The toner according to claim 1, wherein said sulfur-containing compound has an acid value of from 3 mg·KOH/g to 80 mg·KOH/g.

23. The toner according to claim 1, wherein said sulfur-containing compound has an acid value of from 5 mg·KOH/g to 40 mg·KOH/g.

24. The toner according to claim 1, wherein said sulfur-containing compound has an acid value of from 10 mg·KOH/g to 30 mg·KOH/g.

25. The toner according to claim 1, wherein said sulfur-containing compound has volatile matter of from 0.01% to 2.0%.

26. The toner according to claim 1, wherein said sulfur-containing compound has a volatile matter of from 0.01% to 1.0%.

27. The toner according to claim 1, wherein said sulfur-containing compound is contained in an amount of from 0.01 part by weight to 15 parts by weight based on 100 parts by weight of the binder resin.

28. The toner according to claim 1, wherein said sulfur-containing compound is contained in an amount of from 0.10 part by weight to 10 parts by weight based on 100 parts by weight of the binder resin.

29. An image-forming method comprising the steps of:

forming an electrostatic latent image on an electrostatic-image-bearing member;

developing the electrostatic latent image with a toner held in a developing means, to form a toner image;

transferring the toner image thus formed, to a transfer medium via, or not via, an intermediate transfer member;

fixing the toner image held on the transfer medium, to the transfer medium by heat-and-pressure fixing means;

wherein:

said toner comprises toner particles containing at least (i) a binder resin, (ii) a colorant and (iii) a sulfur-containing compound selected from the group consisting of a sulfur-containing polymer and a sulfur-containing copolymer, said toner has a weight-average particle diameter of from 5 μm to 12 μm; and at least 90% of the total number of toner particles having a diameter of 3 μm or larger have a circularity a of 0.900 or higher as determined from the following expression (1):

$$\text{Circularity } a = L_0/L \quad (1)$$

where $L_0$ represents the circumferential length of a circle having the same projected area as a particle image of a particle of the toner, and L represents the circumferential length of the particle image;

and in which;

a) the relationship between cut rate Z and toner weight-average particle diameter X satisfies the following expression (2):

$$\text{Cut rate } Z \leqq 5.3 \times X \quad (2)$$

provided that the cut rate Z is represented by the following expression (3):

$$Z = (1 - B/A) \times 100 \quad (3)$$

where A is the particle concentration of the whole measured particles as measured with a flow-type particle image analyzer FPIA-1000, manufactured by Toa Iyou Denshi K. K., and B is the particle concentration of measured particles of 3 μm or larger in circle-corresponding diameter; and for the toner particles of 3 μm or larger in diameter having a number-based circularity distribution of the circularity a, the relationship between the number-based cumulative value Y of particles with a circularity a of 0.950 or higher and the toner weight-average particle diameter X satisfies the following expression (4):

$$\text{Number-based cumulative value } Y \text{ of particles with a circularity } a \text{ of 0.950 or higher} \geqq \exp 5.51 \times X^{-0.645} \quad (4)$$

provided that the toner weight-average particle diameter X is from 5.0 μm to 12.0 μm; or b) the relationship between the cut rate Z and the toner weight-average particle diameter X satisfies the following expression (5):

$$\text{Cut rate } Z > 5.3 \times X \quad (5);$$

and for the toner particles of 3 μm or larger in diameter having a number-based circularity distribution of the circularity a, the relationship between the number-based cumulative value Y of particles with a circularity a of 0.950 or higher and the toner weight-average particle diameter X satisfies the following expression (6):

$$\text{Number-based cumulative value } Y \text{ of particles with a circularity } a \text{ of 0.950 or higher} \geqq \exp 5.37 \times X^{-0.545} \quad (6)$$

provided that the toner weight-average particle diameter X is from 5.0 μm to 12.0 μm.

30. The method according to claim 29, wherein;

said electrostatic-image-bearing member is electrostatically charged by a contact charging means to which a bias has been applied;

the electrostatic-image-bearing member thus charged is exposed to light to form a digital latent image;

the digital latent image is developed with the toner held in the developing means to form the toner image; and the toner image is transferred to the transfer medium via, or not via, the intermediate transfer member by a contact transfer means to which a bias has been applied.

31. The method according to claim 29, wherein;

said toner is a magnetic toner having magnetic-toner particles containing a magnetic material; and said developing means has a developing sleeve provided internally with a magnetic-field-generating means, and an elastic blade for forming a magnetic-toner layer on the developing sleeve.

32. The method according to claim 29, wherein said toner is the toner according to any one of claims 2 to 28.

33. A process cartridge comprising an electrostatic-image-bearing member and a developing means for developing with a toner an electrostatic latent image formed on the electrostatic-image-bearing member;

said electrostatic-image-bearing member and said developing means being supported in one unit to constitute the process cartridge, and the process cartridge being detachably mountable to the main body of an image-forming apparatus; wherein:

said toner comprises toner particles containing at least (i) a binder resin, (ii) a colorant and (iii) a sulfur-containing compound selected from the group consisting of a sulfur-containing polymer and a sulfur-containing copolymer, wherein;

said toner has a weight-average particle diameter of from 5 μm to 12 μm; and at least 90% of the total number of particles of the toner having a diameter of 3 μm or larger have a circularity a of 0.900 or higher as determined from the following expression (1):

$$\text{Circularity } a = L_0/L \quad (1)$$

where $L_0$ represents the circumferential length of a circle having the same projected area as a particle image of a particle of the toner, and L represents the circumferential length of the particle image;

and in which:

a) the relationship between cut rate Z and toner weight-average particle diameter X satisfies the following expression (2):

$$\text{Cut rate } Z \leqq 5.3 \times X \quad (2)$$

provided that the cut rate Z is represented by the following expression (3):

$$Z = (1 - B/A) \times 100 \quad (3)$$

where A is the particle concentration of the whole measured particles as measured with a flow-type particle image analyzer FPIA-1000, manufactured by Toa Iyou Denshi K. K., and B is the particle concentration of measured particles of 3 μm or larger in circle-corresponding diameter; and for the toner particles of 3 μm or larger in diameter having a number-based circularity distribution of the circularity a, the relationship between the number-based cumulative value Y of particles with a circularity a of 0.950 or higher and the toner weight-average particle diameter X satisfies the following expression (4):

$$\text{Number-based cumulative value } Y \text{ of particles with a circularity } a \text{ of 0.950 or higher} \geqq \exp 5.51 \times X^{-0.645} \quad (4)$$

provided that the toner weight-average particle diameter X is from 5.0 μm to 12.0 μm; or b) the relationship between the cut rate Z and the toner weight-average particle diameter X satisfies the following expression (5):

$$\text{Cut rate } Z > 5.3 \times X \quad (5);$$

and for the toner particles of 3 μm or larger in diameter having a number-based circularity distribution of the circularity a, the relationship between the number-based cumulative value Y of particles with a circularity a of 0.950 or higher and the toner weight-average particle diameter X satisfies the following expression (6):

$$\text{Number-based cumulative value } Y \text{ of particles with a circularity } a \text{ of 0.950 or higher} \geqq \exp 5.37 \times X^{-0.545} \quad (6)$$

provided that the toner weight-average particle diameter X is from 5.0 μm to 12.0 μm.

34. The process cartridge according to claim 33, wherein said electrostatic-image-bearing member is a photosensitive drum.

35. The process cartridge according to claim 33, which further comprises a contact charging means.

36. The process cartridge according to claim 33, wherein said toner is the toner according to any one of claims 2 to 28.

* * * * *

UNITED STATES PATENT AND TRADEMARK OFFICE

CERTIFICATE OF CORRECTION

PATENT NO. : 6,537,715 B2
DATED : March 25, 2003
INVENTOR(S) : Yuichi Mizoo et al.

Figure 10:
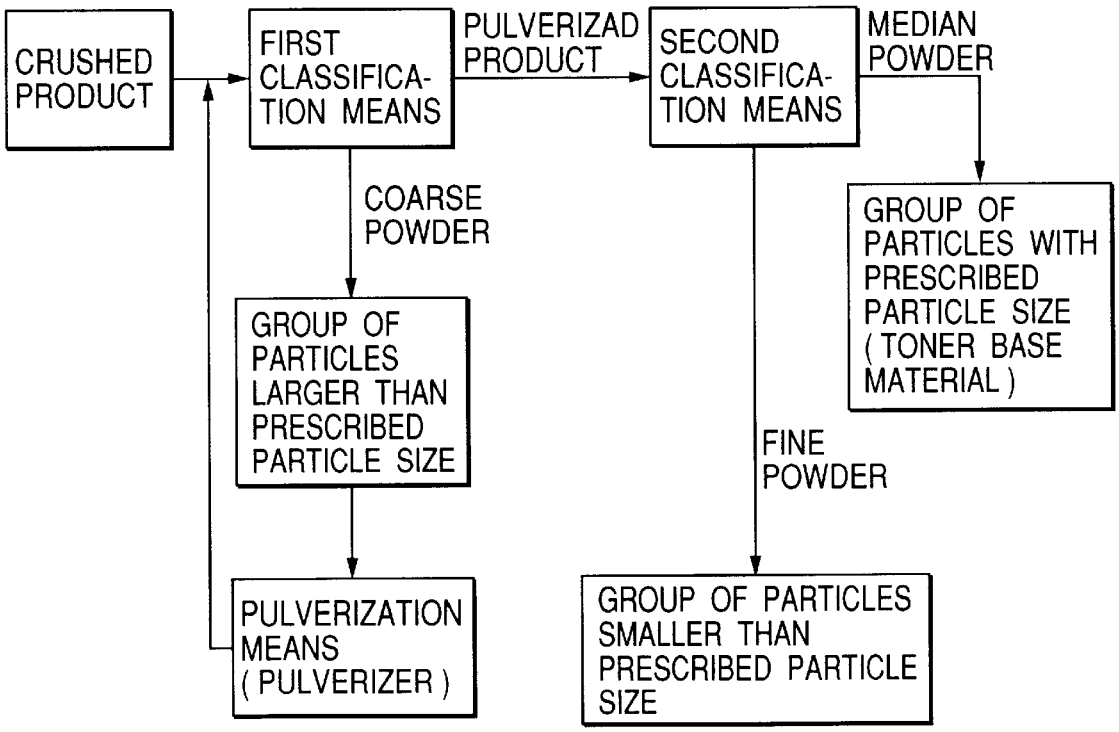
FIG. 10 PRIOR ART
FIG. 10 is a flow chart for describing a conventional process for producing toner particles.

It is certified that error appears in the above-identified patent and that said Letters Patent is hereby corrected as shown below:

Drawings,
Sheet No. 9, Figure 10 "PULVERIZAD" should read -- PULVERIZED --.

Column 1,
Line 26, "function," should read -- functions, --.
Line 28, "become required to have much serverer performances" should read -- been required to meet more severe performance standards --.
Line 40, "more tends" should read -- tends more --.
Line 41, "less" should be deleted.
Line 42, "occur," should read -- occur less, --.
Line 48, "more" should be deleted, and "toners." should read -- toners more. --.

Column 2,
Line 17, "can not" should read -- cannot --.
Line 37, "function," should read -- functions, --.
Line 65, "Application" should read -- Applications --.

Column 3,
Line 12, "Application" should read -- Applications --.

Column 4,
Line 28, "can not" should read -- cannot --.

Column 5,
Line 31, "severer" should read -- more severe --.
Line 57, "make" should read -- makes --.

Column 11,
Line 20, "makes small" should read -- reduces --.
Line 26, "round" should read -- rounded --.
Line 57, "contains" should read -- contain --.
Line 60, "have" should read -- has --.
Line 64, "has" should read -- have --.

Column 12,
Line 32, "it may" should read -- may it --.
Line 34, "can not" should read -- cannot --.
Line 44, "less act" should read -- act less --.
Line 61, "too greatly act" should read -- act too much --.

UNITED STATES PATENT AND TRADEMARK OFFICE

CERTIFICATE OF CORRECTION

PATENT NO. : 6,537,715 B2
DATED : March 25, 2003
INVENTOR(S) : Yuichi Mizoo et al.

It is certified that error appears in the above-identified patent and that said Letters Patent is hereby corrected as shown below:

Column 14,
Line 21, "rather more occur" should read -- occur rather more --.
Line 66, "complicate" should read -- complicated --.

Column 16,
Line 17, "a-methylene" should read -- α-methylene --.
Line 36, "combination" should read -- a combination --.

Column 17,
Line 8, "a" should read -- as --.

Column 20,
Line 56, "trimethyrolpropane" should read -- trimethylolpropane --.
Line 65, "tetramethyrolmethane" should read -- tetramethylolmethane --.

Column 22,
Line 36, "complicate" should read -- complicated --.
Line 53, "a" should be deleted.

Column 23,
Line 3, "measurement." should read -- measurements. --.
Line 13, "combination" should read -- combinations --.

Column 26,
Line 24, "($Y_3Fe5O_{12}$)," should read -- ($Y_3Fe_5O_{12}$), --.
Line 25, "($Gd_3Fe5O_{12}$)," should read -- ($Gd_3Fe_5O_{12}$), --.
Line 26, "($PbFe12O_{19}$)," should read -- ($PbFe_{12}O_{19}$), --.

Column 27,
Line 56, "us e" should read -- use --.

Column 28,
Line 42, "provides" should read -- provide --.

Column 29,
Line 16, "can not" should read -- cannot --.

Column 31,
Lines 28 and 51, "so" should read -- such --.

UNITED STATES PATENT AND TRADEMARK OFFICE

CERTIFICATE OF CORRECTION

PATENT NO. : 6,537,715 B2
DATED : March 25, 2003
INVENTOR(S) : Yuichi Mizoo et al.

It is certified that error appears in the above-identified patent and that said Letters Patent is hereby corrected as shown below:

Column 36,
Line 30, "is" should read -- are --.
Line 59, "been more" should read -- be further --.

Column 38,
Line 64, "Is" should read -- is --.

Column 39,
Line 6, "Iron" should read -- iron --.
Line 7, "b e" should read -- be --.
Line 44, "Example" should read -- Examples --.

Column 47,
Lines 35 and 58, "that it had" should read -- such that it had --.

Column 48,
Line 38, "that it had" should read -- such that it had --.

Column 52,
Table 1,

| | | |
|---|---|---|
| "Sulfur = " | should read | -- Sulfur- --; |
| "Sulfonic = acid = " | should read | -- Sulfonic- acid- --; |
| "Weight = " | should read | -- Weight- --; and |
| "∞m)" | should read | -- ($\mu$m) --. |

Column 54,
Table 4,

| | | |
|---|---|---|
| "Right = " | should read | -- Right- --; and |
| "Monoazoe" | should read | -- Monoazo --. |

Column 55,
Table 4,

| | | |
|---|---|---|
| "Right = " | should read | -- Right- --; and |
| "Monoazoe" | should read | -- Monoazo --. |

UNITED STATES PATENT AND TRADEMARK OFFICE

CERTIFICATE OF CORRECTION

PATENT NO. : 6,537,715 B2
DATED : March 25, 2003
INVENTOR(S) : Yuichi Mizoo et al.

It is certified that error appears in the above-identified patent and that said Letters Patent is hereby corrected as shown below:

Column 57,
Table 6, "20 (S) 92 B C" should read
-- 20 (S) 92 B B --.
Table 7, "Right = " should read -- Right- --; and
"Monoazoe" should read --Monoazo --.

Column 61,
Line 47, "means;" should read -- means, --.

Column 62,
Lines 49 and 60, "wherein;" should read -- wherein, --.

Column 63,
Line 11, "apparatus; wherein," should read -- apparatus, ¶wherein, --.
Line 16, "wherein;" should read -- wherein: --.

Signed and Sealed this

Eighth Day of February, 2005

JON W. DUDAS
*Director of the United States Patent and Trademark Office*